United States Patent [19]

Kishimoto et al.

[11] Patent Number: 4,745,048

[45] Date of Patent: May 17, 1988

[54] SILVER HALIDE COLOR PHOTOGRAPHIC MATERIAL AND METHOD OF PROCESSING THE SAME USING AN IMPROVED DESILVERING ACCELERATOR

[75] Inventors: Shinzo Kishimoto; Kei Sakanoue; Noboru Sasaki, all of Minami-ashigara, Japan

[73] Assignee: Fuji Photo Film Co., Ltd., Kanagawa, Japan

[21] Appl. No.: 870,909

[22] Filed: Jun. 5, 1986

[30] Foreign Application Priority Data

Jun. 7, 1985 [JP] Japan ..... 60-123945
Dec. 9, 1985 [JP] Japan ..... 60-276622

[51] Int. Cl.[4] ..... G03C 5/44; G03C 5/38; G03C 1/46; G03C 7/32

[52] U.S. Cl. ..... 430/376; 430/381; 430/383; 430/393; 430/430; 430/460; 430/461; 430/474; 430/503; 430/548; 430/554; 430/555

[58] Field of Search ..... 430/383, 376, 393, 460, 430/461, 430, 381, 503, 474, 548, 554, 555

[56] References Cited

U.S. PATENT DOCUMENTS 3,042,520 7/1962 Johnson et al. ..... 430/393
3,241,966 3/1966 Heilmann et al. ..... 430/393
3,893,858 7/1975 Wabnitz et al. ..... 430/393
4,436,808 3/1984 Yagihara et al. ..... 430/548 X
4,546,070 10/1985 Kishimoto et al. ..... 430/393
4,552,834 11/1985 Lau et al. ..... 430/393
4,639,415 1/1987 Kaneko et al. ..... 430/558

OTHER PUBLICATIONS

British Journal of Photography Annual 1984: pp. 4, 187–191, 195–200, Date: 12/23/1983.

*Primary Examiner*—Mukund J. Shah
*Attorney, Agent, or Firm*—Burns, Doane, Swecker & Mathis

[57] ABSTRACT

A quick desilvering process of silver halide color photographic materials is provided, wherein the total amount of coated silver is 5.2 g/m$^2$ or less, an average iodide content in the whole light-sensitive silver halide grains is 5.5 mol % or less; and a 2-equivalent magenta polymer coupler is included as a magenta coupler, and bleach-fixing treatment, or bleaching treatment at a pH of 5.5 or less, or desilvering treatment in the presence of a specific desilvering accelerator is carried out. Silver halide color photographic materials which permit the quick desilvering are also provided. These contain a specific desilvering accelerator.

18 Claims, No Drawings

SILVER HALIDE COLOR PHOTOGRAPHIC MATERIAL AND METHOD OF PROCESSING THE SAME USING AN IMPROVED DESILVERING ACCELERATOR

BACKGROUND OF THE INVENTION

1. Field of the Invention

The present invention relates to a silver halide color photographic material and method of processing the same, particularly light-sensitive materials suitable to a quick and convenient process and a method of processing the same.

2. Description of the Prior Art

Generally, a basic process of processing color photographic materials consists of a color developing step and a desilvering step. In the color developing step, exposed silver halide is reduced by a color developing agent to yield silver and, at the same time, the color developing agent reacts with a color forming agent (a coupler) to produce a dye image. In the subsequent desilvering step, the silver produced in the color developing step is oxidized by an oxidizing agent called a bleaching agent and, then, is dissolved by a complexing agent for silver ion called a fixing agent. By passing through the desilvering step, only the dye image is formed on the color photographic materials.

The above desilvering step is conducted by two baths, i.e., a bleaching bath containing a bleaching agent and a fixing bath containing a fixing agent, or by a single bath of a bleach-fixing solution containing both a bleaching agent and a fixing agent.

In an actual developing process, there are various auxiliary steps to maintain photographic and physical quality of an image or to improve preservability of an image in addition to the above basic steps. For instance, there are a hardner bath, a stop bath, an image stabilization bath and a water washing bath.

Generally, ferricyanide, bichromate, ferric chloride, ferric aminopolycarboxylate complex and persulfate are known as a bleaching agent.

However, ferricyanide and bichromate have a pollution problem due to cyan compounds and hexavalent chromium, and therefore, some special treatment equipments are required to use these. Further, ferric chloride has problems such as formation of iron hydroxide in a water washing step thereafter and generation of stain and, accordingly, has various obstacles in practical use. Persulfate has a disadvantage that its bleaching ability is very weak and bleaching takes very long time. Regarding this point, a method of enhancing the bleaching action using a bleach accelerator together has been proposed. However, this method is difficult to be used because, for instance, there is a regulation about persulfate as a dangerous substance and various special cares are required in storage.

Ferric aminopolycarboxylate complex, particularly ferric ethylendiaminetetraacetate complex or ferric diethylenetriaminepentaacetate complex, has only a little pollution problem and has no problem in storage unlike persulfate and, accordingly, is the most generally used bleaching agent. However, the bleaching ability of ferric aminopolycarboxylate complex is not always sufficient. It may attain the envisaged purpose when low speed silver halide photographic materials which mainly uses a silver chlorobromide emulsion is subjected to a bleaching or bleach-fixing process. However, when high speed color photographic materials which mainly use a silver chlorobromoiodide or iodobromide emulsion and is color sensitized, particularly color reversal photographic materials used for taking photographs using an emulsion of a high silver content or color negative photographic materials used for taking photographs, are processed, disadvantageous such as insufficient desilvering and long bleaching time arise.

For instance, when negative photographic materials used for taking photographs are bleached using a bleaching solution of ferric aminopolycarboxylate, at least 4 minutes are required for bleaching and, in addition, complicated cares should be taken to maintain a bleaching power, such as pH control of the bleaching bath and aeration. Even though these cares are taken, insufficient bleach often takes place in fact.

Further, processing by a fixing bath for at least 3 minutes is required for desilvering following the bleaching step. It is strongly desired to shorter such a long period of time for desilvering.

A bleach-fixing solution containing ferric aminopolycarboxylate complex and thiosulfate in a single bath is known as a means of accelerating the desilvering step as described in German Pat. No. 866,605. However, when ferric aminopolycarboxylate which has a weak oxidizing power (bleaching ability) is combined with thiosulfate which has a reducing ability, the bleaching ability of the former are extremely weakened and it is very difficult to sufficiently desilver color photographic materials used for taking photographs of a high speed and a high silver content. Thus, the above solution cannot be used in practice. Of course, many improvements have been made to solve the above draw backs of such a bleach-fixing solution. For instance, UK Pat. No. 926,569 and Japanese Patent Publication No. 11,854/1978 disclose a method of adding iodides and bromides. Japanese Patent Publication (unexamined) No. 95834/1973 discloses a method of incorporating a high concentration of ferric aminopolycarboxylate complex salt using triethanolamine. However, these methods attain merely insufficient effects and cannot be used for practical purpose.

Further, beside the insufficient desilvering ability, a bleach-fixing solution has a serious draw back that it reduces cyan dye formed in color development into leuco dye, which results in deteriorated color reproduction. It is known that this draw back can be improved by raising a pH of the bleach-fixing solution as described in U.S. Pat. No. 3,773,510. However, to raise a pH further weakens the bleaching ability on the contrary and, therefore, this cannot be practically used. U.S. Pat. No. 3,189,452 discloses a method where leuco dye is oxidized back to cyan dye by a ferricyanide bleaching solution after bleach-fixing. However, the use of ferricyanide has the aforesaid pollution problem. Further, even if bleaching is conducted after a bleach-fixing step, the effect of decreasing an amount of the remaining silver is almost not attained.

As another method for raising the bleaching ability of ferric aminopolycarboxylate complex, it has been proposed to add various bleaching accelerators to a bleaching bath, a bleach-fixing bath or a bath preceding these.

For instance, there can be mentioned various mercapto compounds described in U.S. Pat. No. 3,893,858, UK Pat. No. 1,138,842 and Japanese Patent Publication (unexamined) No. 141623/1978, compounds having a disulfide bond described in Japanese Patent Publication (unexamined) No. 95630/1978, thiazolidine derivatives described in Japanese Patent Publication No. 9854/1978, isothiourea derivatives described in Japanese Patent Publication (unexamined) No. 94927/1978, thiourea derivatives described in Japanese Patent Publication No. 8506/1970 and Japanese Patent Publication No. 26586/1974, thioamide compounds described in Japanese Patent Publication (unexamined) No. 42349/1974, and dithiocarbamates described in Japanese Patent Publication (unexamined) No. 26506/1980.

Some of these bleaching accelerators surely show the bleaching acceleration effect. However, their effects not always sufficient and shortening of the process time has not yet been successfully attained only by these techniques.

SUMMARY OF THE INVENTION

Accordingly, the purpose of the invention is to provide a method for the quick desilvering of color photographic materials.

The second purpose of the invention is to provide color photographic materials which can be quickly desilvered.

It has been found that the quick processing is attained by a method where photographic materials in which the total amount of coated silver contained is 5.2 g/m$^2$ or less, the average iodide content in the light-sensitive silver halide grains as a whole is 5.5 mol% or less and a 2-equivalent magenta polymer coupler is included as a magenta coupler is bleach-fixed, or is processed in the presence of a bleaching (desilvering) accelerator represented by general formulae I or II as described below, or is processed by a bleaching solution having a pH of 5.5 or less.

DETAILED DESCRIPTION OF THE INVENTION

Generally, if a 4-equivalent coupler is replaced by a 2-equivalent coupler, the amount of coated silver can be decreased and the layer thickness can also be made thinner, which is advantageous to desilvering. However, were use of a 2-equivalent coupler in silver halide color photographic light-sensitive materials for taking photographs cannot make it possible to shorten the time for the desilvering by bleach fixing or by the existence of a certain type of desilvering accelerators or by promotion of desilvering ability by lowering the pH of bleaching solution. The present inventors have found that the shortening of the time for the desilvering can be attained by means that the total amount of coated silver in the light-sensitive materials is made 5.2 g/m$^2$ or less, the average iodide content in the light-sensitive silver halide grains as a whole is made 5.5 mol% or less, and a polymerized 2-equivalent magenta coupler is used as a magenta coupler. When the total amount of coated silver in light-sensitive materials or the average iodide content in the light-sensitive silver halide grains as a whole exceeds the above-mentioned values, desilvering in the treatment by a single bath bleach-fixing solution is insufficient even if the 2-equivalent coupler is used. In contrast, when the total amount of coated silver in the light-sensitive materials and the iodide content in the whole light-sensitive silver halide grains are set to or below the prescribed values and the 2-equivalent magenta polymer coupler is used, the desilvering step is shortened, which is unexpected and surprising in silver halide color light-sensitive materials in which developed silver formed in color development does not always increase with an increasing amount of coated silver.

The 2-equivalent magenta polymer coupler to be used in the present invention will be explained below in detail.

The 2-equivalent magenta polymer coupler to be used in the present invention is a polymer which has at least 10 magenta coupler residues per molecule and an average molecular weight of 3,000 or more, preferably 10,000 or more. The magenta coupler residues are preferably contained in a linear or partly cross-linked polymer. More preferably, they are contained in side chains of a linear polymer obtained addition polymerization, and include a recurring unit represented by general formula I:

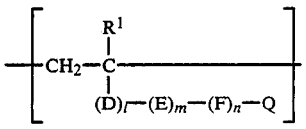

[I]

Introduction of this unit into a polymer is easily attained by homopolymerization or copolymerization of ethylenical monomers represented general formula II:

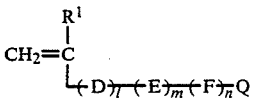

[II]

In general formulae I and II, $R^1$ represents a hydrogen atom, an alkyl group having 1 to 4 carbon atoms, or a chlorine atom, D represents —COO—, —CONR$^2$—, or a substituted or unsubstituted phenylene group, E represents a substituted or unsubstituted alkyl, phenylene or aralkylene group, and F represents —CONR$^2$—, —NR$^2$CONR$^2$—, —NR$^2$COO—, —NR$^2$CO—, —OCONR$^2$—, —NR$^2$—, —COO—, —OCO—, —CO—, —O—, —SO$_2$—, —NR$^2$SO$_2$— or —SO$_2$NR$^2$—. $R^2$ represents a hydrogen atom, a substituted or unsubstituted aliphatic hydrocarbon or aryl group. When two or more $R^2$'s are present in a single molecule, they may be the same or different. Each of $l$, m and n is zero or 1.

E represents a substituted or unsubstituted $C_1$–$C_{10}$ alkylene, aralkylene or phenylene group wherein the alkylene group may be linear or branched. As examples of the alkylene group, there can be mentioned methylene, methylmethylene, dimethylmethylene, dimethylene, trimethylene, tetramethylene, pentamethylene, hexamethylene and decylmethylene. The aralkylene group includes, for instance, benzylidene. The phenylene group includes, for instance, p-phenylene, m-phenylene and methylphenylene.

As examples of substituents on the alkylene, aralkylene or phenylene group represented by E, there can be mentioned aryl such as phenyl, nitro, hydroxyl, cyano, sulfo, alkoxy such as methoxy, aryloxy such as phenoxy, acyloxy such as acetoxy, acylamino such as acetylamino, sulfonamide such as methanesulfonamide, sulfamoyl such as methylsulfamoyl groups, halogen atoms such as fluorine, chlorine, iodine, carboxy groups, carbamoyl groups such as methylcarbamoyl, alkoxycarbamoyl groups such as methoxycarbamoyl group and sulfonyl groups such as methylsulfonyl group. When two or more substituents are present, they may be the same or different.

Q is a pyrazolone type magenta coupler residue represented by the following general formula III or a pyrazoloazol type magenta coupler residue represented by the following general formula IV:

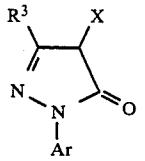

[III]

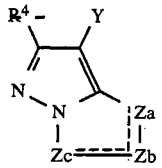

[IV]

wherein Ar is an alkyl or aryl group, $R^3$ is an anilino, acylamino, ureido or sulfonamide group which may all have one or more substituents, $R^4$ is an organic substituent or a hydrogen atom. Za, Zb and Zc represent a methine, substituted methine, =N— or —NH— group, and either of a Za—Zb bond and a Zb—Zc bond is a double bond and the other is a single bond. When Zb—Zc is a carbon—carbon double bond, it may be a part of an aromatic ring. X and Y each represent a group capable of splitting off through coupling reaction with an oxidized form of aromatic primary amine developing agent, i.e. a splitting-off group.

The pyrazolone type coupler represented by general formula III will be explained below in detail.

Ar may optionally be selected from known substituents at 1-position of 2-pyrrazoline-5-one coupler. For instance, alkyl, substituted alkyl including haloalkyl such as fluoroalkyl, cyanoalkyl and benzylalkyl, hetrocyclic such as triazolyl, thiazolyl and oxazolyl, aryl and substituted aryl groups can be named here. As examples of the substituents on the aforesaid each group there can be mentioned alkyl such as methyl, ethyl and floroalkyl, alkoxy such as methoxy and ethoxyl, aryloxy such as phenyloxy, alkoxycarbonyl such as methoxycarbonyl, acylamino such as acetylamino, carbamoyl, alkylcarbamoyl such as methylcarbamoyl and ethylcarbamoyl, dialkylcarbamoyl such as dimethylcarbamoyl, arylcarbamoyl such as phenylcarbamoyl, alkylsulfonyl such as methylsulfonyl, arylsulfonyl such as phenylsulfonyl, alkylsulfonamide such as methanesulfonamide, arylsulfonamide such as phenylsulfonamide, sulfamoyl, alkylsulfamoyl such as ethylsulfamoyl, dialkylsulfamoyl such as dimethylsulfamoyl, alkylthio such as methylthio, arylthio such as phenylthio, cyano, nitro groups and halogen atoms such as fluorine, chlorine and bromine atoms. When two or more substituents are present, they may be the same or different. The most preferred Ar is a substituted phenyl group. The preferred substituents on the substituted phenyl group include halogen atoms, alkyl, alkoxyl, alkoxycarbonyl and cyano groups. A chlorine atom is particularly preferred.

$R^3$ represents unsubstituted or substituted anilino, acylamino such as alkylcarbonamide, phenylcarbonamide, alkoxycarbonamide and phenyloxycarbonamide, ureido such as alkylureido and phenylureido, and sulfonamide groups. As examples of substituents on these groups, there can be mentioned halogen atoms such as fluorine, chlorine and bromine atoms, linear or branched alkyl such as methyl, t-butyl, octyl and tetradecyl, alkoxy such as methoxy, ethoxy, 2-ethylhexyloxy and tetradecyloxy, acylamino such as acetamide, benzamide, butanamide, octanamide, tetradecanamide, α-(2,4-di-tert.amylphenoxy)acetamide, α-(2,4-di-tert.amylphenoxy)butylamide, α-(3-pentadecylphenoxy)-hexanamide, α-(4-hydroxy-3-tert.butylphenoxy)tetradecanamide, 2-oxo-pyrrolidine-1-yl, 2-oxo-5-tetradecylpyrrolidine-1-yl and N-methyltetradecanamide, sulfonamide such as methansulfonamide, benzenesulfonamide, ethylsulfonamide, p-toluenesulfonamide, octanesulfonamide, p-dodecylbenzenesulfonamide and N-methyltetradecanesulfonamide, sulfamoyl such as sulfamoyl, N-methylsulfamoyl, N-ethylsulfamoyl, N,N-dimethylsulfamoyl, N,N-dihexylsulfamoyl, N-hexadecylsulfamoyl, N-[3-(dodecyloxy)propyl]sulfamoyl, N-[4-(2,4-di-tert.amylphenoxy)butyl]sulfamoyl and N-methyl-N-tetradecylsulfamoyl, carbamoyl such as N-methylcarbamoyl, N-butylcarbamoyl, N-octadecylcarbamoyl, N-[4-(2,4-di-tert.amylphenoxy)butyl]carbamoyl and N-methyl-N-tetradecyl carbamoyl, diacylamino such as N-succinimide, N-phthalimide, 2,5-dioxo-1-oxazolidinyl, 3-dodecyl-2,5-dioxo-1-hydantoinyl and 3-(N-acetyl-N-dodecylamino)succinimide, alkoxycarbonyl such as methoxycarbonyl, tetradecyloxycarbonyl and benzyloxycarbonyl, alkoxysulfonyl such as methoxysulfonyl, butoxysulfonyl, octyloxysulfonyl and tetradecyloxysulfonyl, aryloxysulfonyl such as phenoxysulfonyl, p-methylphenoxysulfonyl and 2,4-di-tert.amylphenoxysulfonyl, alkanesulfonyl such as methanesulfonyl, ethanesulfonyl, octanesulfonyl, 2-ethylhexylsulfonyl and hexadecanesulfonyl, arylsulfonyl such as benzenesulfonyl and 4-nonylbenzenesulfonyl, alkylthio such as methylthio, ethylthio, hexylthio, benzylthio, tetradecylthio and 2-(2,4-di-tert.amylphenoxy)ethylthio, arylthio such as phenylthio and p-tolylthio, alkyloxycarbonylamino such as methoxycarbonylamino, ethyloxycarbonylamino, benzyloxycarbonylamino and hexadecyloxycarbonylamino, alkylureido such as N-methylureido, N,N-dimethylureido, N-methyl-N-dodecylureido, N-hexadecylureido and N,N-dioctadecylureido, acyl such as acetyl, benzoyl, octadecanoyl and p-dodecanamide benzoyl, nitro, carboxyl, sulfo, hydroxy and trichloromethyl groups.

In the aforesaid substituents, "alkyl" has 1 to 36 carbon atoms and "aryl" has 6 to 38 carbon atoms.

Preferred $R^3$ is a substituted anilino or acylamino group. The most preferred $R^3$ is a substituted acylamino group. In the most preferred pyrazolone type magenta couplers, Q is bound to moiety $(F)_n$ of general formula II at moiety $R^3$.

X represents halogen atoms such as chlorine and bromine atoms, a coupling splitting-off group linked with an oxygen atom such as acetoxy, propanoyloxy, benzoyloxy, ethoxyoxaloyloxy, pyruvoyloxy, cinnamoyloxyl, phenoxy, 4-cyanophenoxyl, 4-methanesulfonamidephenoxy, α-naphthoxy, 4-cyanoxyl, 4-methanesulfonamide phenoxy, 3-pentadecylphenoxy, benzyloxycarbonyloxy, ethoxy, 2-cyanoethoxy, benzyloxy, 2-phenetyloxy, 2-phenoxy-ethoxy, 5-phenyltetrazolyloxy and 2-benzothiazolyloxy groups, a coupling splitting-off group linked with a nitrogen atom such as those described in Japanese Patent Publication (unexamined) No. 99437/1984, specifically, benzenesulfonamide, N-ethyltoluenesulfonamide, heptafluorobutanamide, 2,3,4,5,6-pentafluoro-benzamide, octanesulfonamide, p-cyanophenylureido, N,N-diethylsulfamoylamino, 1-piperidyl, 5,5-dimethyl-2,4-dioxo-3-oxazolidinyl, 1-benzyl-5-ethoxy-3-hydantoinyl, 2-oxo-1,2-dihydro-1-pyridinyl, imidazolyl, pyrazolyl, 3,5-dimethylpyrazolyl, 4-methylpyrazolyl, 3,5-diethyl-1,2,4-triazol-1-yl, 5- or 6-bromobenzotriazol-1-yl, 5-methyl-1,2,3,4-triazol-1-yl and benzimidazolyl groups, a coupling splitting-off group linked with a sulfur atom such as phenylthio, 2-carboxyphenylthio, 2-methoxy-5-octylphenylthio, 2-butoxy-5-octylphenylthio, 4-methanesulfonylphenylthio, 4-octanesulfonamidephenylthio, benzylthio, 2-cyanoethylthio, 5-phenyl-2,3,4,5-tetrazolylthio and 2-benzothiazolyl groups.

X is preferably the coupling splitting-off group linked with a nitrogen atom, particularly, such as pyrazolyl, imidazolyl and triazolyl groups.

The following are examples of the 2-equivalent magenta monomer couplers having the pyrazolone type magenta coupler residue represented by general formula III among the 2-equivalent magenta monomer couplers forming the recurring unit represented by general formula II according to the present invention, though the invention is not limited to the following.

(1)

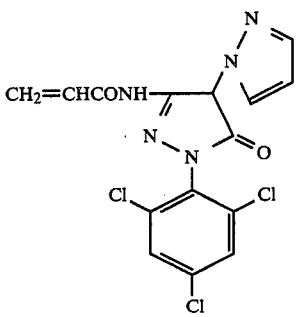

(2)

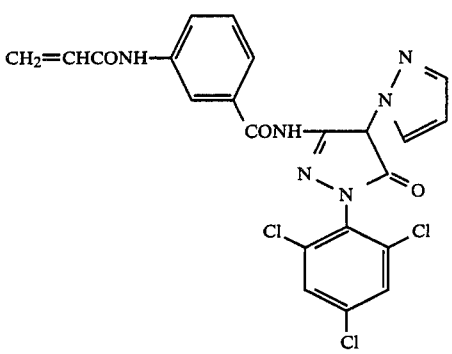

(3)

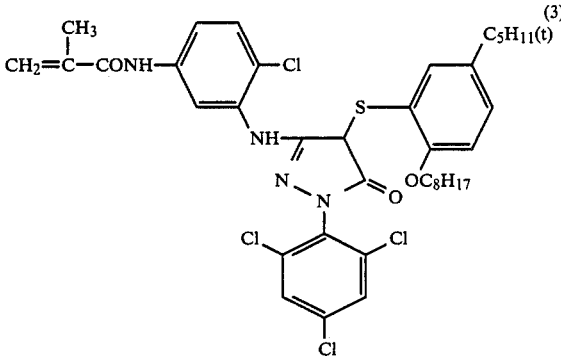

-continued (4)

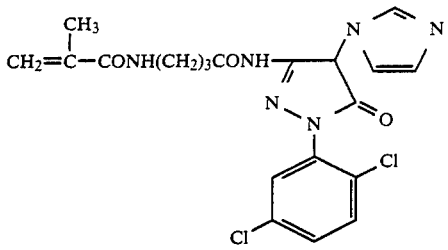

(5)

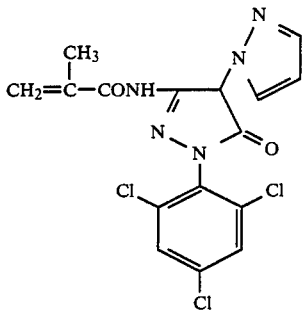

(6)

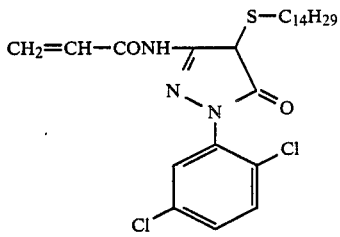

(7)

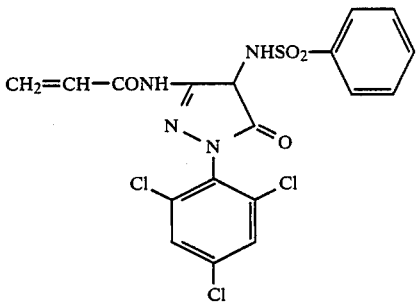

(8)

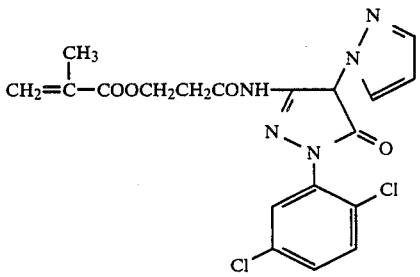

-continued
(9)
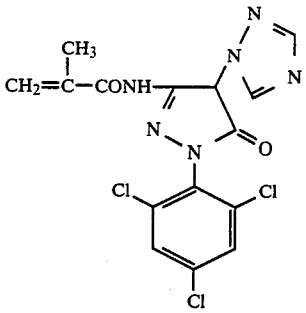
(10)
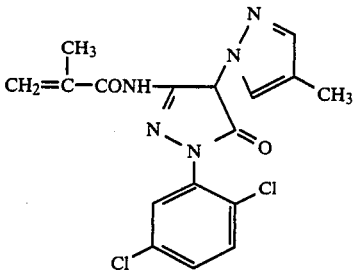
(11)
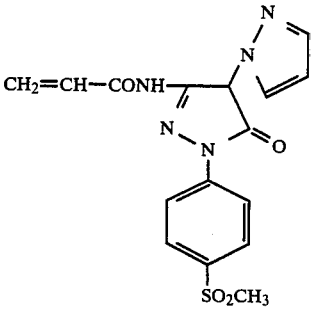
(12)
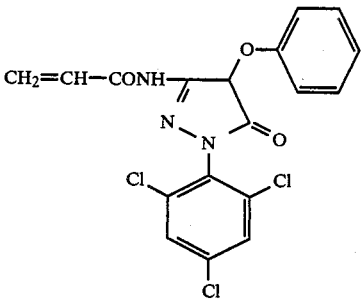
(13)
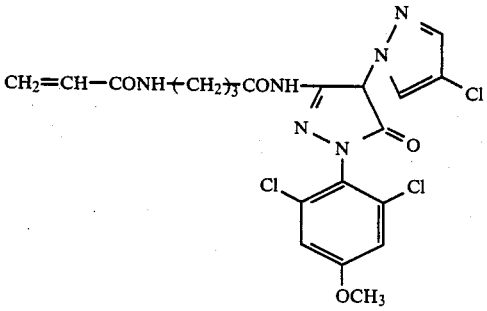
-continued
(14)
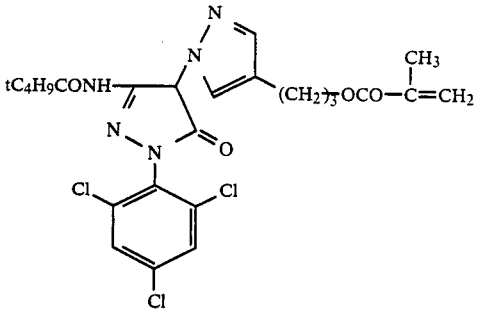
(15)
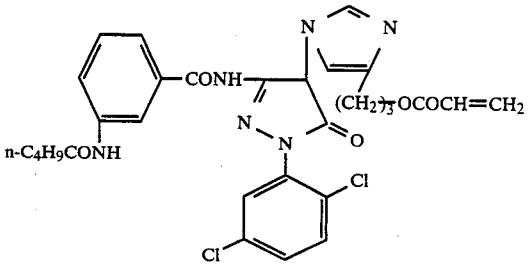
(16)
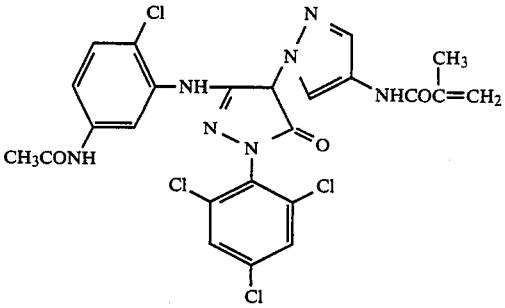
(17)
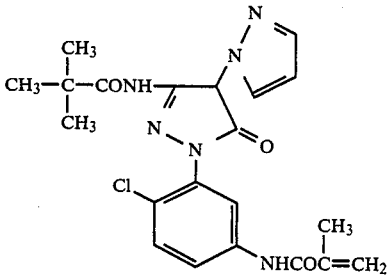
(18)
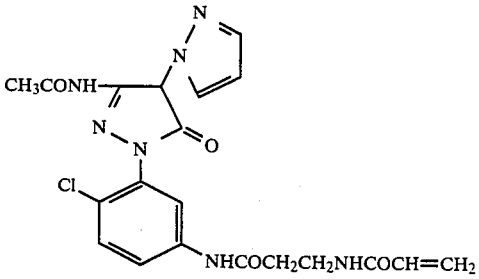

-continued
(19)
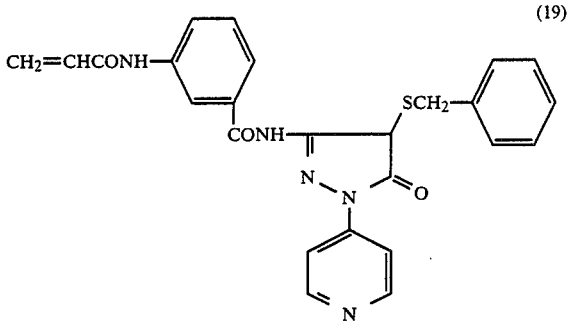
(20)
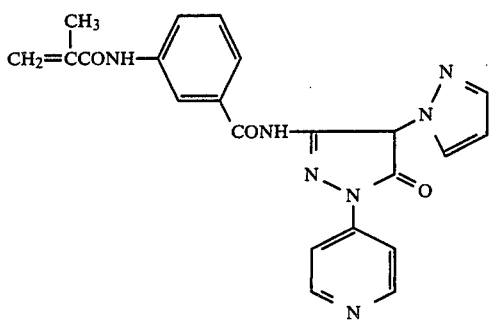
(21)
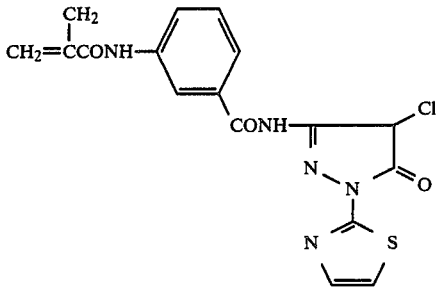
(22)
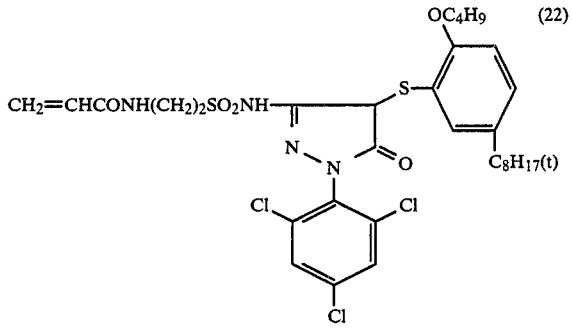
(23)
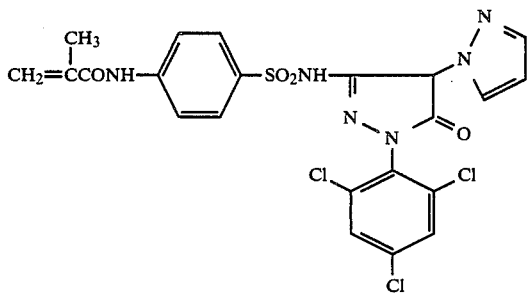
-continued
(24)
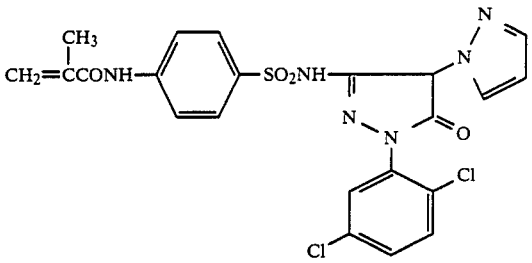
(25)
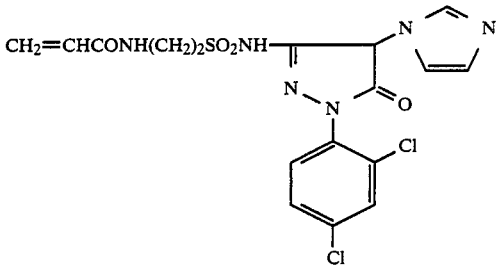
(26)
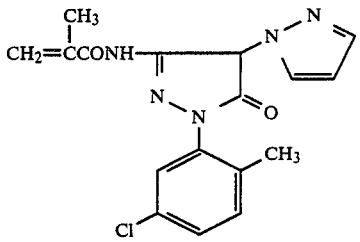
(27)
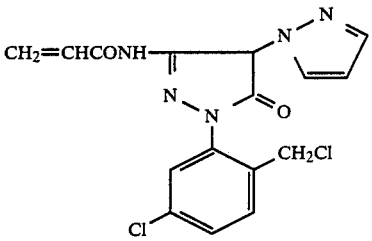
(28)
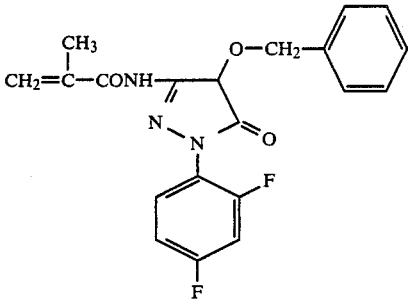
(29)
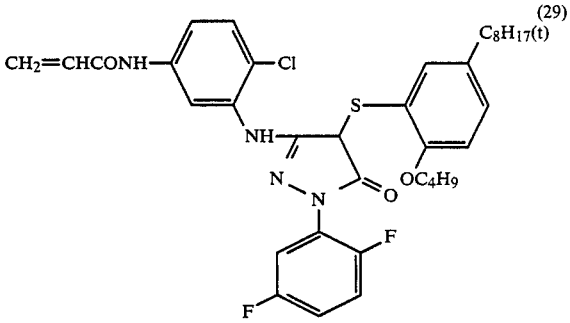

-continued
(30)
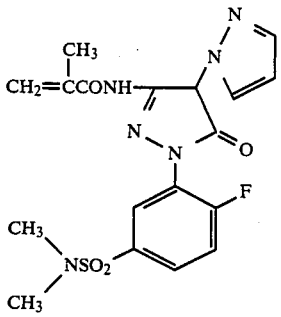
(31)
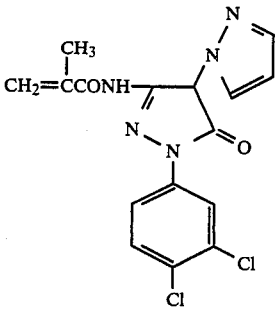
(32)
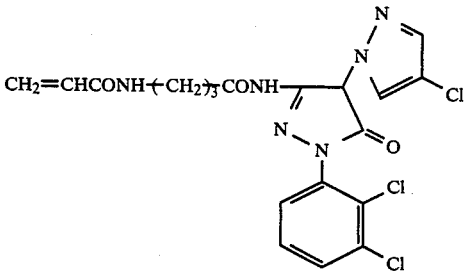
(33)
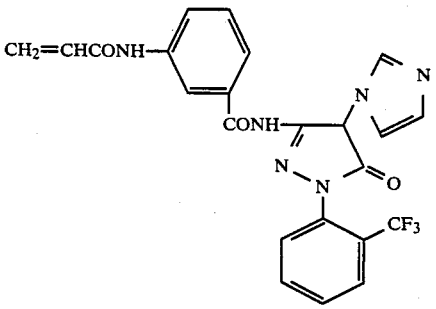
(34)
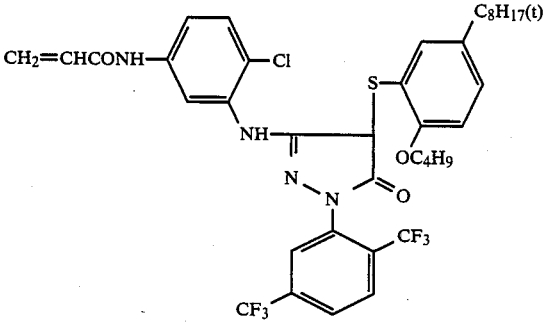
-continued
(35)
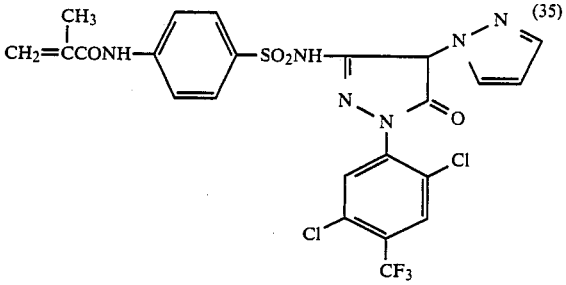
(36)
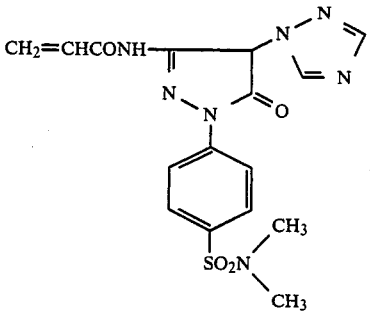
(37)
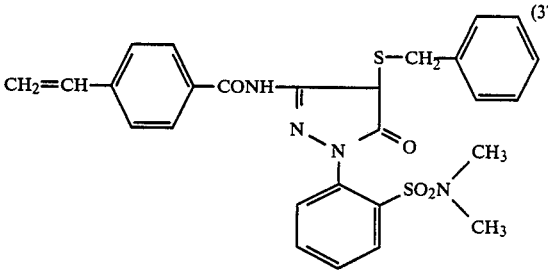
(38)
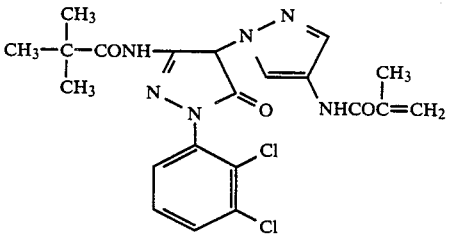
(39)
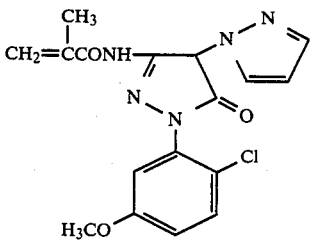

-continued (40)

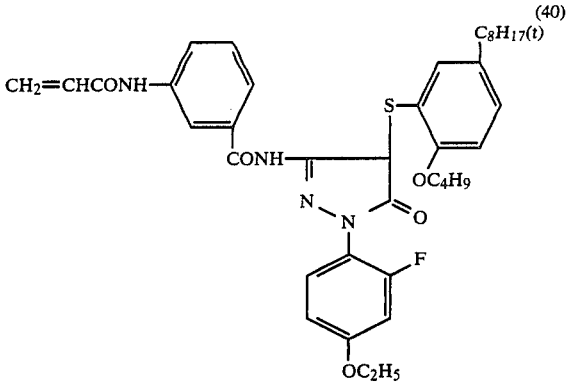

(41)

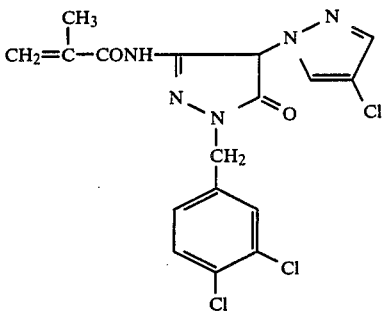

(42)

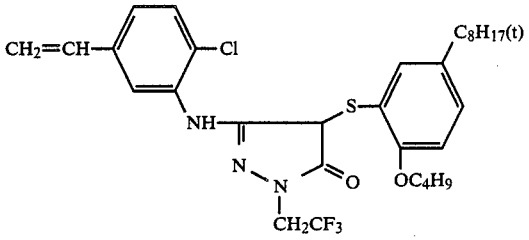

(43)

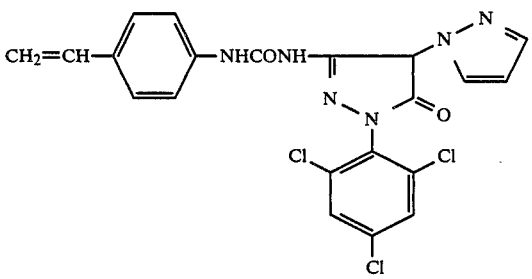

(44)

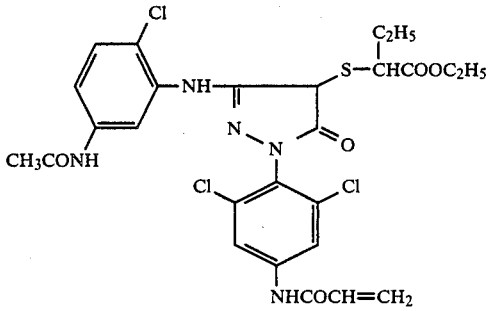

-continued (45)

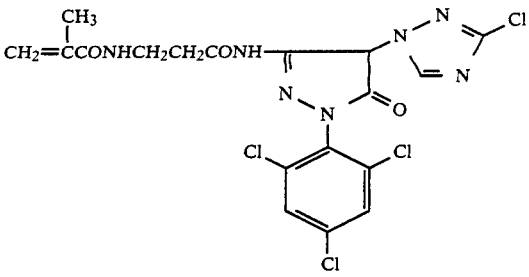

(46)

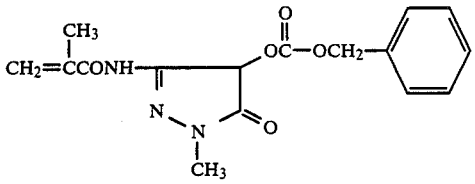

(47)

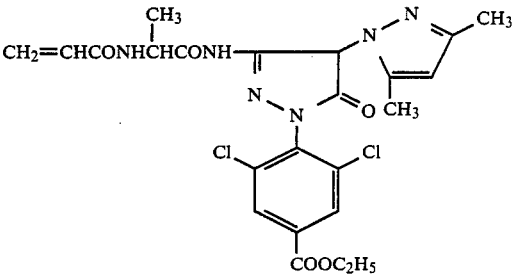

The pyrazoloazol type coupler represented by general formula IV is a 5-membered ring-5-membered ring-condensed nitrogen heterocyclic coupler, and its chromophoric central nucleus shows an aromatic property electrically equivalent to naphthalene and has a chemical structure called generically "azapentalene." Preferred skeletal structures among the couplers represented by general formula IV are those generically referred to as follows and having the following general formulae V to X. Compounds V, VII and VIII are particularly preferred, and compound VIII is most preferred.

(V) 1H-imidazo 1,2-b pyrazoles
(VI) 1H-pyrazolo 1,5-b pyrazoles
(VII) 1H-pyrazolo 5,1-c 1,2,4 triazoles
(VIII) 1-H-pyrazolo 1,5-b 1,2,4 triazoles
(IX) 1H-pyrazolo 1,5-b tetrazoles
(x) 1H-pyrazolo 1,5-a benzimidazoles General formula [V]

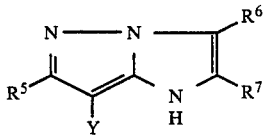

General formula [VI]

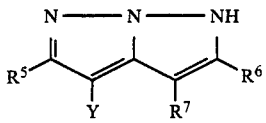

-continued

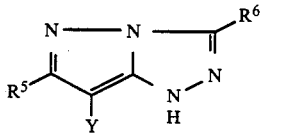

General formula [VII]

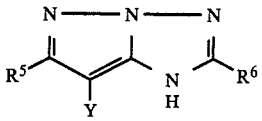

General formula [VIII]

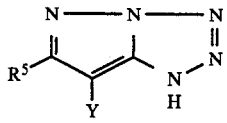

General formula [IX]

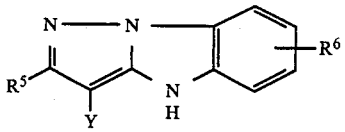

General formula [X]

Substituents $R^5$, $R^6$ and $R^7$ in general formulae V to X each represent aliphatic hydrocarbon, aromatic or heterocyclic groups. These may or may not have substituents. Permissible substituents on $R^5$, $R^6$ and $R^7$ include halogen atoms, alkyl, alkenyl, aryl, heterocyclic, alkoxy, aryloxy, acyloxy, sulfonyloxy, acyl, sulfonyl, carboxyl, sulfo, hydroxyl, amino, carbonamide, sulfonamide, carbamoyl, sulfamoyl, alkoxycarbamoyl, aryloxycarbonyl, ureido, sulfinyl, alkylthio, arylthio and cyano groups. $R^5$, $R^6$ and $R^7$ may further be a hydrogen atom or the aforesaid permissible substituents with the exception of halogen atoms. Preferred $R^5$, $R^6$ and $R^7$ are alkyl, aryl, carbonamide sulfonamide and ureido, which may have one or more of the aforesaid substituents. The number of the carbon atoms contained in the aliphatic group or heterocyclic ring is preferably 1 to 22 and the number of the carbon atoms contained in the aromatic group is preferably 6 to 22.

When two or more $R^6$ are present in general formula X, they may be the same or different.

Y represents (1) a halogen atom, (2) such a group as to link the carbon atom at a coupling active site with an aliphatic group, aromatic group, heterocyclic group, aliphatic, aromatic or heterocyclic sulfonyl group or aliphatic, aromatic or heterocyclic carbonyl group through an oxygen, nitrogen or sulfur atom, or (3) an aromatic azo group. The aliphatic, aromatic and heterocyclic groups contained in these splitting-off groups may have the permissible substituents referred to in connection with $R^5$, $R^6$ and $R^7$. When two or more these subtituents are present, they may be the same or different.

Examples of the splitting-off groups are a halogen atom such as fluorine atom, chlorine atom and bromine atom, alkoxy such as ethoxy, dodecyloxy, methoxyethylcarbamoylmethoxy, carboxypropyloxy and methanesulfonylethoxy, aryloxy such as 4-chlorophenoxy, 4-methoxyphenoxy and 4-carboxyphenoxy, acyloxy such as acetoxy, tetradecanoyloxy and benzoloxy, aliphatic or aromatic sulfonyloxy such as methanesulfonyloxy and toluenesulfonyloxy, acylamino such as dichloroacetylamino, trifluoroacetylamino and heptafluorobutyrylamino, aliphatic or aromatic sulfonamide such as methanesulfonamide and p-toluenesulfonamide, alkoxycarbonyloxy such as ethoxycarbonyloxy and benzyloxycarbonyloxy, aryloxycarbonyloxy such as phenoxycarbonyloxy, aliphatic, aromatic or heterocyclic thio such as ethylthio and phenylthio, carbamoylamino such as N-methylcarbamoylamino and N-phenylcarbamoylamino, 5- or 6-membered nitrogen-containing heterocyclic ring such as 1-imidazolyl, 1-pyrazolyl, 1-triazolyl, 1-tetrazolyl and 1,2-dihydro-2-oxo-1-pyridyl, imido such as succinimide and hydantoinyl, aromatic azo such as phenylazo groups. These groups may have the substituents referred to for $R^5$, $R^6$ and $R^7$.

Among the above, preferable splitting-off groups are those capable of splitting off as anion, typically, halogen atoms, alkoxy, aryloxy, arylthio, sulfonyloxy and acylamino groups.

Particularly preferred pyrazoloazole type couplers are monomers having the residues represented by the formulae V and VIII.

Examples of the coupler compounds represented by general formulae V to X, their preparation, etc., are described in the following literature. The compound of formula V is disclosed in U.S. Pat. No. 4,500,630; the compound of formula VI, Japanese Patent Publication (unexamined) No. 43659/1985; the compound of formula VII, Japanese Patent Publication No. 27411/1972; the compound of formula VIII, European Pat. No. 119,860A; the compound of formula IX, Japanese Patent Publication (unexamined) No. 33552/1985; and the compound of formula X, U.S. Pat. No. 3,061,432.

Further, the compound of formulae V to X may have highly color forming ballast groups described in Japanese Patent Publication (unexamined) No. 42045/1983, European Pat. No. 126,433A, U.S. Pat. Nos. 4,513,082 and 4,503,141 and Japanese Patent Publication (unexamined) No. 177557/1984.

The following are examples of 2-equivalent magenta monomer couplers having the pyrazoloazole type coupler residue represented by general formula IV among the 2-equivalent magenta monomer couplers forming the recurring unit represented by general formula II according to the present invention, though the invention is not limited to the following:

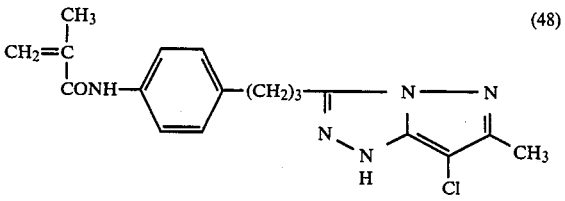

(48)

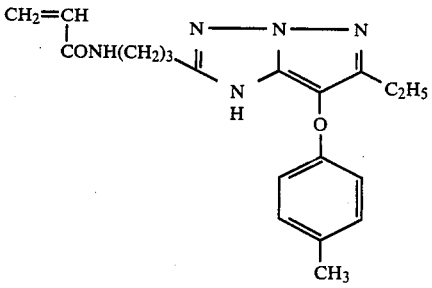

(49)

-continued (50)

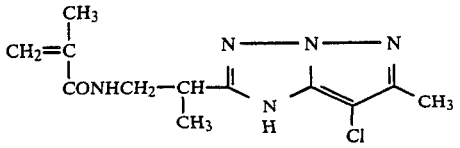

(51)

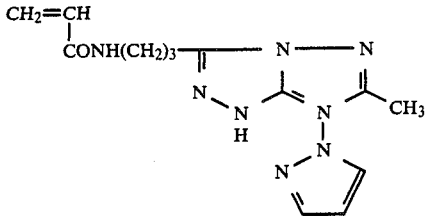

(52)

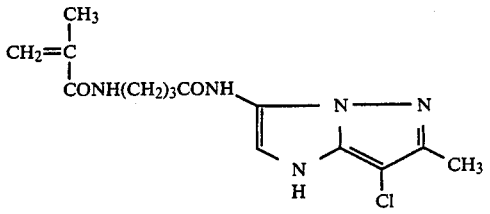

(53)

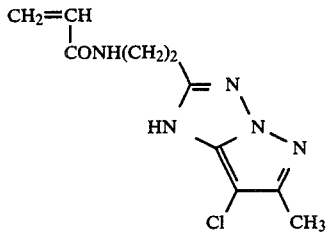

(54)

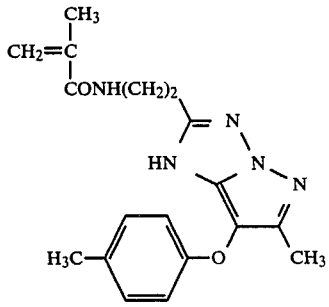

The polymer couplers having the recurring unit represented by general formula I to be used in the invention may be synthesized by addition polymerization of one or more ethylenical monomers represented by general formula II. The addition polymerization can be conducted as heat polymerization with no catalyst, preferably, radical, anion or cation polymerization using various initiators. The radical polymerization is particularly preferred, and the 2-equivalent magenta polymer coupler according to the invention may be obtained by polymerization of the ethylenical monomer of general formula II alone or copolymerization of this monomer with one or more non-chromophoric (i.e., unable to couple with an oxidized form of an aromatic primary amine developing agent), ethylenical monomers capable of copolymerizing with the above monomer.

Synthesis of the magenta polymer coupler used in the present invention by radical polymerization may be carried out using a polymerization initiator and a solvent compound such as those described in Japanese Patent Publication (unexamined) Nos. 5543/1981, 94752/1982, 176038/1982, 204038/1982, 28745/1983, 10738/1983, 42044/1983, 145944/1983 and 42543/1984.

Polymerization temperature should be decided depending on molecular weight of the polymer, the type of the initiator, and can be below 0° C. up to 100° C. or higher. Usually, the polymerization is conducted at a temperature of from 30° to 100° C.

A preferred ratio of the chromophoric part corresponding to general formula I in the copolymer coupler is usually 5 to 80% by weight. However, in light of color reproduction, color developing properties and stability, a range of from 20 to 70% by weight is preferable. In this case, equivalent molecular weight, i.e., grams of the polymer containing 1 mole monomer coupler, is about 250 to 4,000, though the invention is not limited to this.

Examples of the non-chromophoric ethylenical monomer which are incapable of coupling with an oxydized form of an aromatic primary amine developing agent and used in copolymerization with the 2-equivalent magenta monomer coupler of general formula II are acrylic ester, methacrylic ester, crotonic ester, vinyl ester, maleic diester, fumaric diester, itaconic diester, acrylic amides, methacrylic amides, vinyl esters and styrenes.

More specifically, acrylic ester includes methyl acrylate, ethyl acrylate, n-propyl acrylate, isopropyl acrylate, n-butyl acrylate, isobutyl acrylate, tert. butyl acrylate, hexyl acrylate, 2-ethylhexyl acrylate, acetoxyethyl acrylate, phenyl acrylate, 2-methoxy acrylate, 2-ethoxy acrylate, and 2-(2-methoxyethoxy)ethyl acrylate.

Methacrylic ester includes methyl methacrylate, ethyl methacrylate, n-propyl methacrylate, n-butyl methacrylate, tert. butyl methacrylate, cyclohexyl methacrylate, 2-hydroxyethyl methacrylate, and 2-ethoxyethyl methacrylate. Crotonic ester includes butyl crotonate and hexyl crotonate. Vinyl ester includes vinyl acetate, vinyl propionate, vinyl butylate, viyl methoxy acetate and vinyl benzoate. Maleic diester includes diethyl maleate, dimethyl maleate and dibutyl maleate. Fumaric diester includes diethyl fumarate, dimethyl fumarate and dibutyl fumarate. Itaconic diester includes diethyl itaconate, dimethyl itaconate and dibutyl itaconate. Acrylic amides include acrylic amide, methylacrylic amide, ethylacrylic amide, propylacrylic amide, n-butylacrylic amide, tert. butylacrylic amide, cyclohexylacrylic amide, 2-methoxyethylacrylic amide, dimethylacrylic amide, diethylacrylic amide and phenylacrylic amide. Methacrylic amides include methylmethacrylic amide, ethylmethacrylic amide, n-butylmethacrylic amide, tert. butylmethacrylic amide, 2-methoxymethacrylic amide, dimethylmethacrylic amide, and diethylmethacrylic amide. Vinyl esters include methylvinyl ether, butylvinyl ether, hexylvinyl ether, methoxyethylvinyl ether and dimethylaminoethylvinyl ether. Styrenes include styrene, methyl styrene, dimethyl styrene, trimethyl styrene, ethyl styrene, isopropyl styrene, butyl styrene, chloromethyl styrene, methoxy styrene, butoxy styrene, acetoxy styrene, chloro styrene, dichloro styrene, bromo styrene, vinyl benzoic acid methyl ester, and α-methyl styrene.

As examples of other copolymerizable monomers there can be mentioned allyl compounds such as allyl acetate, vinyl ketones such as methylvinyl ketone, vinyl heterocyclic compounds such as vinyl pyridine, glycidyl esters such as glycidyl acrylate, unsaturated nitriles such as acrylonitrile, acrylic acid, methacrylic acid, itaconic acid, maleic acid, monoalkyl itaconate such as monomethyl itaconate, monoalkyl maleate such as monomethyl maleate, citraconic acid, vinylsulfonic acid, acryloyloxyalkylsulfonic acid such as acryloyloxymethylsulfonic acid, acrylamide alkylsulfonic acid such as 2-acrylamide-2-methlethanesulfonic acid. These acids may be in a form of alkali metal (e.g., Na, K) salt or ammonium salt.

In light of hydrophilic property and hydrophobic property of monomers, copolymerizability of monomers, color forming property of formed polymer couplers, and color tone of formed dye, comonomers to be preferably used include acrylic ester, methacrylic ester, styrenes, maleic ester, acrylic amides and methacrylic amides.

Physicochemical properties of the final polymer couplers may be controlled by combinational use of monomers which give different physical or chemical property. Examples of such a combination are n-butylacrylate and styrene; n-butylacrylate and methylacrylate; and t-butylmethacrylamide and ethylacrylate.

Examples of the 2-equivalent magenta polymer couplers to be used in the present invention are listed below. Copolymerization ratios are based on weight.

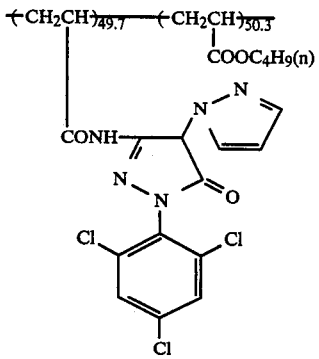

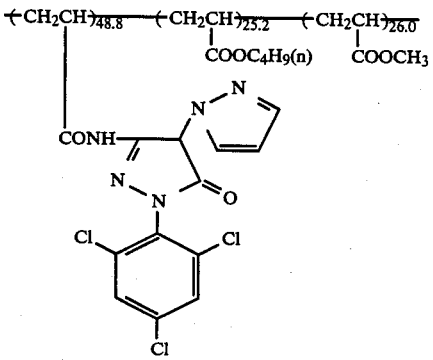

-continued

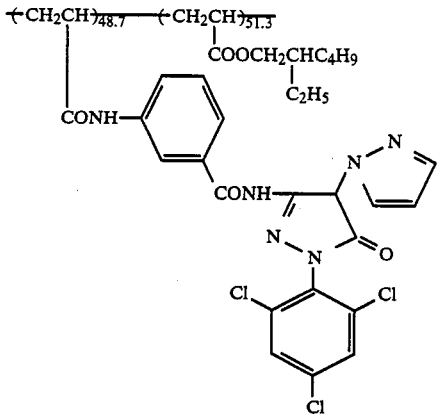

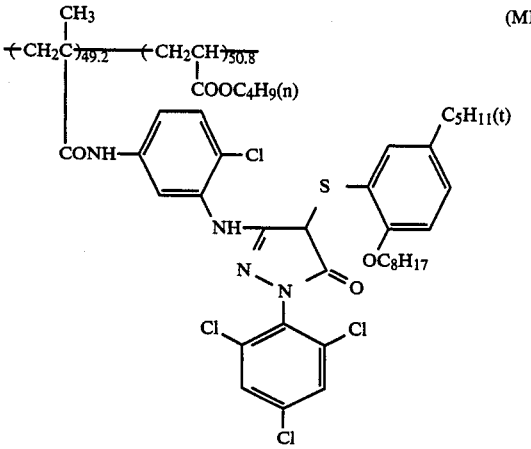

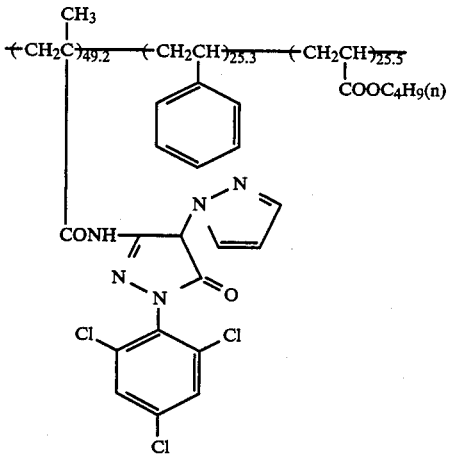

-continued
(MP-6)
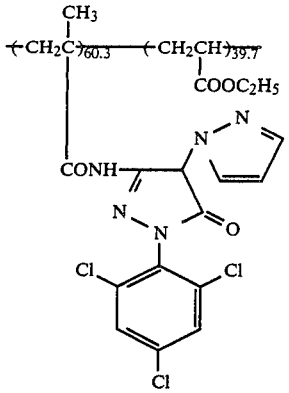
(MP-7)
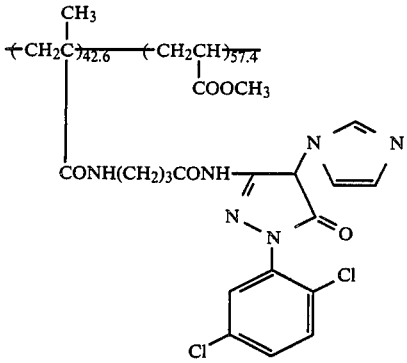
(MP-8)
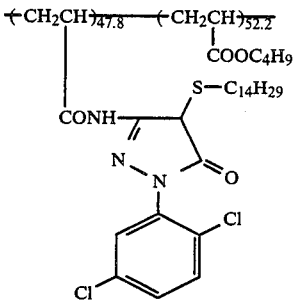
(MP-9)
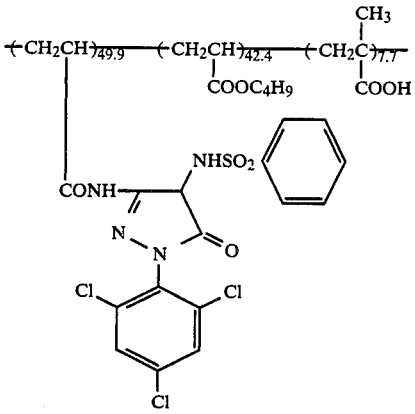
-continued
(MP-10)
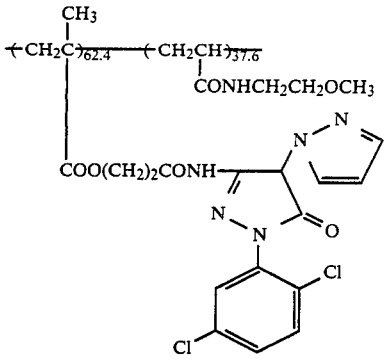
(MP-11)
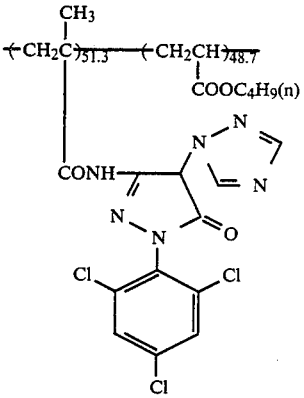
(MP-12)
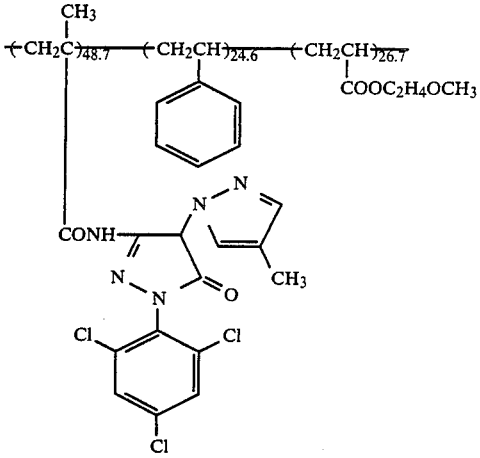
(MP-13)
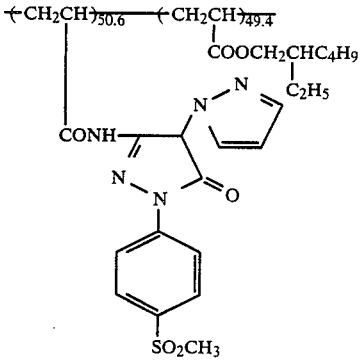

-continued
(MP-14)
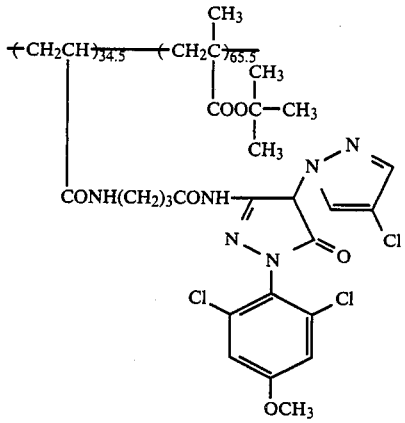
(MP-15)
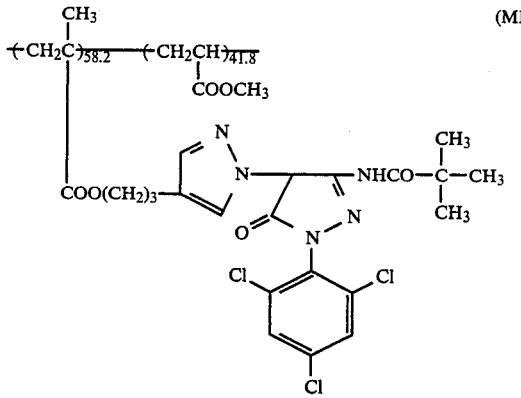
(MP-16)
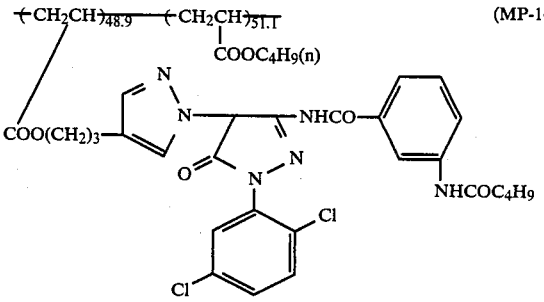
(MP-17)
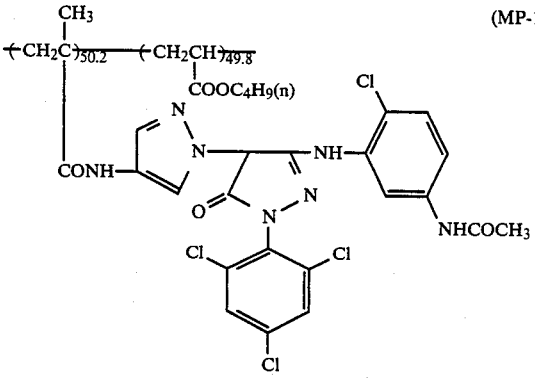
-continued
(MP-18)
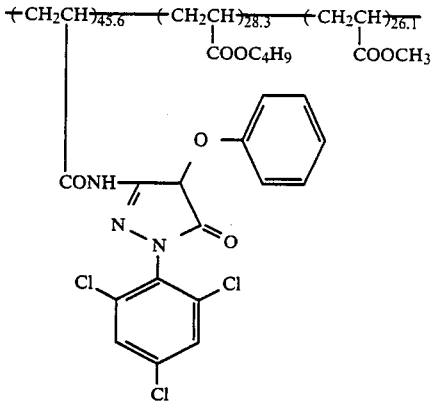
(MP-19)
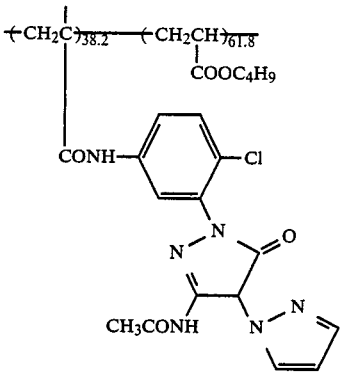
(MP-20)
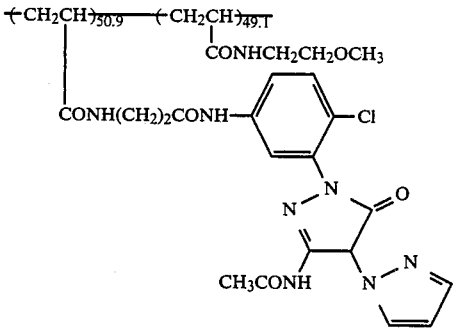
(MP-21)
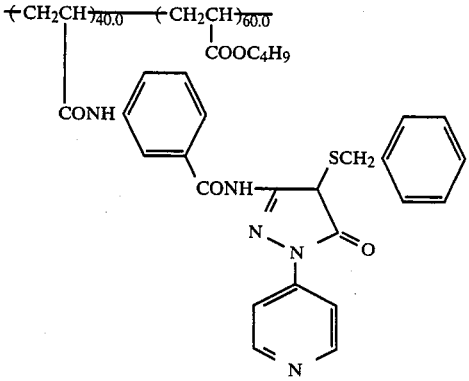

-continued
(MP-22)
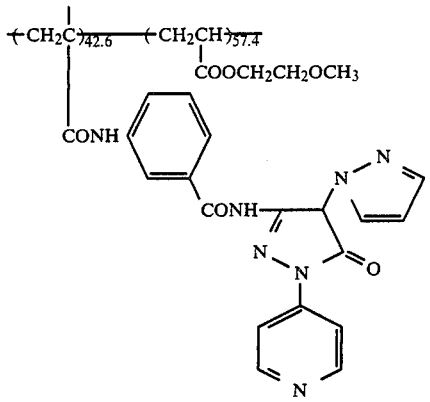
(MP-23)
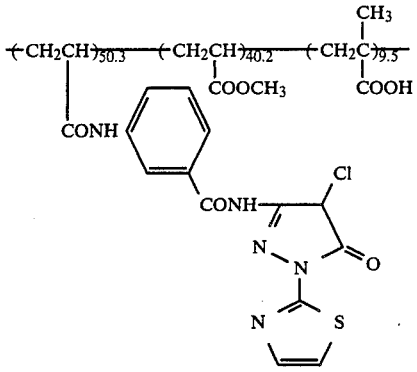
(MP-24)
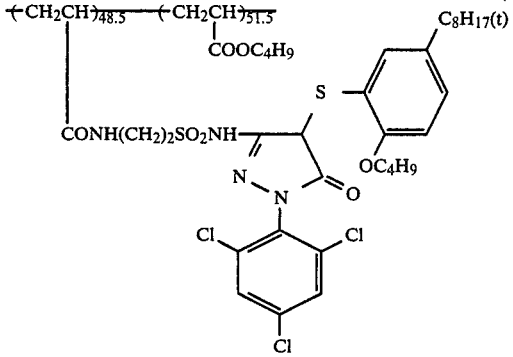
(MP-25)
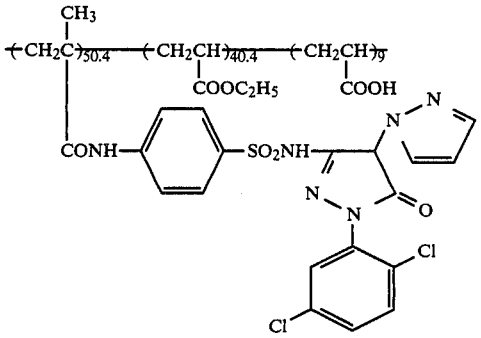
-continued
(MP-26)
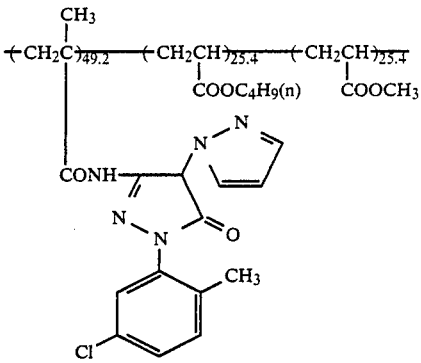
(MP-27)
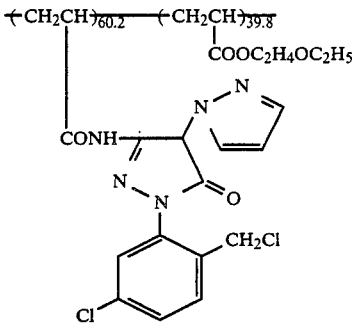
(MP-28)
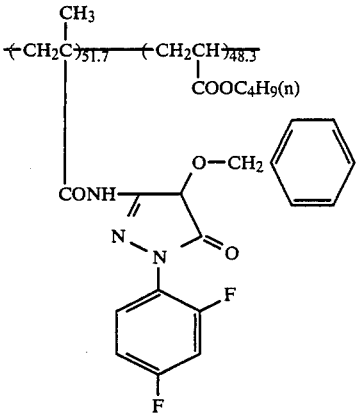
(MP-29)
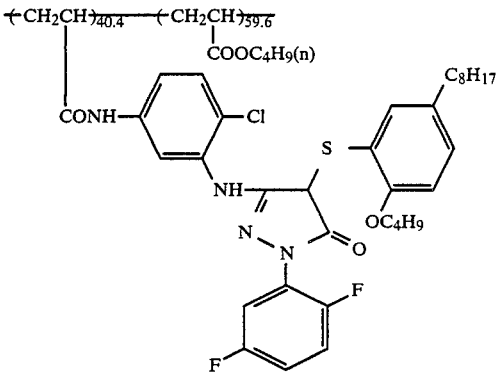

-continued
(MP-30)
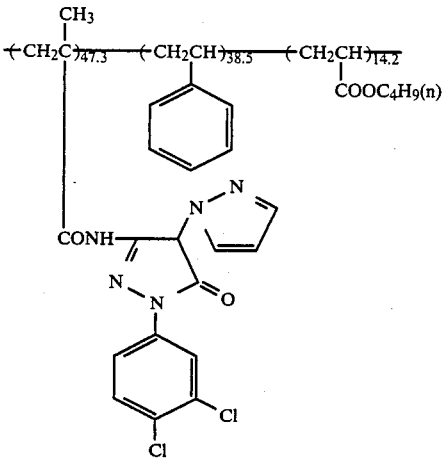
(MP-31)
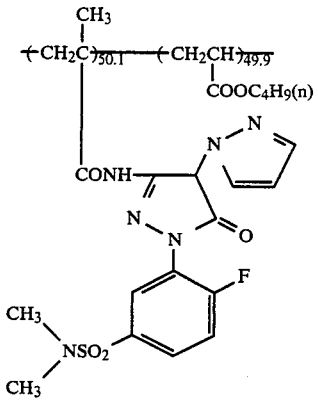
(MP-32)
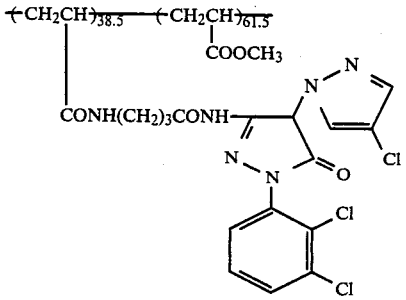
(MP-33)
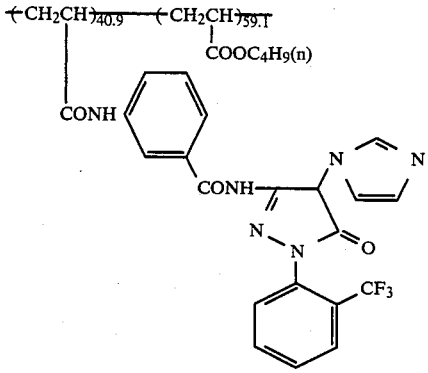
-continued
(MP-34)
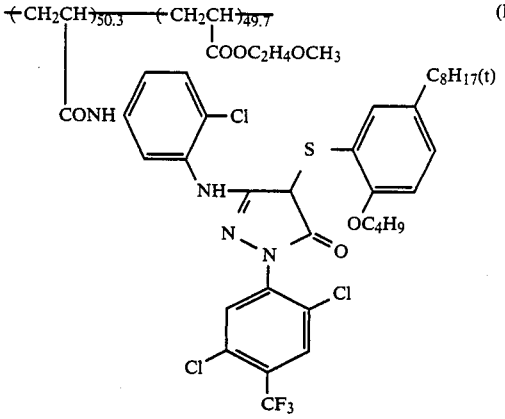
(MP-35)
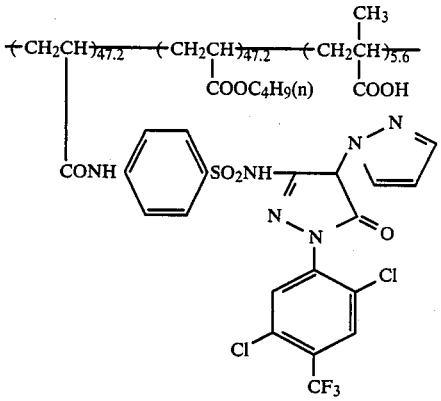
(MP-36)
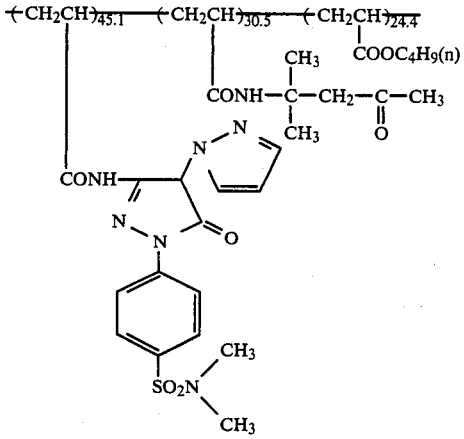
(MP-37)
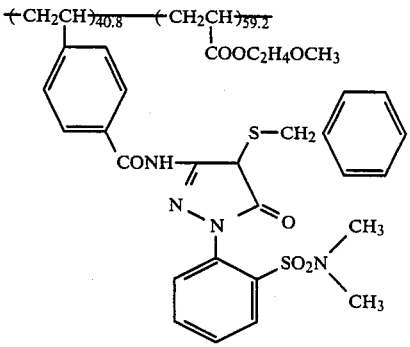

-continued
(MP-38)
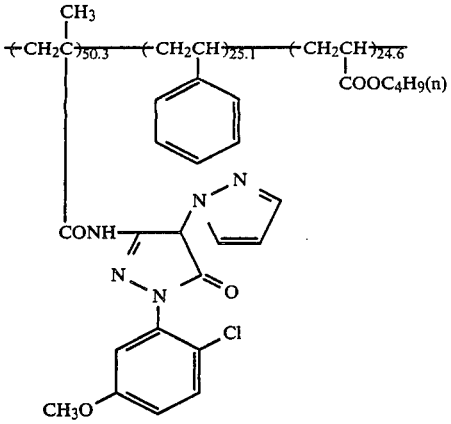
(MP-39)
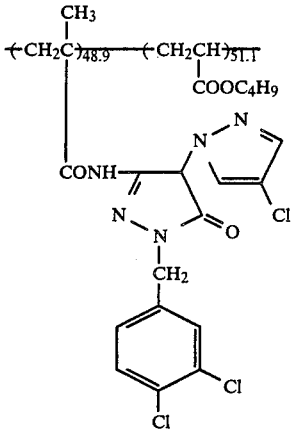
(MP-40)
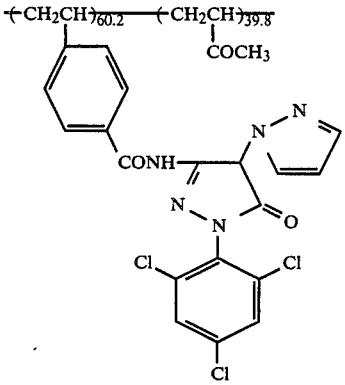
(MP-41)
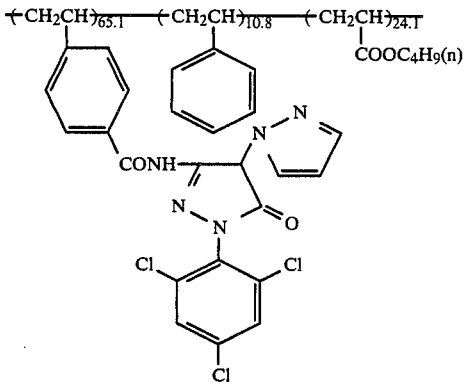
-continued
(MP-42)
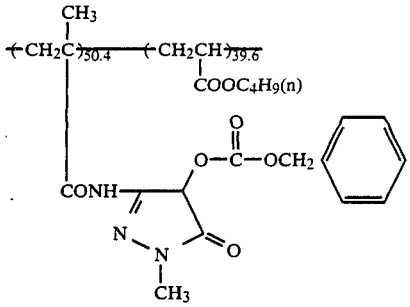
(MP-43)
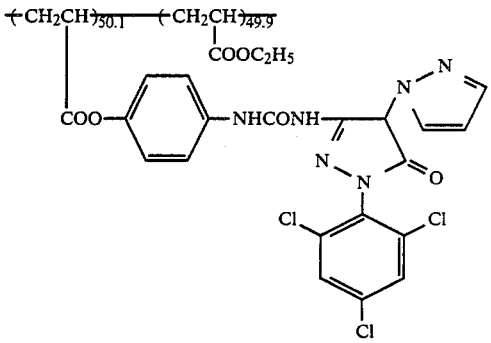
(MP-44)
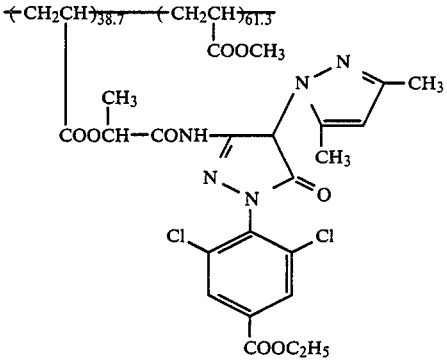
(MP-45)
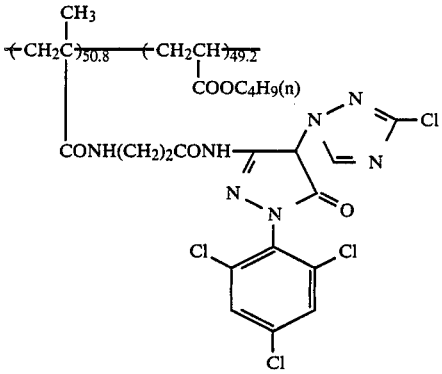
(MP-46)
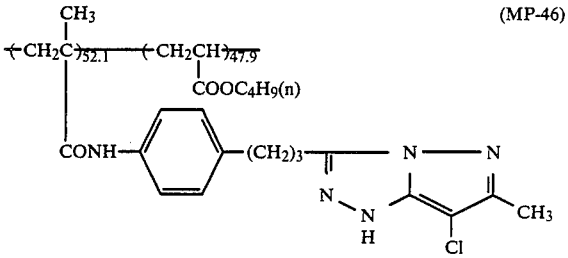

-continued (MP-47)

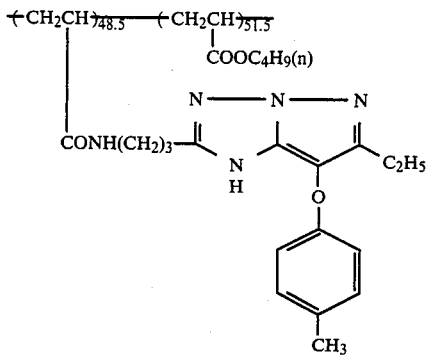

(MP-48)

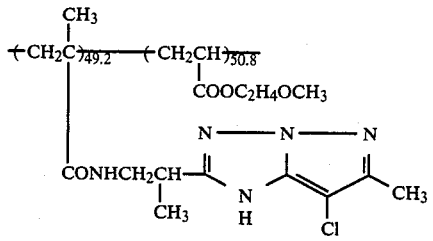

(MP-49)

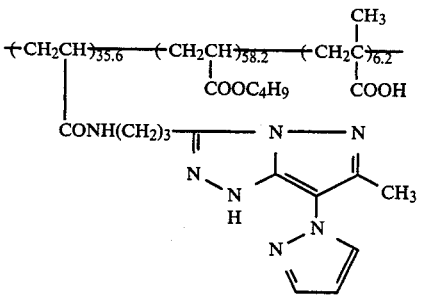

(MP-50)

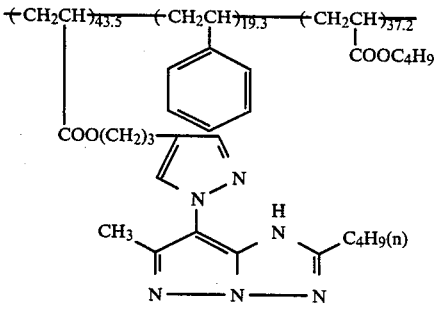

(MP-51)

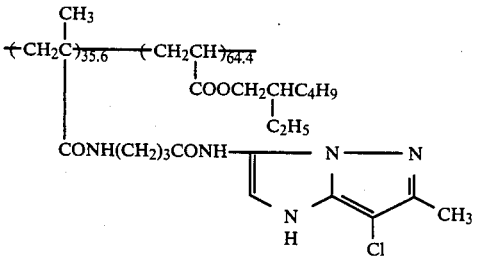

-continued (MP-52)

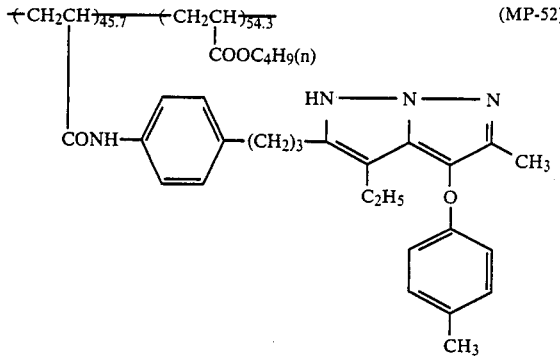

(MP-53)

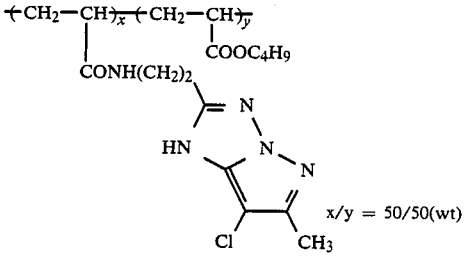

x/y = 50/50(wt)

(MP-54)

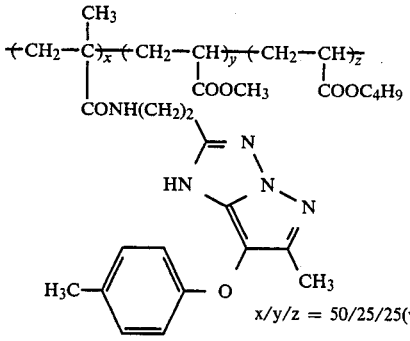

x/y/z = 50/25/25(wt)

The 2-equivalent magenta polymer coupler to be used in the present invention may be synthesized by the methods decribed in Japanese Patent Publication (unexamined) Nos. 94752/1982, 46555/1985 and 145944/1983.

The used amount of the 2-equivalent magenta coupler according to the invention is preferably 20% by weight of more, particularly 70% by weight or more, of the whole magenta coupler.

The desilvering accelerator used in the present invention will be explained below.

The desilvering accelerator used in the invention may be added in any manner so as to be present in a bleaching step. It may be incorporated in light-sensitive materials in advance, or may be present in a solution, such as a developing solution, of any step prior to the bleaching step and, then, be carried over to a bleaching bath or to a bleach-fixing bath. Alternatively, it may of course be directly added to a bleaching bath or to a bleach-fixing bath. An embodiment where the accelerator is added in a form of a precursor and, subsequently, converted into a compound of the invention in a bleaching step is also within the scope of the invention.

The desilvering accelerator used in the invention is represented by the following general formula XI or XII.

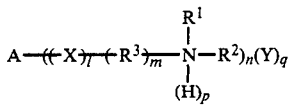

[XI]

wherein A represents a n-valent aliphatic, aromatic or heterocyclic linking group provided that, if n equals 1, A is merely an aliphatic, aromatic or heterocyclic group or a hydrogen atom.

The aliphatic linking group represented by A includes alkylene groups having 3 to 12 carbon atoms such as trimethylene, hexamethylene and cyclohexylene groups.

The aromatic linking group represented by A includes arylene groups having 6 to 18 carbon atoms such as phenylene and naphthylene groups.

The heterocyclic linking group includes heterocyclic groups having one or more hetero atoms such as oxygen, sulfur and nitrogen atoms, for instance, thiophen, furan, triazine, pyridine and piperidine groups.

One aliphatic, aromatic or heterocyclic linking group is usually present. However, two or more these groups may be linked. These groups may be linked directly or linked via a divalent linking group such as —O—, —S—,

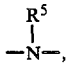

—$SO_2$—, —CO— or combination thereof, wherein $R^5$ represents a lower alkyl group.

Further, these aliphatic, aromataic and heterocyclic linking groups may have substituents. As the substituents, there are named alkoxy group, halogen atoms, alkyl, hydroxyl, carboxyl, sulfo, sulfonamide and sulfamoyl groups.

X represents —O—, —S— or

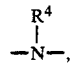

wherein $R^4$ represents a lower alkyl group such as methyl or ethyl.

$R^1$ and $R^2$ represent a substituted or unsubstituted lower alkyl group such as methyl, ethyl, propyl, isopropyl and pentyl groups. Preferred substituents are hydroxyl, lower alkoxy such as methoxy, methoxyethoxy and hydroxyethoxy, amino such as unsubstituted amino, dimethylamino and N-hydroxyethyl-N-methylamino groups. When more than one substituents are present, these may be the same or different.

$R^3$ represents a lower alkylene group having 1 to 5 carbon atoms such as methylene, ethylene, trimethylene and methylmethylene groups.

Y represents anion such as halide ion, for instance, chloride and bromide ions, nitrate ion, sulfate ion, p-toluene sulfonate ion, and oxalate ion.

Further, $R^1$ and $R^2$ may be linked with each other via a carbon atoms or a hetero atom such as oxygen, nitrogen and sulfur atoms to form 5- or 6-membered hetero ring such as pyridine, piperidine, morphorine, triazine and imidatriazine rings.

$R^1$ or $R^2$ may be linked with A via a carbon or hetero atom such as oxygen, nitrogen and sulfur atoms to form 5- or 6-membered hetero ring such as hydroxyquinoline, hydroxyindol and isoindoline rings.

Further, $R^1$ (or $R^2$) and $R^3$ may be linked with each other via a carbon or hetero atom such as oxygen, nitrogen and sulfur atoms to form 5- or 6-membered hetero ring such as piperidine, pyrolidine and morphorine rings.

L is zero or 1; m, zero or 1; n, 1, 2 or 3; p, zero or 1; and q, zero, 1, 2, or 3.

The following are example of the compounds represented by the formula XI, though the invention should not be limited to these.

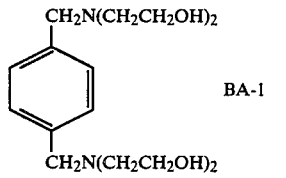

(XI)-(1)

BA-1

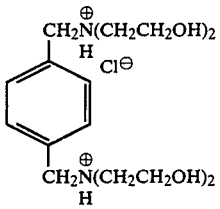

(XI)-(2)

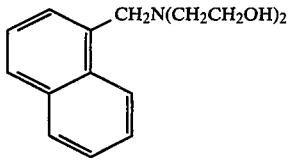

(XI)-(3)

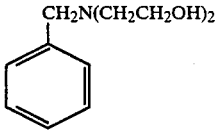

(XI)-(4)

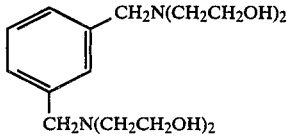

(XI)-(5)

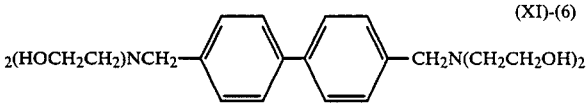

(XI)-(6)

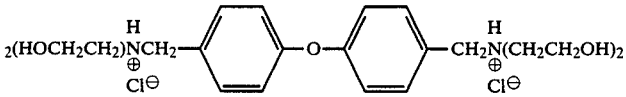

(XI)-(7)

-continued
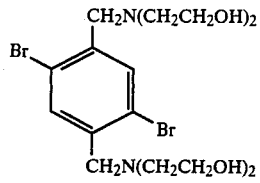
(XI)-(8)
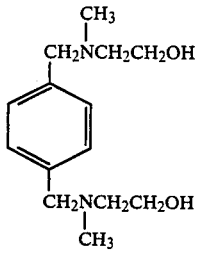
(XI)-(9)
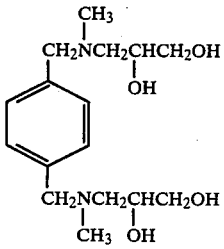
(XI)-(10)
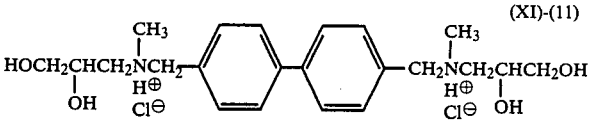
(XI)-(11)
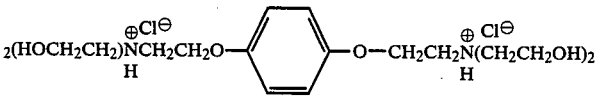
(XI)-(12)
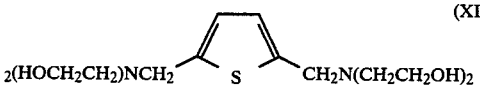
(XI)-(13)
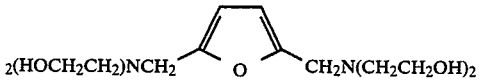
(XI)-(14)
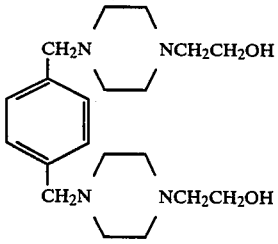
(XI)-(15)
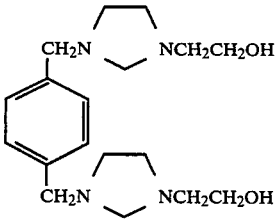
(XI)-(16)
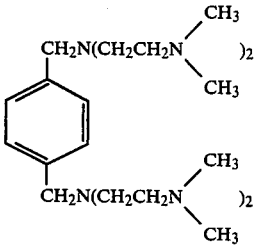
(XI)-(17)
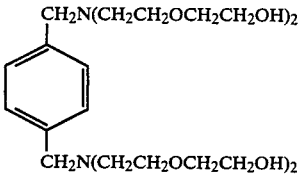
(XI)-(18)
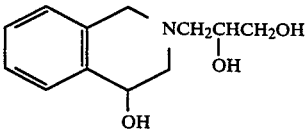
(XI)-(19)
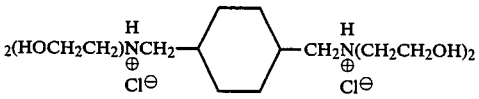
(XI)-(20)
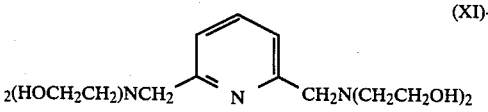
(XI)-(21)
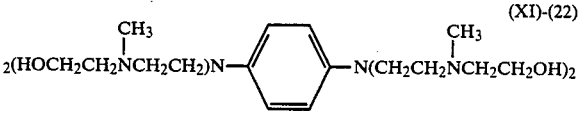
(XI)-(22)

-continued (XI)-(23)

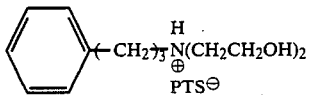

(XI)-(24)

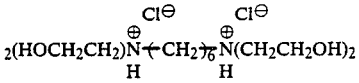

The compounds represented by the formula XI may be synthesized by known methods described in U.S. Pat. No. 4,552,834, Japanese Patent Publication 12056/1979 and Japanese Patent Publication (unexamined) No. 192953/1982.

[XII]

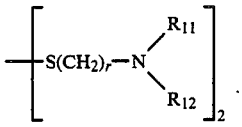

wherein $R_{11}$ and $R_{12}$ may be the same or different and represent a hydrogen atom, a substituted or unsubstituted lower alkyl group, preferably, having 1 to 5 carbon atoms such as methyl, ethyl and propyl groups, or an acyl group, preferably, having 1 to 3 carbon atoms such as acetyl and propyonyl groups, and r is an integer of 1 to 3 provided that $R_{11}$ and $R_{12}$ cannot be a hydrogen atom at the same time. $R_{11}$ and $R_{12}$ may be linked with each other to form a ring.

$R_{11}$ and $R_{12}$ are preferably substituted or unsubstituted lower alkyl groups.

As substituents which $R_{11}$ and $R_{12}$ may have, there are named hydroxyl, carboxyl, sulfo and amino groups.

The following are examples of the compounds represented by formula II, though the invention should not be limited to these.

(XII)-(1)

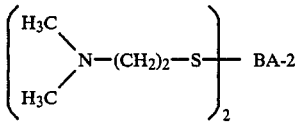

BA-2

(XII)-(2)

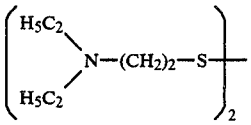

(XII)-(3)

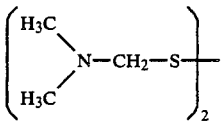

(XII)-(4)

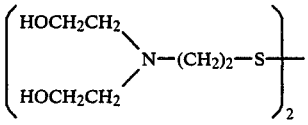

(XII)-(5)

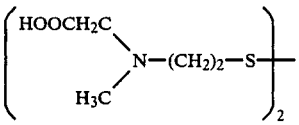

-continued (XII)-(6)

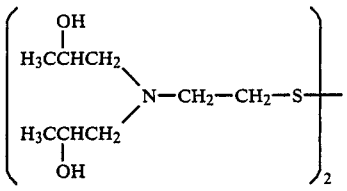

(XII)-(7)

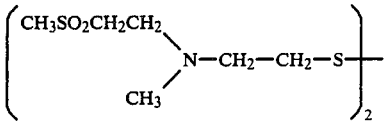

(XII)-(8)

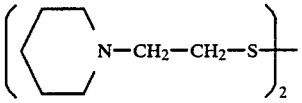

(XII)-(9)

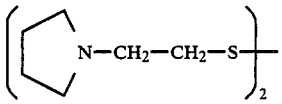

(XII)-(10)

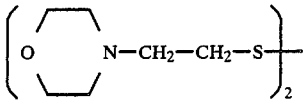

Those compounds represented by general formula XII may easily be synthesized by the method described in Japanese Patent Publication (unexamined) No. 95630/1978.

When the compounds represented by general formulae XI and/or XII are added to light-sensitive materials, these may be included in any layer such as an antihalation layer, an intermediate layer (for instance, between layers of different color-sensitivities, between layers of the same color-sensitivities, or between a light-sensitive layer and a non-light-sensitive layer), a light-sensitive silver halide emulsion layer, a non-light-sensitive silver halide emulsion layer, a yellow filter layer and a protective layer. These may be included in two or more layers.

More than one of these compounds may be used in a mixed state in light-sensitive materials. Total amount of these compounds added is $1\times10^{-5}$ to $1\times10^{-2}$ mol/m$^2$, preferably $2\times10^{5}$ to $5\times10^{-2}$ mol/m$^2$, more preferably $5\times10^{-5}$ to $2\times10^{-3}$ mol/m$^2$.

When being added to a bath in processing steps, the compounds represented by general formulae XI and/or XII are added to a bleaching bath, a bleach-fixing bath or a bath prior to a bath having bleaching ability such as a developing bath, or a pre-bath prior to a bleaching or bleach-fixing bath. However, these are preferably added to a developing bath, a bleaching bath or a bleach-fixing bath.

An amount of these to be added to a processing bath depends upon a type of photographic materials to be processed, a process temperature, a time period required for envisaged processing and so on, and is generally $2\times10^4$ to $1\times10^{-1}$ mol, preferably $5\times10^{-4}$ to $5\times10^{-2}$ mol, more preferably $2\times10^{-3}$ to $5\times10^{-2}$ mol per l of a process solution.

When these compounds are incorporated into light-sensitive materials, these compounds may be added as such in a coating solution or dissolved in a solvent which does not adversely affect silver halide color photographic materials, such as water and alcohols, and then added. Alternatively, these compounds may be dissolved in high boiling organic solvents and/or low boiling organic solvents and emulsified in an aqueous solution and, subsequently, added.

When these compounds are added to a processing solution, these are generally dissolved in water, alkaline water, organic solvents and so on in advance and then added, though these may directly be added to a processing solution in a form of powder.

The amount of coated silver contained in the light-sensitive materials of the present invention and the average iodide content in the whole emulsion grains are 5.2 g/m$^2$ or less and 5.5 mol% or less, respectively. Especially, the amount of the coated silver is preferably 5.0 g/m$^2$ or less, and may be little as far as it has sensitivity practically required for color photographic light-sensitive materials for taking photographs. However, when the amount of the coated silver in the light-sensitive materials or the average iodine content is larger than the above limit, shortening of the desilvering process is insufficient even if the 2-equivalent magenta polymer coupler is used.

The light-sensitive materials to be treated according to the present invention include color negative films for general use, movies, etc., and color reversal films for slides, movies and so on.

The coupler may be introduced into the light-sensitive materials by various known dispersion methods, for instance, solid dispersion method, alkali dispersion method, preferably, latex dispersion method, particularly oil-in-water dispersion method. In the oil-in-water dispersion method, the coupler is dissolved in a high boiling organic solvent or a low boiling solvent called an auxiliary solvent, or a mixture of both types and, then, finely dispersed in an aqueous medium, such as water or an aqueous gelatine solution, in the presence of a surfactant. Examples of the high boiling organic solvents are described in U.S. Pat. No. 2,322,027. Phase transition may take place during dispersion operation. Further, the resultant material may be used for coating after removing or decreasing the auxiliary solvent by, for instance, evaporation, noodle water washing or ultra-filtration when necessary.

Examples of the high boiling organic solvents are phthalic esters such as dibutyl phthalate, dicyclohexyl phthalate, di-2-ethylhexylphthalate and decylphthalate, phosphoric or phosphonic esters such as triphenyl phosphate, tricresyl phosphato, 2-ethylhexyldiphenyl phosphate, tricyclohexyl phosphate, tri-2-ethylhexyl phosphate, tridecyl phosphate, tributoxyethyl phosphate, trichloropropyl phosphate and di-2-ethylhexylphenyl phosphate, benzoil esters such as 2-ethylhexyl benzoate, dodecyl benzoate and 2-ethylhexyl-p-hydroxy benzoate, amides such as diethyldodecane amide and N-tetradecyl pyrrolidone, alcohols and phenols such as isostearyl alcohol and 2,4-di-tert. amyl phenol, aliphatic carboxylate such as dioctyl azelate, glycerol tributylate, isostearyl lactate and trioctyl citrate, aniline derivatives such as N,N-dibutyl-2-butoxy-5-tert. octyl aniline, hydro carbons such as paraffine, dodecyl benzene and diisopropyl naphthalene. As the auxiliary solvents, organic solvents having a boiling point above approximately 30° C., preferably above 50° C. and below approximately 160° C., such as ethyl acetate, butyl acetate, ethyl propionate, methyl ethyl ketone, cyclohexanone, 2-ethoxyethyl acetate and dimethylformamide.

Procedure and effects of the latex dispersion method and examples of latices for impregnation are described in U.S. Pat. No. 4,199,363, DEOS Nos. 2,541,274 and 2,541,230.

Any silver halide out of silver bromide, silver iodobromide, silver iodochlorobromide, silver chlorobromide, silver iodochloride and silver chloride may be used in photographic emulsion layers in the photographic light-sensitive materials used in the present invention. Preferred silver halide is silver iodobromide or iodochlorobromide containing not higher than 30 mol% silver iodide. Silver iodobromide containing 2 to 25 mol% silver iodide is particularly preferred.

The silver halide grains in the photographic emulsions may be so-called regular grains having a regular crystal form such as cubic, octahedron or fourteenhedron. Alternatively, the grains may be of an irregular crystal structure such as spherical, or ones having crystal defects such as twinning plane, or composite form thereof.

Regarding a grain size of silver halide, the grains may be fine grains having a size of 0.1$\mu$ or less, or may be large size grains having a diameter of the projected area of up to 10$\mu$. They may be monodispersed grains having a narrow distribution or polydispersed grains having a broad distribution.

Photographic emulsions to be used in the present invention may be prepared according to, for instance, the methods described in P. Glafkides, Chimie et Physique Photographique, Paul Montel, 1967; G. F. Duffin, Photographic Emulsion Chemistry, Focal Press, 1966; and V. L. Zelikman et al, Making and Coating Photographic Emulsion, Focal Press, 1964. That is, any of a acid method, neutral method and ammoniacal method may be used. Further, a single-jet, simultaneous jet method or a combination thereof may be used for reacting a soluble silver salt with a soluble halogen salt. A method of forming grains in silver ion-excessive condition, i.e., so-called reverse jet method, may be used. As one of the simultaneous jet method, a method where pAg is maintained constant in a liquid phase in which silver halide forms, i.e., controlled double jet method, may also be used. This method yields silver halide emulsion in which a crystal form is regular and a grain size is uniform.

It is also possible to mix more than two silver halides which have separately formed.

The aforesaid silver halide emulsion having regular grains is obtained by controlling pAg and pH during the formation of grains. Details are disclosed in, for instance, Photographic Science and Engineering, vol. 6, p 159 to 165 (1962), Journal of Photographic Science, vol. 12, p 242 to 251 (1964), U.S. Pat. No. 3,655,394 and UK Pat. No. 1,413,748.

A typical monodispersed emulsion contains silver halide whose average grain size is larger than 0.1$\mu$ and of which at least 95% by weight has a grain size within the average grain size ±40%. An emulsion containing silver halide whose average grain size is 0.25 to 2$\mu$ and of which at least 95% by weight or by number has a grain size within the average grain size ±20% may be used in the present invention. Methods for the preparation of such a emulsion are described in U.S. Pat. Nos. 3,574,628 and 3,655,394 and UK Pat. No. 1,413,748. Further, monodispersed emulsions as described in Japanese Patent Publication (unexamined) Nos. 8600/1973, 39027/1976, 83097/1976, 137133/1978, 48521/1979, 99419/1979, 37635/1983 and 49938/1983 may preferably be used in the present invention.

Use of flat grains in the silver halide photographic emulsion used in the invention may attain enhanced sensitivity including improvement of efficiency of color sensitization by sensitizing dyes, improved relation between sensitivity and graininess, improved sharpness, improvement or progress of development, improved covering power and improved cross-over.

Flat silver halide grain herein has a ratio of diameter to thickness of 5 or maore, such as more than 8 or between 5 and 8.

Diameter of silver halide grain herein is a diameter of circle which has the same area as the projected area of grain. In the present invention, the diameter of the flat silver halide grains is 0.3 to 5.0μ, preferably 0.5 to 3.0μ.

The thickness is 0.4μ or less, preferably 0.3 or less, more preferably 0.2μ or less.

Generally, a flat silver halide grain has two surfaces parallel to each other. Accordingly, "thickness" is represented by the distance between the two parallel surface constituting a flat silver halide grain.

Flat silver halide grains whose grain size and/or thickness is monodispersed as described in Japanese Patent Publication No. 11386/1972 may be used.

Monodispersion of flat silver halide grains mentioned above means that 95% of the grains falls within the range of the number average grain size ±60%, preferably, ±40%. "Number average grain size" herein means the number average diameter of the projected area of silver halide grains.

The flat silver halide grains contained in the emulsion used in the invention account preferably for 50% or more of the total projected area, more preferably 70% or more, particularly 90% or more.

Preferred flat silver halide is silver bromide, silver iodobromide, silver chlorobromide, silver chloroiodobromide, silver chloride and silver iodochloride. Silver iodochloride is particularly preferred in high speed light-sensitive materials. In the case of silver iodochloride, the content of silver iodide is usually 40 mol% or less, preferably 20 mol% or less, more preferably 15 mol% or less.

The flat grains may have homogeneus composition or may be composed of two or more phases of different halogen compositions.

For instance, when silver iodobromide is used, flat silver iodobromide grains may have layered structure composed of plural phases having different iodide contents. Japanese Patent Publication (unexamined) Nos. 113928/1983 and 99433/1984 described preferred examples of halide composition of flat silver halide grains and halide distribution in grains. Basically, relative contents of iodide included in flat silver halide grains in each phases are preferably chosen depending upon development conditions for the light-sensitive materials containing these flat silver halide grains, (such as the amount of a solvent for silver halide in a developing solution) and so on.

The flat silver halide grains may be composite type silver halide crystals in which oxide crystal such as PbO and silver halide crystals such as silver chloride are connected and silver halide crystals formed by epitaxial growth (such as crystals in which silver chloride, silver iodobromide or silver iodide is epitaxially grown or silver bromide, or crystals in which silver chloride, silver bromide, silver iodide or silver chloroiodobromide is epitaxially grown on hexagonal, or octahedral silver iodide). Examples of those are described in U.S. Pat. Nos. 4,435,501 and 4,463,087.

Regarding sites of the formation of latent image, grains which give a latent image mainly on the surface of grains or grains which give a latent image mainly in the inner part of the grains may be used. This may be properly selected depending upon, for instance, the use of the light-sensitive materials which use the aforesaid flat silver halide grains and the depth in the grain to which a developing solution to be used for processing the light-sensitive materials can penetrate so as to develop a latent image.

A preferred method of using the flat silver halide grains according to the present technique is described in detail in Research Disclosure No. 22534 (January, 1983) and No. 25330 (May, 1985), where the method of use, for instance, on a basis of relation between the thickness and optical properties of flat silver halide grains is disclosed.

Grains may have homogeneous crystal structure or may have different silver halide compositions in the inner part and the outer part or may have layered structure. Such emulsion grains are disclosed in UK Pat. No. 1,027,146, U.S. Pat. Nos. 3,505,068 and 4,444,877, and Japanese Patent Publication (unexamined) No. 143331/1985. More than 2 types of silver halides which have different compositions may be connected by epitaxial connection. Alternatively, silver halide may be connected with compounds other than silver halide, such as rhodan silver and lead oxide. Such emulsion grains are disclosed in U.S. Pat. Nos. 4,094,684; 4,142,900; 4,459,353; 4,349,622; 4,395,478; 4,433,501; 4,463,087; 3,656,962; and 3,852,067; UK Pat. No. 2,038,792; and Japanese Patent Publication (unexamined) No. 162540/1984.

It is also possible to use a mixture of various crystal types of grain.

Solvents for silver halide are useful to facilitate ripening. For instance, it is known that an excess amount of halogen ion is placed in a reactor to facilitate ripening. Therefore, it is clear that it is possible to facilitate ripening merely by introducing a halide salt solution into a reactor. Other ripening agents may also be used. Those ripening agents may previously be added to a dispersion medium in a reactor before adding silver and halide salts, or may be introduced into a reactor which adding one or more halide salts, silver salts and peptizing agents. Alternatively, the ripening agents may be separately introduced in a step of addition of halide salts and silver salts.

As ripening agents other than halogen ion, there are named ammonia or amino compound, thiocyanate salts such as alkali metal thiocyanate, particularly sodium or potassium thiocyanate, and ammonium thiocyanate. The use of thiocyanate ripening agents is disclosed in U.S. Pat. Nos. 2,222,264; 2,448,534; and 3,320,069. COnventional thioether ripening agents described in U.S. Pat. Nos. 3,271,157; 3,574,628 and 3,773,313 may also be used. Alternatively, thione compounds disclosed in Japanese Patent Publication (unexamined) Nos. 82408/1978 and 144319/1978 may be used.

Properties of silver halide grains can be controlled by making various compounds present in a course of silver halide formation and precipitation. Such compounds may be introduced in a reactor in advance or, according to a conventional manner, may be added while adding one or more salts. As described in U.S. Pat. Nos. 2,448,060; 2,628,167; 3,737,313; and 3,772,031; and Research Disclosure Vol. 134 (June, 1975), 13452, properties of silver halide may be controlled by making such compounds present in a step of silver halide formation and precipitation as compounds of copper, iridium, lead, bismuth, cadmium, zinc, chalcogen such as sulfur, selenium and tellurium, gold and precious metals of VII group. Silver halide emulsions may be sensitized by inner reduction of grains during the formation and precipitation thereof as described in Japanese Patent Publication No. 1410/1983 and Moiser, Journal of Photographic Science, Vol. 25, 1977, 19–27.

Silver halide emulsions are usually chemically sensitized. The chemical sensitization may be conducted using active gelatine as described in T. H. James, The Theory of the Photographic Process, 4th ed, Macmillan, 1977), pp 67–76. Alternatively, the chemical sentitization may be carried out using selenium, tellurium, gold, palladium, iridium or a mixture of these sensitizing agents at a pAg of 5 to 10, a pH of 5 to 8 and a temperature of 30° to 80° C. Preferably, the chemical sensitization is carried out in the presence of gold compounds and thiocyanate compounds, or sulfur containing compounds described in U.S. Pat. Nos. 3,857,711; 4,266,018; and 4,054,457, or other sulfur containing compounds such as hypo, thiourea compounds, rhodanine compounds. The chemical sensitization may be conducted in the presence of chemical sensitization aids. Useful chemical sensitization aids are compounds which are known to inhibit fogging and enhance sensitivity in the course of chemical sensitization, such as azaindene, azapyridazine and azapyrimidine. Examples of chemial sensitization modifying aids are described in U.S. Pat. Nos. 2,131,038; 3,411,914; and 3,554,757; Japanese Patent Publication (unexamined) No. 126526/1983; and G. F. Duffin, Photographic Emulsion Chemistry (Focal Press, 1966), p 138–143. In addition to or instead of the chemical sensitization, it is possible to conduct reduction sensitization using hydrogen as described in U.S. Pat. Nos. 3,891,446 and 3,984,249. Reduction sensitization may be carried out by use of such reducing agents as stannous chloride, thiourea dioxide and polyamine or by low pAg (e.g., below 5) treatment and/or high pH (e.g., above 8) treatment as described in U.S. Pat. Nos. 2,518,698; 2,743,182; and 2,743,183. Further, it is possible to enhance color sensitization by the chemical sensitization described in U.S. Pat. Nos. 3,917,485 and 3,966,476.

Silver halide photographic emulsions used in the invention may spectrally be sensitized by methine dyes or others. Dyes to be used include cyanine dyes, merocyanine dyes, complex cyanine dyes, complex mercocyanine dyes, holopolar cyanine dyes, hemicyanine dyes, styryl dyes and hemioxonol dyes. Particularly useful dyes are those belonging to cyanine dyes, merocyanine dyes and complex merocyanine dyes. In those dyes, any nuclei usually used in cyanine dyes may be adopted as basically reactive heterocyclic nuclei. Namely, pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus etc.; nuclei composed by fusing an alicyclic hydrocarbon ring with the aforesaid nuclei; and nuclei composed by fusing an aromatic hydrocarbon ring with the aforesaid nuclei, such as indolenine nucleus, benzindolenine nucleus, indole nucleus, benzoxazole nucleus, naphthooxazole nucleus, benzthiazole nucleus, naphthothiazole nucleus, benzselenazole nucleus, benzimidazole nucleus, quinaline nucleus, may be used. Those nuclei may be substituted on their carbon atoms.

For merocyanine dyes or complex merocyanine dyes, 5 or 6 membered heterocyclic nuclei, such as pyrrazoline-5-one-nucleus, thiohydontoin nucleus, 2-thiooxazalidine-2,4-dione nucleus, thiazoline-2,4-dione nucleus, rhodanine nucleus, thiobarbituric acid nucleus, may be used as a nucleus having a ketomethylene structure.

Those sensitizing dyes may be used alone or in combination. A combination of sensitizing dyes are often used, particularly, for the purpose of supersensitization.

Substances having no special sensitization effect per se or substances absorbing substantially no visual lights and showing supersensitization may be incorporated in the emulsions together with the sensitizing dyes. For instance, aminostilbene compounds substituted with a nitrogen-containing heterocyclic group, such as described in U.S. Pat. Nos. 2,933,390 and 3,635,721, aromatic organic acid formaldehyde condensate, such as described in U.S. Pat. No. 3,743,510, cadmium salts and azaindene compounds may be incorporated. The combinations described in U.S. Pat. Nos. 3,615,613; 3,615,641; 3,617,295; and 3,635,721, are particularly useful.

When the emulsion according to the invention is spectrally sensitized, it may be carried out at any stage of the preparation of the emulsion.

Generally, spectrally sensitizing dyes are added to a chemically sensitized emulsion before coating. U.S. Pat. No. 4,425,426 discloses a method of adding them to an emulsion before or during chemical sensitization. Further, U.S. Pat. Nos. 2,735,766; 3,628,960; 4,183,756; and 4,183,756 disclose a method of adding spectrally sensitizing dyes to a emulsion before the completions of formation of silver halide grains.

Particularly, U.S. Pat. Nos. 4,183,756 and 4,225,666 disclose that advantages of enhanced photographic sensitivity and strengthened adsorption of spectrally sensitizing dyes on silver halide grains are attained by adding the spectrally sensitizing dyes to an emulsion after the formation of stable nuclei for formatin of silver halide grains.

Known photographic additives capable of being used in the present invention are also described in Research Disclosures No. 17643 and No. 18716, whose relevant parts are shown in the following table.

| | Additive | RD17643 | RD18716 |
|---|---|---|---|
| 1. | Chemical sensitizing agent | page 23 | page 648, right column |
| 2. | Sensitivity enhancing agent | | page 648, right column |
| 3. | Spectral sensitizing agent, Supersensitizing agent | pages 23 and 24 | page 648, right column to page 649, right column |
| 4. | Antifoggant, Fogging stabilizing agent | pages 24 and 25 | page 649, right column |
| 5. | Light absorbing agent, Filter dye, UV absorbing agent | pages 25 and 26 | page 649, right column to page 650, left column |

-continued

| | Additive | RD17643 | RD18716 |
|---|---|---|---|
| 6. | Antistain agent | page 25, right column | page 650, left to right column |
| 7. | Hardening agent | page 26 | page 651, left column |
| 8. | Binder | page 26 | page 651, left column |
| 9. | Plasticizer, Lubricant | page 27 | page 650, right column |
| 10. | Coating aid, Surface activator | pages 26 and 27 | page 650, right column |
| 11. | Antistatic | page 27 | page 650, right column |

For the purpose of increase of sensitivity, strengthening of contrast or acceleration of development, photographic emulsion layers in the photographic materials according to the invention may contain, for instance, polyalkyleneoxide derivatives thereof, such as ethers, esters and amine, thioether compounds, thiomorphorines, quaternary ammonium salts, urethane derivatives, urea derivatives, imidazole derivatives and 3-pyrazolidones. For instance, those described in U.S. Pat. Nos. 2,400,532; 2,423,549; 2,716,062; 3,617,280; 3,772,021; and 3,808,003; and UK Pat. No. 1,488,991 may be used.

For the purpose of prevention of fogging during preparation, storage or development of the light-sensitive materials, or stabilization of the performance, various compounds may be contained in the silver halide photographic emulsion used in the present technique. There are named antifoggants or stabilizers, for instance, azols such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, mercaptotetrazoles, particularly 1-phenyl-5-mercaptotetrazole; mercaptopyrimidines; mercaptotriadines; thioketo compounds such as oxadolinethione; azaindenes such as triazaindens, tetraazaindenes, particularly 4-hydroxy substituted (1, 3, 3a, 7) tetraazoindenes, and pentaazaindenes; benzenethiosulfonic acid, benzenesulfinic acid, and benzenesulfonamide.

Various color couplers may be used in the present invention. "Color coupler" herein means a compound capable of forming a dye through coupling reaction with an oxidized form of an aromatic primary amine developing agent. Typical examples of useful color couplers include nephthol or phenol type compounds, pyrazolone or pyrazoloazole type compounds, or ketomethylene compounds of heterocycle. Cyan, magenta and yellow color couplers which may be used in the present invention are disclosed in the patents cited in Research Disclosure, 17643 (December, 1978) VII-D; and 18717 (November, 1979).

The color couplers incorporated in light-sensitive materials are preferably made nondiffusible by having ballast groups or being polymerized. 2-Equivalent couplers which are substituted with coupling splitting-off groups are more preferable than 4-equivalent couplers in which a hydrogen atom is in a coupling active cite, because the amount of coated silver can be decreased. Furthermore, couplers in which a formed dye has a proper diffusability, non-color couplers, DIR couplers which release a development inhibitor through coupling reaction or couplers which release a development accelerator may also be used.

A typical yellow coupler capable of being used in the present invention is an acylacetamide coupler of an oil protect type. Examples of such are disclosed in U.S. Pat. Nos. 2,407,210; 2,875,057; and 3,265,506. 2-Equivalent yellow couplers are preferably used in the present invention. Typical examples of such are the yellow couplers of an oxygen atom splitting-off type described in U.S. Pat. Nos. 3,408,194; 3,447,928; 3,933,501; and 4,022,620, or the yellow couplers of a nitrogen atom splitting-off type described in Japanese Patent Publication No. 10739/1983, U.S. Pat. Nos. 4,401,752 and 4,326,024, Research Disclosure (RD) 18053 (April, 1979), UK Pat. No. 1,425,020, DEOS No. 2,219,917; 2,261,361; 2,239,587; and 2,433,812. α-Pivaloyl acetanilide type couplers are excellent in fastness, particularly light fastness, of formed dye. α-Benzoyl acetanilide type couplers yield high color density.

Magenta couplers which may be used in the present invention other than the afore-mentioned 2-equivalent magenta polymer couplers include couplers of an oil protect type of indazolone, cyanoacetyl, or, preferably, pyrazoloazole such as 5-pyrazolone and pyrazolotriazole. Among 5-pyrazolone type couplers, couplers whose 3-position is substituted with an arylamino or acylamino group is preferred from the viewpoint of color phase and color density of the formed dye. Typical examples of such are described in U.S. Pat. Nos. 2,311,082; 2,343,703; 2,600,788; 2,908,573; 3,062,653; 3,152,896; and 3,936,015. A splitting-off group of the 2-equivalent 5-pyrazolone type couplers is preferably a nitrogen atom splitting-off group described in U.S. Pat. No. 4,310,619 and an arythio group described in U.S. Pat. No. 4,351,897. The 5-pyrazolone type coupler having ballast groups described in European Pat. No. 73,636 yields high color density.

As examples of pyrazoloazole type couplers, there are named pyrazolobenzimidazoles described in U.S. Pat. No. 3,061,432, preferably pyrazolo [5, 1-c] [1, 2, 4] triazoles described in U.S. Pat. No. 3,725,067, pyrazolotetrazols described in Research Disclosure 24220 (June, 1984) and Japanese Patent Publication (unexamined) No. 33552/1985, and pyrazolopyrazoles described in Research Disclosure 24230 (June, 1984) and Japanese Patent Publication No. 43659/1985. Imidazo [1, 2-b] pyrazoles described in U.S. Pat. No. 4,500,630 is preferred on account of small yellow minor absorption of formed dye. Pyrazols [1, 5-b] [1, 2, 4] triazole described in U.S. Pat. No. 4,540,654 is particularly preferred.

Cyan couplers which may be used in the present invention include naphthol or phenol couplers of an oil protect type. Typical naphthol type couplers are described in U.S. Pat. No. 2,474,293. Typical 2-equivalent naphtholic couplers of oxygen atom-splitting-off type are described in U.S. Pat. Nos. 4,052,212; 4,146,396; 4,228,233; and 4,296,200. Exemplary phenol type couplers are described in U.S. Pat. Nos. 2,369,929; 2,801,171; 2,772,162; and 2,895,826.

Cyan couplers which are resistant to humidity and heat are preferably used in the present invention. Examples of such are phenol type cyan couplers having an alkyl group higher than a methyl group at a metha position of a phenolic nucleus as described in U.S. Pat. No. 3,772,002; 2,5-diacylamino-substituted phenol type couplers as described in U.S. Pat. Nos. 2,772,162; 3,758,308; 1,126,396; 4,334,011; and 4,327,173; DEOS No. 3,329,729; and European Pat. No. 121,365; and phenol type couplers having a phenylureido group at the 2-position and an acylamino group at the 5-position as described in U.S. Pat. Nos. 3,446,622; 4,333,999; 4,451,559; and 4,427,767. Cyan couplers in which 5-position of naphtol is substituted with a sulfonamide or amide group as described in Japanese Patent Publication (unexamined) No. 60-237448/1985, Japanese Patent Application Nos. 264277/1984 and 268135/1984 are excellent in fastness of formed image and may also be preferably used in the present invention.

In order to compensate unnecessary absorption in the short-wave region of dye formed from magenta and cyan couplers, it is preferred to use a colored coupler together in color light-sensitive materials used for taking photographs. Examples of such are the yellow colored magenta coupler described in U.S. Pat. No. 4,163,670 and Japanese Patent Publication No. 39413/1982, the magenta colored cyan coupler described in U.S. Pat. Nos. 4,004,929 and 4,138,258, and UK Pat. No. 1,146,368.

Graininess may be improved by using together a coupler whose chromophoric dye is highly diffusible. As such couplers, some magenta couplers are specifically described in U.S. Pat. No. 4,366,237 and UK Pat. No. 2,125,570 and some yellow, magenta and cyan couplers are specifically described in European Pat. No. 96,570 and DEOS No. 3,234,533.

Dye-forming couplers and the aforesaid special couplers may be a dimer or higher polymer. Typical examples of polymerized dye-forming couplers are described in U.S. Pat. Nos. 3,451,820 and 4,080,211. Examples of polymerized magenta couplers are described in UK Pat. No. 2,102,173, U.S. Pat. No. 4,367,282, Japanese Patent Application Nos. 75041/1985 and 113596/1985.

In order to meet properties required for light-sensitive materials, two or more couplers may be used together in the one and same light-sensitive layer, or the same coupler may be introduced in two or more different layers.

The standard amount of the colored couplers to be used is 0.001 to 1 mole, preferably 0.01 to 0.5 mole for yellow couplers, 0.003 to 0.3 mole for magenta couplers and 0.002 to 0.3 mole for cyan couplers per mole of light-sensitive silver halide.

The light-sensitive materials according to the invention may contain a coupler which releases a development inhibitor in a course of development, i.e., a so-called DIR coupler.

Examples of the DIR coupler are those which release a heterocyclic mercapto type development inhibitor as described in U.S. Pat. No. 3,227,554; those which release benzotriazole derivatives as described in Japanese Patent Publication No. 9942/1983; so-called colorless DIR couplers described in Japanese Patent Publication No. 16141/1976; those which release a nitrogen-containing heterocyclic development inhibitor with decomposition of methylol after splitting-off as described in Japanese Patent Publication (unexamined) No. 90932/1977; those which release a development inhibitor, accompanied with intramolecular nucleophilic reaction after splitting-off as described in U.S. Pat. No. 4,248,962 and Japanese Patent Publication (unexamined) No. 56837/1987; those which release a development inhibitor by electron transfer via conjugated system after splitting-off as described in Japanese Patent Publication (unexamined) Nos. 114946/1981, 154234/1982, 188035/1982, 98728/1983, 209736/1983, 209737/1983, 209738/1983, 209739/1983 and 209740/1983; those which release a diffusive development inhibitor which makes development inhibiting ability deactivated in a development bath as Japanese Patent Publication Nos. 151944/1982 and 217932/1983; and those which release reactive compounds to form a development inhibitor by reaction in membrane during development or to make a development inhibitor deactivated as described in Japanese Patent Publication Nos. 182438/1985 and 184248/1985.

Among the aforesaid DIR couplers, couplers which are preferably used in combination with the coupler according to the invention are developing solution deactivation type couplers as described in Japanese Patent Publication (unexamined) No. 151944/1982, timing type couplers as described in U.S. Pat. No. 4,248,962 and Japanese Patent Publication (unexamined) No. 39653/1984 and reaction type couplers as described in Japanese Patent Publication (unexamined) No. 184248/1985. Particularly preferred ones are the developing solution deactivation type DIR couplers described in Japanese Patent Publication (unexamined) Nos. 151944/1982, 217932/1983, 218644/1985, 225156/1985, and 233650/1985, and the reaction type DIR couplers described in Japanese Patent Publication (unexamined) No. 184248/1985.

The light-sensitive materials of the present invention may contain a compound which releases a nucleus-forming agent or a development accelerator or a precursor thereof (hereinafter referred to as a development accelerator) in a form of image during development. Examples of such compounds are described in UK Pat. Nos. 2,097,140 and 2,131,188 and are couplers which release a development accelerator by coupling reaction with an oxidized form of an aromatic primary amine development agent or the like, i.e., DAR couplers.

The development accelerator or the like released from the DAR coupler preferably has an adsorbing group for silver halide. Examples of such DAR couplers are described in Japanese Patent Publication (unexamined) Nos. 157638/1984 and 170840/1984. Particularly preferred are DAR couplers which forms N-acyl substituted hydrazines having a monocyclic or fused cyclic hetro ring as an adsorbing group and splitting off at a sulfur or nitrogen atom from a coupling active site of a photographic coupler. Examples of such couplers are described in Japanese Patent Publication (unexamined) No. 128446/1985.

Compounds which have a development accelerating part in a coupler residue as described in Japanese Patent Publication (unexamined) No. 37556/1985 and compounds which release a development accelerator by oxidation reduction reaction with a development agent as described in Japanese Patent Publication (unexamined) No. 107029/1985 may also be used in the light-sensitive materials of the present invention.

The DAR couplers are preferably introduced into a light-sensitive silver halide emulsion of the light-sensitive materials of the present invention. Preferably, at least one light-sensitive layer contains substantially non-light-sensitive silver halide grains as described in Japanese Patent Publication (unexamined) Nos. 172640/1984 and 128429/1985.

The light-sensitive materials used in the present invention may contain hydroquinone derivatives, aminophenol derivative, amines, gallic acid derivatives, catechol derivatives, ascorbic acid derivatives, colorless couplers and sulfonamide phenol derivatives as a anticolorfoggant or a color mixing inhibitor.

Known antidiscoloration agents may be used in the light-sensitive materials of the present invention, such as hydroquinones, 6-hydroxycumarones, 5-hydroxycumarones, spirocumarones, p-alkoxyphenols, hindered phenols such as bisphenols, gallic acid derivatives, methylenedioxybenzenes, aminophenols, hindered amines, and ether or ester derivatives obtained by silylation or alkylation of a phenolic hydroxyl group of these compounds. Further, metal complexes such as (bissalicylaldoximate) nickel complex and (bis-N,N-dialkyldithiocarbamate) nickel complex may also be used.

UV absorbants may be added to a hydrophilic colloid layer in the light-sensitive materials. For instance, benzotriazoles substituted with an aryl group described in U.S. Pat. Nos. 3,553,794 and 4,236,013, Japanese Patent Publication No. 6540/1976 and Europe Pat. No. 57,160; butadienes described in U.S. Pat. Nos. 4,450,229 and 4,195,999; cinnamic esters described in U.S. Pat. Nos. 3,705,805 and 3,707,375; benzophenones described in U.S. Pat. Nos. 3,215,530 and UK Pat. No. 1,321,355; and polymeric compound having UV absorbing residues described in U.S. Pat. Nos. 3,761,272 and 4,431,726 may be used. Fluorescent whitners having a UV absorbing property described in U.S. Pat. Nos. 3,499,762 and 3,700,455. Typical UV absorbants are those described in Research Disclosure 24239 (June, 1984).

The light-sensitive materials of the invention may include one or more surfactants for various purposes, for instance, as a coating assistant or an antistatic, for improvement of slipping, emulsifying dispersion, prevention of adhesion or improvement of photographic properties such as development acceleration, contrast development and sensitization.

The light-sensitive materials prepared by te present invention may contain water-soluble dyes as filter dyes in hydrophilic colloid layers for the purpose of irradiation or antihalation and so on. As such dyes, oxonol dye, hemioxonol dye, styryl dye, merocyanine dye, anthraquinone dye, azo dye are preferably used. Besides, cyanine dye, axomethine dye, triarylmethane dye and phthalocyanine dye are also useful. It is possible to emulsify oil-soluble dye by oil-in-water dispersion method and add it to hydrophilic colloid layers.

In order to introduce a lipophilic compound such as photographic couplers into a hydrophilic organic colloid layer in the light-sensitive materials, various methods such as oil-in-water dispersion method, latex dispersion method and alkali dispersion method may be adopted. A proper method may be selected depending on chemical structure and physicochemical properties of a compound to be introduced.

The photograpic couplers of the present invention may be added to, for instance, one or more silver halide emulsion layers preferably according to the latex dispersion method or, more preferably, the oil-in-water dispersion method. In the oil-in-water dispersion method, the couplers are dissolved in a high boiling organic solvent of a boiling point of 175° C. or higher in an atmospheric pressure (hereinafter referred to as oil) using, if necessary, a low boiling auxiliary solvent together, and are finely dispersed in water or an aqueous binder solution of, for instance, gelatine, preferably, in the presence of a surfactant.

Typical high boiling organic solvents are phthalates described in U.S. Pat. Nos. 2,272,191 and 2,322,027, Japanese Patent Publication (unexamined) Nos. 31728/1979 and 118246/1979; phosphates and phosphonates described in U.S. Pat. Nos. 3,676,137, 4,217,410, 4,278,756, 4,326,022 and 4,353,979; benzoates described in U.S. Pat. No. 4,080,209; amides described in U.S. Pat. Nos. 2,533,514, 4,106,940 and 4,127,413; alcohols and phenols described in Japanese Patent Publication (unexamined) Nos. 27922/1976, 13414/1978 and 130028/1978 and U.S. Pat. No. 2,835,579; aliphatic carboxylic esters described in Japanese Patent Publication (unexamined) Nos. 26037/176, 27921/1976, 149028/1976, 34715/1977, 1521/1978, 15127/1978, 58027/1979, 64333/1981 and 114940/1981, U.S. Pat. Nos. 3,748,141, 3,779,765, 4,004,928, 4,430,421 and 4,430,422; anilines described in Japanese Patent Publication No. 105147/1983; hydro carbons described in Japanese Patent Publication (unexamined) Nos. 62632/1975 and 99432/1979 and U.S. Pat. No. 3,912,515; ones described in Japanese Patent Publication (unexamined) No. 146622/1978, U.S. Pat. No. 3,689,271, 3,700,454, 3,764,336, 3,765,897, 4,075,022 and 4,239,851 and DEOS No. 2410914. Two or more high boiling organic solvents may be used in combination. For instance, a combination of phthalate and phosphate is described in U.S. Pat. No. 4,327,175.

A dispersion method by polymers described in Japanese Patent Publication (unexamined) No. 59943/1976, Japanese Patent Publication Nos. 39853/1976 and 126830/1981, U.S. Pat. Nos. 2,772,163 and 4,201,589 may also be used.

Gelatine is preferred as a binder or protective colloid which may be used in an emulsion layer or an intermediate layer of the light-sensitive materials of the invention, though other hydrophilic colloid may also be used. For instance, protein such as gelatine derivatives, graft polymers of gelatine and other polymers, albumine and casein; cellulose derivatives such as hydroxyethyl cellulose, carboxymethyl cellulose and cellulose sulfuric esters, sodium alginate, sugar derivatives such as starch derivatives; various synthetic hydrophilic homo- or copolymers such as polyvinyl alcohol, polyvinyl alcohol partial acetal, poly-N-vinyl pyrrolidone, polyacrylic acid, polymethacrylic acid, polyacrylamide, polyvinylimidazole and polyvinylpyrazol.

For gelatine, lime-treated gelatine for general use, acid-treated gelatine, and enzyme-treated gelatine described in Bull. Soc. Sci. Phot. Japan, No. 16, p 30 (1966) may be used. Further, hydrolysed gelatine may be used.

Inorganic or organic hardeners may be included in a photographic light-sensitive layer or any hydrophilic colloid layers constituting a backing layer in the light-sensitive materials of the invention. For instance, cromate, aldehydes such as formaldehyde, glyoxal and glutaraldehydo, N-methylol compounds such as dimethylol urea are named as examples. Active halogen compound such as 2,4-dichloro-6-hydroxy-1,3,5-triazine, and active vinyl compounds such as 1,3-bisvinylsulfonyl-2-propanol, 1,2-bisvinylsulfonylacetamide ethane and vinyl polymers having as vinyl sulfonyl group on side chains are preferred, because these quickly harden hydrophilic colloid to yield stable photographic properties. N-carbamoylpyridinium salts and haloamidinium salts are excellent in a hardening speed.

Multilayer color photographic materials according to this invention usually have at least one red-sensitive emulsion layer, at lest one green-sensitive emulsion layer and at least one blue-sensitive emulsion layer on a substrate. The order of arrangement of these layers may optionally be selected at needs. Layer arrangement is preferably in an order of red-sensitive layers, green-sensitive layers and, then, blue-sensitive layers from the substrate. It is possible to constitute an emulsion layer having a certain color-sensitivity using more than one emulsion layers having different sensitivities to enhance attainable sensitivity. It is also possible to make up a three-layered constitution to improve graininess. Further, there may be a non-color-sensitive layer between two or more emulsion layers having the same color sensitivity. It is possible that, between emulsion layers of the same color sensitivity, another emulsion layer of a different color sensitivity is inserted.

In multi-layered multi-color photographic materials, there may be provided filter layers for absorbing lights of specifc wave lengths or layers for preventing halation. The aforesaid organic dyes as well as colloid silver grains may be used in those light-absorbing layers.

For the purpose of enhancing sensitivity by reflection of light and trapping of development inhibiting substances, non-light-sensitive silver halide fine grain emulsion may be used in one or more non-light-sensitive layers of multi-layered multi-color photographic materials.

Generally, cyan-forming couplers are included in red-sensitive emulsion layers; magenta-forming couplers in green-sensitive emulsion layers; and yellow-forming couplers in blue-sensitive emulsion layers. However, other combinations are also permitted. For instance, an IR-sensitive layer is combined to yield quasicolorphotographs or materials to be exposed to semi-conductor laser. Further, it is possible to admix a coupler which forms a dye other than complementary color of a sensitive light wave length of each layer so as to avoid unnatural hue.

In the photographic materials according to the invention, photographic emulsion layers and other layers are coated on a conventional flexible substrate such as a plastic film, paper and cloth, or a rigid substrate such as glass, ceramics or metal. Examples of useful flexible substrate are films and descrete plates composed of a synthetic or semi-synthetic polymer such as cellulose nitrate, cellulose acetate, cellulose acetate nitrate, polystyrene, polyvinylchloride, polyethylene terephthalate and polycarbonate, and paper coated or laminated with $\alpha$-olefine polymer such as polyethylene, polypropylene and ethylenebutene copolymer. The substrate may be colored with dyes or pigments. It may be made black for shielding a light. The surface of the substrate is generally undercoated to give good adhesion with a photographic emulsion layer or the like. It is possible to subject to substrate surface to glow discharge, corona discharge, UV radiation or flame treatment before or after undercoating.

For the coating with photographic emulsion layers or hydrophilic colloid layers, various known coating methods may be used, such as a dip coating method, roller coating method, curtain coating method and extrusion coating method. When occasion demands, the coating methods described in U.S. Pat. Nos. 2,681,294, 2,761,791, 3,526,528, and 3,508,947 may be used for the simultaneous coating with plural layers.

Various exposure means may be adopted for the light-sensitive materials of the present invention. Any sources of light which radiate radiant rays corresponding to the sensitive wave length of the light-sensitive materials may be used as a lighting source or a writing source of light. Natural light (sun light), incandescents, halogen atom sealing lamps, mercury lamps, fluorescent lamps, flash light sources such as strobo lamps and metal burning flash lamps are usually used. Further, laser of gases, dye solutions or semiconductors, luminescent diodes and plasma light sources may also be used. Fluorescent light emitted from a fluorescent body excited by electron beams or the like (CRT, etc.), or a exposure means of a combination of microshutter arrays using liquid crystal (LCD) or lead zirconate titanate (PLZT) doped with lanthanum and a source of light of a linear or plane form may also be used.

A color developing solution used for the development of the light-sensitive materials of the present invention is preferably an aqueous alkaline solution containing an aromatic primary amine type color developing agent as a main component. Although aminophenolic compounds are useful as the color developing agent, p-phenylenediamine type compounds are preferred.

As examples of the latter, there can be named 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline or sulfate, hydrochloride, phosphate, p-toluenesulfonate, tetraphenylborate and p-(t-octyl)benzensulfonate thereof. These diamines are generally more stable in a salt state than in a free state and, therefore, are preferably used.

Examples of the aminophenol type derivatives are o-aminophenol, p-aminophenol, 4-amino-2-oxy-toluene, 2-amino-3-oxy-toluene, 2-oxy-3-amino-1,4-dimethylbenzene.

In addition, those described in L. F. A. Mason "Photographic Processing Chemistry", Focal Press (1966), pp 226 to 229, U.S. Pat. Nos. 2,193,015 and 2,592,364 and Japanese Patent Publication (unexamined) No. 64933/1973 may be used. Those may be used in combination if necessary.

A color developing solution generally contains a pH buffer such as carbonate, borate and phosphate of alkali metals, a development restrainer or antifoggant such as bromide, iodide, benzimidazols, benzthiazols and mercapto compounds, a preservative such as hydroxylamine, triethanolamine, compounds described in DEOS No. 2622950, sulfite and hydrogen sulfite, an organic solvent such as ethyleneglycol, a development accelerator such as benzylalcohol, polyethyleneglycol, quarternary ammonium salts, amines, thiocyanate and 3,6-thiaoctane-1,8-diol, a dye-forming coupler, a competing coupler, a nuclens forming agent such as sodium boron hydride, an auxiliary developing agent such as 1-phenyl-3-pyrazolidone, a thickner, a chelating agent such as ethylenediaminetetraacetic acid, nitrirotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, aminopolycarboxylic acids as described in Japanese Patent Publication (unexamined) No. 195845/1983, 1-hydroxyethylidene-1,1'-diphosphonic acid, organic phosphonic acids as described in Research Disclosure 18170 (May, 1979), amino phosphonic acids such as aminotris(methylenephosphonic acid) and ethylenediamine-N,N,N',N'-tetramethylenephosphonic acid, and phosphonocarboxylic acids as described in Japanese Patent Publication (unexamined) Nos. 102726/1977, 42730/1978, 121127/1979, 4024/1980, 4025/1980, 126241/1980, 65955/1980 and 65956/1980, and Research Disclosure 18170.

The color developing agent is generally used in an amount of about 0.1 to about 30 g, preferably about 1 to about 15 g per l of a color developing solution. The pH of the color developing solution is generally 7 or higher, preferably about 9 to 17. Further, it is possible to use an auxiliary solution to adjust the concentrations of halides, a color developing agent and the like so as to decrease the amount of a replenisher for the color developing bath.

In the development of reversal color light-sensitive materials, color development is usually carried out after black-and-white development. In the black-and-white developing solution, known developing agent, for instance, dihydroxybenzenes such as hydroquinone and hydroquinonemonosulfonate, 3-pyrazolidones such as 1-phenyl-3-pyrazolidone, aminophenols such as N-methyl-p-aminophenol, may be used alone or in combination.

The photographic emulsion layers after the color development are usually subjected to a bleaching process. The bleaching may be carried out at the same time with a fixing treatment, as called bleach-fixing, or may be carried out separately. In the bleach-fixing process, a counterflow supplement method may be used wherein two or more baths are present and the bleach-fixing solution is fed to the later bath and a overflow liquid of the later bath is introduced in the former bath.

A bleaching agent to be used in the bleaching treatment or the bleach-fixing treatment include compounds of polyvalent metals such as iron (III), cobalt (III), chromium (VI) and copper (II) such as ferricyanides, peroxides, quinones and nitroso compounds; bichromates; organic complex salts of iron (III) or cobalt (III) (e.g., complex salts of aminopolycarboxylic acid, such as ethylenediaminetetraacetic acid and diethylenetriaminepentaacetic acid, aminopolyphopshonic acid, phosphonocarboxylic acid and organic phosphonic acid), or organic acids such as citric acid, tartaric acid and malic acid; persulfates; hydrogen peroxide, and permanganates.

Among these, ferric ion organic complex salts and persulfates are particularly preferred from the viewpoint of facilitation of the process and environmental polution.

Aminocarboxylic acids and aminopolyphosphonic acids and salts thereof useful for forming organic complex salts of ferric ion are named below:

ethylenediaminetetraacetic acid,
diethylenetriaminepentaacetic acid,
ethylenediamine-N-(β-oxyethyl)-N,N',N'-triacetic acid,
1,2-diaminopropanetetraacetic acid,
triethylenetetraminehexaacetic acid,
propylenediaminetetraacetic acid,
nitrilotriacetic acid,
nitrilotripropionic acid,
cyclohexanediaminetetraacetic acid,
1,3-diamino-2-propanoltetraacetic acid,
methyliminodiacetic acid,
iminodiacetic acid,
hydroxyliminodiacetic acid,
dihydroxyethylglycinethyletherdiaminetetraacetic acid,
glycoletherdiaminetetraacetic acid,
ethylenediaminetetrapropionic acid,
ethylenediaminedipropionic acid,
phenylenediaminetetraacetic acid,
2-phosphonobutane-1,2,4-triacetic acid,
1-3-diaminopropanol-N,N,N'-N'-tetramethylenephosphonic acid,
ethylenediamine-N,N,N',N'-tetramethylenephosphonic acid,
1,3-propylenediamine-N,N,N',N'-tetramethylenephosphonic acid,
1-hydroxyethylidene-1,1'-diphosphonic acid.

Among these, ferric ion complex salts of ethylenediaminetetraacetic acid, diethylenetriaminepentaacetic acid, cyclohexanediaminetetraacetic acid, 1,2-diaminopropanetetraacetic acid, methyliminodiacetic acid are preferred on account of their high bleaching power.

The ferric ion complex salt may be used in a form of one or more complex salt previously prepared or may be formed in a solution using a ferric salt, such as ferric sulfate, ferric chloride, ferric nitrate, ferric ammonium sulfate and ferric phosphate, and a chelating agent such as aminopolycarboxylic acid, aminopolyphosphonic acid and phosphonocarboxylic acid. When the complex salt is formed in a solution, one or more ferric salts may be used, and one or more chelating agents may also be used. In either case of the previously prepared complex salt or the in situ formed one, an excessive amount of the chelating agent to form the ferric ion salt may be used. Further, in the bleaching solution or the bleach-fixing solution containing the aforesaid ferric ion complex, complex salts of metal ions other than iron, such as calcium, magnesium, aluminum, nickel, bismuth, zinc, tangsten, cobalt and copper, or complex salts thereof or hydrogen peroxide may be contained.

The persulfates for the bleaching or bleach-fixing treatment in the present invention are, for instance, alkali metal persulfate such as potassium persulfate and sodium persulfate, and ammonium persulfate.

In the bleaching or bleach-fixing solution, bromides such as potassium bromide, sodium bromide and ammonium bromide, chlorides such as potassium chloride, sodium chloride and ammonium chloride, or iodides such as ammonium iodide may be contained as a rehalogenating agent. If necessary, one or more inorganic or organic acids and alkali or ammonium salts thereof having a pH buffering ability, such as, boric acid, borax, sodium metaborate, acetic acid, sodium acetate, sodium carbonate, potassium carbonate, phosphorous acid, phosphoric acid, sodium phosphate, citric acid, sodium citrate and tartaric acid, anti-corrosives such as ammonium nitrate and guanidine may be added.

The amount of the bleaching agent is properly 0.1 to 2 moles per l of a bleaching solution. The preferred pH range of the bleaching solution is 0.5 to 8.0 for ferric ion complex salts, particularly 4.0 to 7.0 for ferric ion complex salts of aminopolycarboxylic acid, aminopolyphosphonic acid, phosphonocarboxylic acid and organophosphonic acid. Persulfates are preferably used at a concentration of 0.1 to 2 moles/l and at a pH of 1 to 5.

The fixing agent used in the fixing or bleach-fixing treatment may be any conventional one, for instance, thiosulfates such as sodium thiosulfate and ammonium thiosulfate; thiocyanates such as sodium thiocyanate and ammonium thiocyanat; thioethers or thioureas such as ethylenebisthioglycol acid, 3,6-dithia-1,8-octanediol, which are water soluble, silver halide-solubilizing agents. These agents may be used alone or in combination. Further, the special bleach-fixing solution consisting of a combination of a fixing agent and a large amount of halide such as potassium iodide described in Japanese Patent Publication (unexamined) No. 155354/1980 may be used in the bleach-fixing process.

The concentration of the fixing agent in the fixing or bleach-fixing treatment is preferably 0.2 to 4 moles/l. In the bleach-fixing treatment, 0.1 to 2 moles of the ferric ion complex and 0.2 to 4 moles of the fixing agent per l of the bleach-fixing solution may preferably be used. Generally, the pH value of the fixing or bleach-fixing solution is preferably 4.0 to 9.0, more preferably 5.0 to 8.0.

In the fixing or bleach-fixing solution, a preservative such as sulfite, for instance, potassium sulfite and ammonium sulfite, bisulfite, hydroxylamine, hydrazine, bisulfite addition product of aldehyde compounds, for instance, acetaldehyde sodium bisulfite, may be contained in addition to the aforesaid additives. Further, various fluorescent brighteners, defoaming agents, surfactants, polyvinylpyrrolidone or organic solvents such as methanol may also be contained.

In the bleaching bath, the bleach-fixing bath and/or preceding bath thereof, a bleaching accelerator other than the aforesaid desilvering, accelerator may be used if necessary. For instance, the compounds having a mercapto or disulfide group described in U.S. Pat. No. 3,893,858, German Pat. Nos. 1,290,812 and 2,059,988, Japanese Patent Publication (unexamined) Nos. 32736/1978, 57831/1978, 37418/1978, 65732/1978, 72623/1978, 95630/1978, 95631/1978, 104232/1978, 124424/1978, 141623/1978 and 28426/1978, and Research Disclosure 17129 (July, 1978), the thiazolidine derivatives described in Japanese Patent Publication (unexamined) No. 14029/1975, the thiourea derivatives described in Japanese Patent Publication No. 8506/1970, Japanese Patent Publication (unexamined) Nos. 20832/1977 and 32735/1978 and U.S. Pat. No. 3,706,561, the iodide described in German Pat. No. 1,127,715 and Japanese Patent Publication (unexamined) No. 16235/1983, the polyethyleneoxides described in German Pat. Nos. 966,410 and 2,748,430, and the polyamine compounds described in Japanese Patent Publication No. 8836/1970, other compounds described in Japanese Patent Publication (unexamined) Nos. 42434/1974, 59644/1974, 94927/1978, 35727/1979, 26506/1980 and 163940/1983, and iodide and bromide ions may also be used. Among these, compounds having a mercapto or disulfide group are preferred due to the larger acceleration effects, particularly those described in U.S. Pat. No. 3,893,858, German Pat. No. 1,290,812 and Japanese Patent Publication (unexamined) No. 95630/1978. Further, the compounds described in U.S. Pat. No. 4,552,834 are also preferred. Those bleaching accelerators may also be incorporated in the light-sensitive materials.

After the bleaching or bleach-fixing process, aftertreatment such as water washing and stabilization is usually carried out.

In the water washing process and the stabilization process, various known compounds may be added for the purpose of prevention of precipitation and stabilization of washing water. For instance, chelating agents such as inorganic phosphoric acid, aminopolycarboxylic acid, organic phosphonic acid, bactericides for inhibition of various bacteria or mold, or anti-mold agents such as those described in J. Antibact. Antigung. Agents, vol. 11, No. 5, p 207–223 (1983) and those described in Bokin Bobai no Kagaku (chemistry for inhibition of bacteria and mold). Hiroshi Horiguchi, metal salts such as magnecium salts, aluminium salts and bismuth, salts of alkali metals and ammonium, and surfactants for prevention of unevenness or the reduction of load for drying may be used. Alternatively, compounds described in L. E. West, "Water Quality Criteria" Phot. Sci. and Eng. vol. 9 No. 6, pp 344–359 (1965), may be used. Particularly, chelating agents, bactericides and antimold agents are effectively used.

The water washing process is usually carried out in a multi-step counterflow manner consisting of more than one baths (e.g. 2 to 9 baths) to save the amount of washing water. Otherwise, multi-step counterflow stabilization process may be carried out instead of the water washing process.

In the stabilizing bath, various compounds other than the aforesaid additives are added for the purpose of stabilizing the image. For instance, various buffer agents for adjusting the pH of the membrane (e.g., to pH 3 to 9), such as a combination of borate, metaborate, borax, phosphates, carbonates, potassium hydroxide, sodium hydroxide, aqueous ammonium, monocarboxylic acids, dicarboxylic acids and, polycarboxylic acids, and aldehydes such as formalin may be used. In addition, chelating agents such as inorganic phosphoric acid, aminopolycarboxylic acid, organic phosphonic acid, aminopolyphosphonic acid and hosphonocarboxylic acid, bactericides, antimold such as thiazoles, isothiazoles, halogenated phenols, sulfanylamide and benzotriazole, surfactants, fluorescent whiteners and hardening metal salts may also be used. Two or more of these may be used in combination for the same purpose or for different purposes.

Further, addition of various ammonium salts such as ammonium chloride, ammonium nitrate, ammonium sulfate, ammonium phosphate, ammonium sulfite and ammonium thiosulfate as a pH adjusting agent after the processing is preferred in order to improve preservability of the image.

Further, in the color phtographic materials for taking pictures, it is possible to substitute the water washing and stabilizing step after fixing, which is usually carried out, with the stabilizing step and the water washing step (water-saving manner) as described above. In this case, formalin may not be added to the stabilizing solution if only the 2-equivalent coupler is used as a magenta coupler.

The period of time of the water washing and the stabilization according to the invention depends on a type of the light-sensitive materials and process conditions and is usually 20 seconds to 10 minutes, preferably 20 seconds to 5 minutes.

Each of the process solutions is used at a temperature of from 10° to 50° C. A range of from 33° to 38° C. is a standard. However, a higher temperature may be used to facilitate the process and to shorten the time period of the process. In contrast, a lower temperature may also be used to improve the quality of the image and the stability of the process solution. Furthermore, in order to save the amount of silver in the light-sensitive materials, the process where cobalt intensifier or hydrogen peroxide intensifier described in German Pat. No. 2,226,770 and U.S. Pat. No. 3,674,499 or the single bath develop-bleach-fixing process described in U.S. Pat. No. 3,923,511 may be used.

Further, each of the time periods of the processes may be shorter than a standard one for a quick processing as for as no serious disadvantage takes place.

For the purposes of simplifying and facilitating the process, the color developing agent or precursor thereof may be incorporated into the silver halide color photographic materials according to the invention. In the event of incoporation, the precursor is preferred on account of higher stability of the photographic materials. As examples of the precursors of developing agents, there can be named, for instance, indoaniline type compounds described in U.S. Pat. No. 3,342,597, shiff base type compounds described in U.S. Pat. No. 3,342,599, Research Disclosures 14850 (August, 1976) and 15159 (November, 1976), aldols described in Research Disclosure 13924, metal salt complexes described in U.S. Pat. No. 3,719,492, and urethane compounds described in Japanese Patent Publication (unexamined) No. 135628/1978. Various precursors of a salt type as described in Japanese Patent Publication (unexamined) Nos. 6235/1981, 16133/1981, 59232/1981, 67842/1981, 83734/1981, 83735/1981, 83736/1981, 89735/1981, 81837/1981, 54430/1981, 106241/1981, 107236/1981, 97531/1982 and 83565/1982 may also be used in the invention.

Various 1-phenyl-3-pyrazolidones may be incorporated into the silver halide photographic materials according to the invention to facilitate the color development. Typical compounds of such are disclosed in Japanese Patent Publication (unexamined) Nos. 64339/1981, 144547/1982, 211147/1982, 50532/1983, 5053/1983, 50533/1983, 50534/1983, 50536/1983 and 115438/1983.

In the case of a continuous process, replenishers are fed to corresponding treatment baths so as to prevent changes in the compositions of the bath solutions, which results in constant finished properties. The amount of a replenisher may be decreased to half or less of a standard amount to save cost when necessary.

Each treatment bath may be provided with a heater, temperature sensor, level sensor, circulation pump, filter, various floating covers, and various squeezees.

The invention will be further be explained in the following examples. cl EXAMPLE 1

A multilayered color photographic light-sensitive material, Sample (i), consisting of layers which have the following compositions were prepared on a substrate of cellulose triacetate film which had been undercoated.

Composition of the Light-Sensitive Layer

The coated amounts of silver halide and colloidal silver are expressed in gram of silver per $m^2$, the coated amounts of couplers, additives and gelatine are expressed in $g/m^2$, and the amount of sensitizing dyes are expressed in mole per mole of silver halide in the same layer.

1st Layer (Antihalation Layer)

| | |
|---|---|
| black colloidal silver | 1.3 |
| gelatine | |
| colored coupler C-1 | 0.06 |
| UV absorbant UV-1 | 0.1 |
| UV absorbant UV-2 | 0.2 |
| dispersion oil Oil-1 | 0.01 |
| dispersion oil Oil-2 | 0.01 |

2nd Layer (Intermediate Layer)

| | |
|---|---|
| gelatine | 1.0 |
| colored coupler C-2 | 0.02 |
| dispersion oil Oil-1 | 0.1 |

3rd Layer (First Red-Sensitive Emulsion Layer)
silver iodobromide emulsion (average grain size 0.3μ, ratio of diameter to thickness 4.0)

| | |
|---|---|
| gelatine | 0.6 |
| sensitizing dye I | $1.5 \times 10^{-4}$ |
| sensitizing dye II | $4.5 \times 10^{-4}$ |
| sensitizing dye III | $1.5 \times 10^{-5}$ |

-continued

| | |
|---|---|
| coupler C-3 | 0.06 |
| coupler C-4 | 0.06 |
| coupler C-8 | 0.04 |
| coupler C-2 | 0.03 |
| dispersion oil Oil-1 | 0.03 |
| dispersion oil Oil-2 | 0.012 |

4th Layer (Second Red-Sensitive Emulsion Layer)
silver iodobromide emulsion (average grain size 0.5μ, ratio of diameter to thickness 5.0)

| | |
|---|---|
| gelatine | 0.7 |
| sensitizing dye I | $1.5 \times 10^{-4}$ |
| sensitizing dye II | $4.5 \times 10^{-4}$ |
| sensitizing dye III | $1.5 \times 10^{-5}$ |
| coupler C-3 | 0.24 |
| coupler C-4 | 0.24 |
| coupler C-8 | 0.04 |
| coupler C-2 | 0.04 |
| dispersion oil Oil-1 | 0.05 |
| dispersion oil Oil-3 | 0.10 |

5th Layer (Third Red-Sensitive Emulsion Layer)
silver iodobromide emulsion (average grain size 0.7μ, ratio of diameter to thickness 8.0)

| | |
|---|---|
| gelatine | 1.0 |
| sensitizing dye I | $2 \times 10^{-4}$ |
| sensitizing dye II | $6 \times 10^{-4}$ |
| sensitizing dye III | $2 \times 10^{-5}$ |
| coupler C-6 | 0.05 |
| coupler C-7 | 0.1 |
| coupler C-2 | 0.03 |
| dispersion oil Oil-1 | 0.01 |
| dispersion oil Oil-2 | 0.05 |

6th Layer (Intermediate Layer)

| | |
|---|---|
| gelatine | 1.0 |
| compound Cpd-A | 0.03 |
| dispersion oil Oil-1 | 0.05 |
| dispersion oil Oil-2 | 0.05 |

7th Layer (First Green-Sensitive Emulsion Layer)
silver iodobromide emulsion (average grain size 0.3μ, ratio of diameter to thickness 4.0)

| | |
|---|---|
| gelatine | 0.5 |
| sensitizing dye VI | $7.5 \times 10^{-4}$ |
| sensitizing dye V | $3 \times 10^{-4}$ |
| coupler C-9 | 0.2 |
| coupler C-5 | 0.03 |
| coupler C-1 | 0.03 |
| dispersion oil Oil-1 | 0.5 |

8th Layer (Second Green-Sensitive Emulsion Layer)
silver iodobromide emulsion (average grain size 0.5μ, ratio of diameter to thickness 5.5)

| | |
|---|---|
| gelatine | 0.5 |
| sensitizing dye IV | $7.5 \times 10^{-4}$ |
| sensitizing dye V | $3 \times 10^{-4}$ |
| coupler C-9 | 0.25 |
| coupler C-1 | 0.03 |
| coupler C-10 | 0.015 |
| coupler C-5 | 0.03 |
| dispersion oil Oil-1 | 0.2 |

9th Layer (Third Green-Sensitive Emulsion Layer)

silver iodobromide emulsion (average grain size 0.7μ, ratio of diameter to thickness 7.5)

| | |
|---|---|
| gelatine | 1.0 |
| sensitizing dye IV | $7 \times 10^{-4}$ |
| sensitizing dye V | $2.8 \times 10^{-4}$ |
| coupler C-11 | 0.05 |
| coupler C-12 | 0.01 |
| coupler C-13 | 0.08 |
| coupler C-1 | 0.02 |
| coupler C-15 | 0.02 |
| dispersion oil Oil-1 | 0.10 |
| dispersion oil Oil-2 | 0.05 |

10th Layer (Yellow Filter Layer)

| | |
|---|---|
| gelatine | 1.2 |
| yellow colloidal silver | 0.08 |
| compound Cpd-B | 0.1 |
| dispersion oil Oil-1 | 0.3 |

11th Layer (First Blue-Sensitive Emulsion Layer)

monodisperse silver iodobromide (average grain size 0.3μ, ratio of diameter to thickness 7.0)

| | |
|---|---|
| gelatine | 1.0 |
| sensitizing dye V | $4 \times 10^{-4}$ |
| coupler C-14 | 0.9 |
| coupler C-5 | 0.07 |
| dispersion oil Oil-1 | 0.2 |

12th Layer (Second Blue-Sensitive Emulsion Layer)

silver iodobromide (average grain size 1.5μ, ratio of diameter to thickness 8.0)

| | |
|---|---|
| gelatine | 0.6 |
| sensitizing dye V | $2 \times 10^{-4}$ |
| coupler C-14 | 0.25 |
| dispersion oil Oil-1 | 0.07 |

13th Layer (First Protective Layer)

| | |
|---|---|
| gelatine | 0.8 |
| UV absorbant UV-1 | 0.1 |
| UV absorbant UV-2 | 0.2 |
| dispersion oil Oil-1 | 0.01 |
| dispersion oil Oil-2 | 0.01 |

14th Layer (Second Protective Layer)

| | |
|---|---|
| fine silver bromide grains (average grain size 0.07μ) | 0.5 |
| gelatine | 0.45 |
| polymethylmethacrylate particles (diameter 1.5μ) | 0.2 |
| hardening agent H-1 | 0.4 |
| formaldehyde scavenger S-1 | 0.5 |
| formaldehyde scavenger S-2 | 0.5 |

In addition to the above constituents, a surfactant was used as a coating aid in each layer.

The chemical structures and names of the compounds used in the invention are listed below:

UV-1

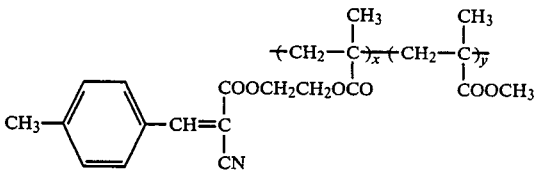

UV-2

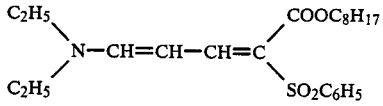

x/y = 7/3 (weight ratio)

Oil-1 tricresylphosphate
Oil-2 dibutyl phthalate
Oil-3 bis(2-ethylhexyl)phthalate

C-1

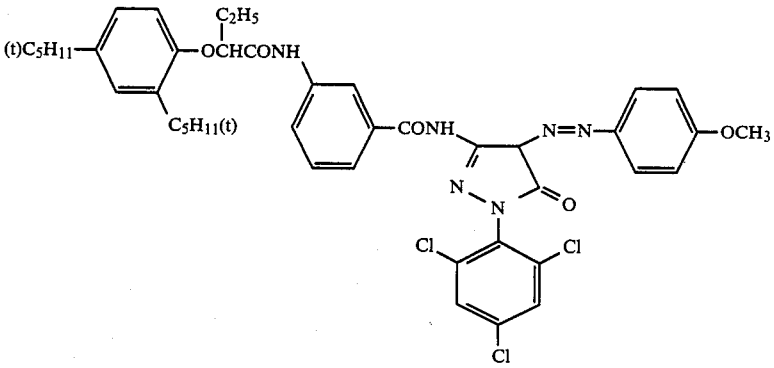

-continued
C-2
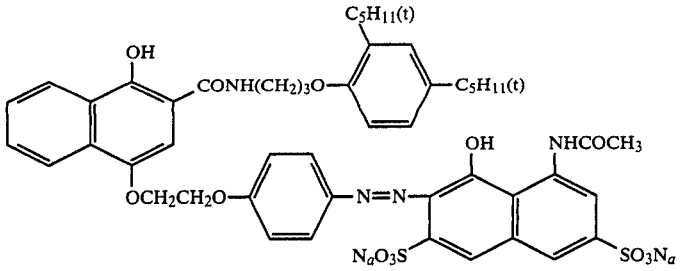
C-3
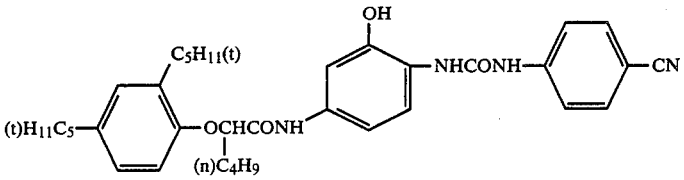
C-4
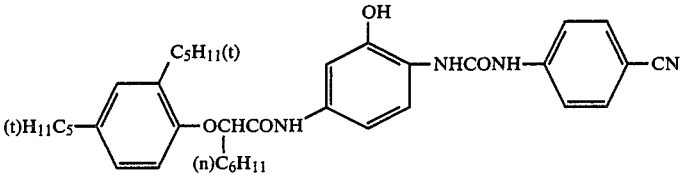
C-5
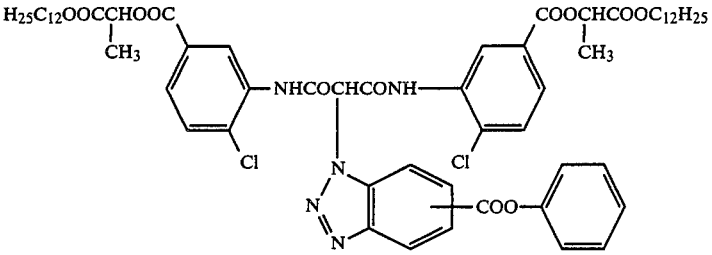
C-6
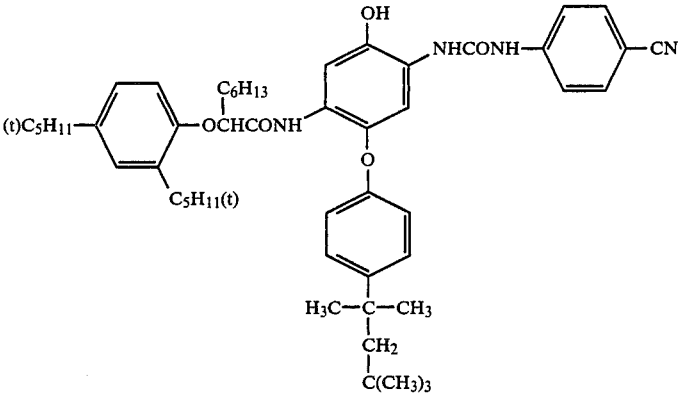
C-7
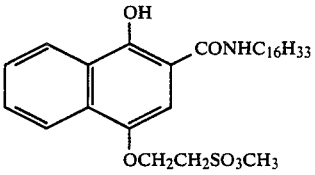

-continued
C-8
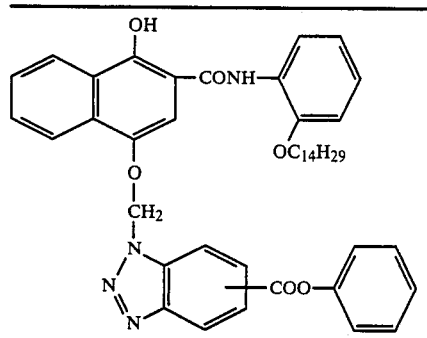
C-10
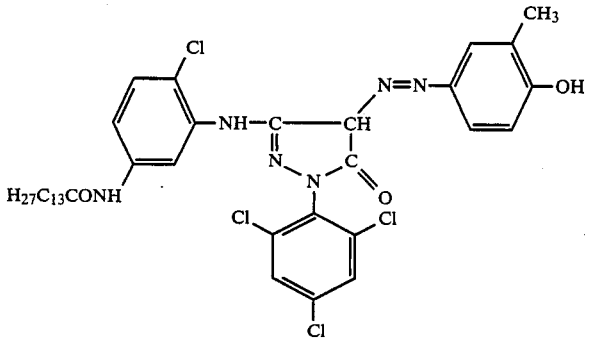
C-11
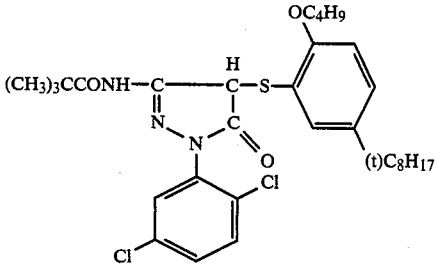
C-12
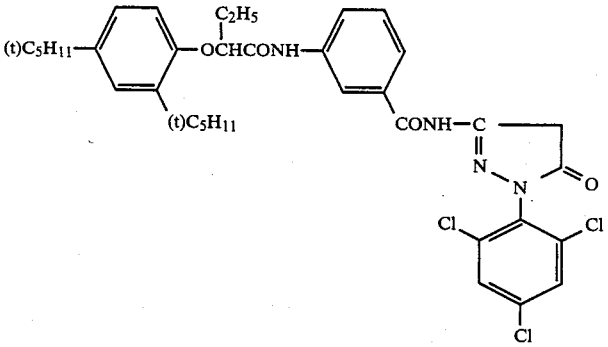
C-13
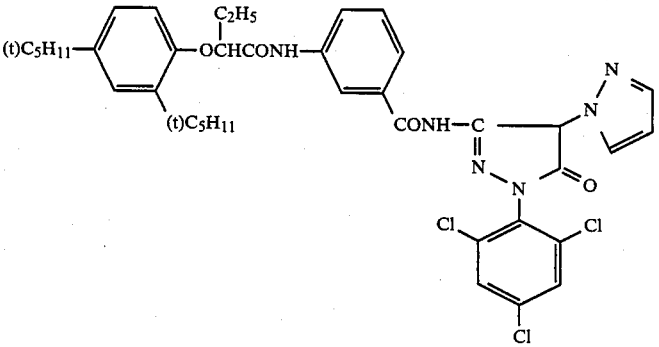

-continued
C-14
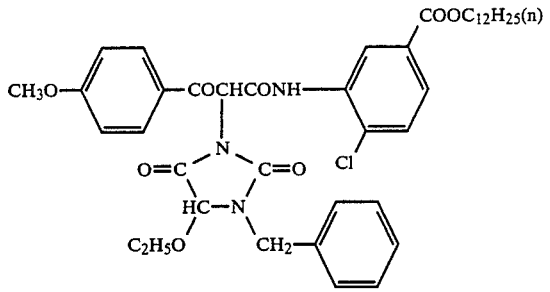
C-15
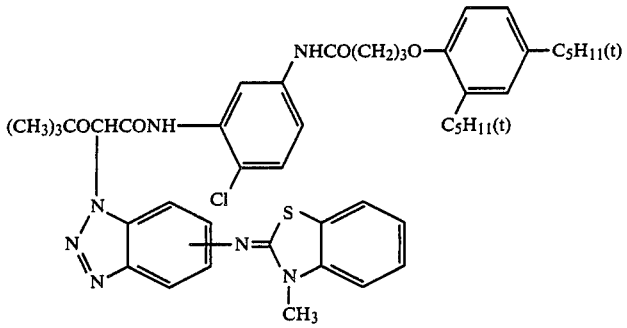
Cpd A
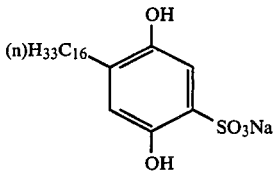
Cpd B
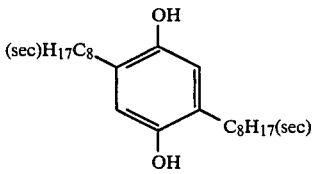
Sensitizing dye I
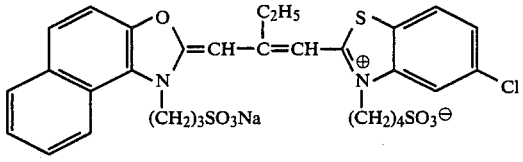
Sensitizing dye II
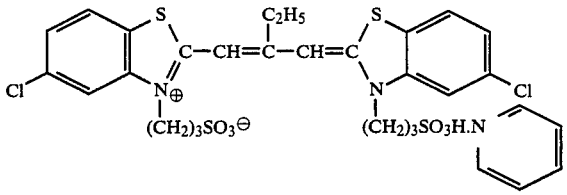
Sensitizing dye III
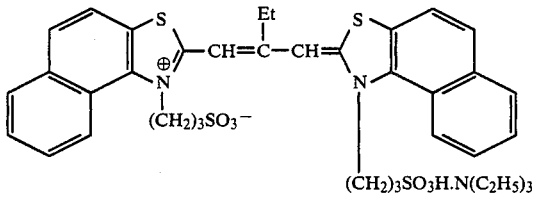

-continued
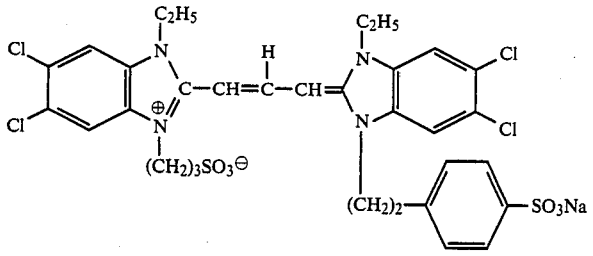
Sensitizing dye IV
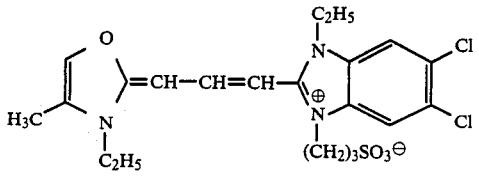
Sensitizing dye V
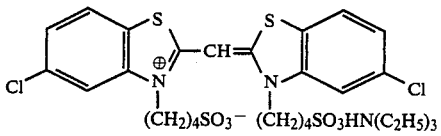
Sensitizing dye VI
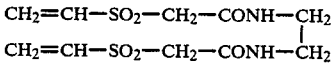
H-1
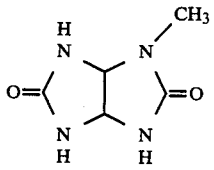
S-1
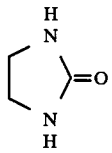
S-2
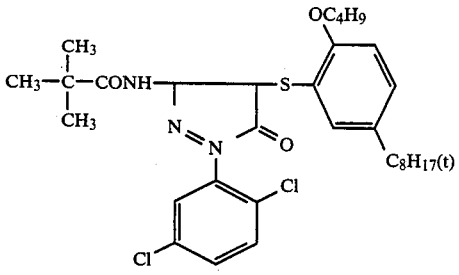
C-16
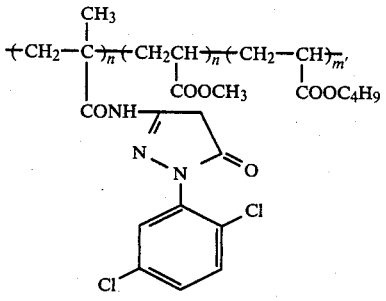
C-17
n/m + m' = 1 (weight ratio)
m/m' = 1
Molecular weight ca. 40,000

-continued

C-9

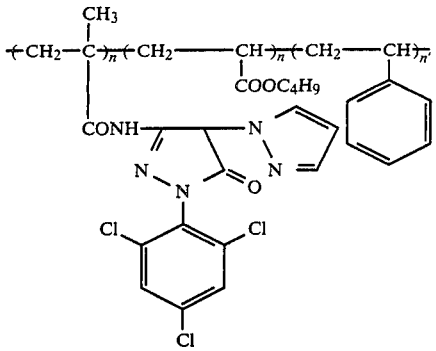

m/n + n' = 1
Molecular weight ca. 15,000

| Layer | Amount of Silver in Layer (g/m$^2$) | Iodide Content (mol %) |
|---|---|---|
| 1 | 0.17 | — |
| 2 | — | — |
| 3 | 0.64 | 2 |
| 4 | 0.59 | 5 |
| 5 | 0.84 | 12 |
| 6 | — | — |
| 7 | 0.25 | 4 |
| 8 | 0.34 | 5 |
| 9 | 0.72 | 5 |
| 10 | 0.07 | — |
| 11 | 0.34 | 3 |
| 12 | 0.62 | 3 |
| 13 | — | — |
| 14 | 0.42 | — |
| | Total Amount of Coated Silver | Average Iodide Content |
| | 4.8 g/m$^2$ | 5.4 mol % |

"An iodide content" used herein means a ratio (mol%) of silver iodide (Ag I) to the whole light-sensitive silver halide.

Samples (ii) to (vii) were prepared in the same manner as in Sample (i) with the following exception.

Sample (ii): C-9 in Sample (i) was replaced with the same mole of C-16.

Sample (iii): C-9 in Sample (i) was replaced with the double mole of C-17.

Sample (iv): The amount of each light-sensitive emulsion was increased by 22%.

Sample (v): The silver iodide content in the emulsion of the 9th layer was increased to 8.4 mol%.

Sample (vi): 0.3 g/m$^2$ of desilvering accelerator BA-1 described herein was added to the 10th layer of Sample (i).

Sample (vii): 0.3 g/m$^2$ of desilvering accelerator BA-2 described herein was added to the 10th layer of Sample (i).

Samples (i)–(vii) thus prepared were exposed to sun light for 5 minutes and subjected to the following treatments A to M. The amount of the remaining silver on each film was determined by X ray fluorometry. The results are shown in Table 1.

Treatments A to M will be explained below.

Treatment A: Standard treatment,

Treatment B: The bleaching time in Treatment A, 6 min. 30 sec., was shortened to 3 min.

Treatment C: 3 g/l of bleaching accelerator BA-1 described herein were added to the treatment solution of Treatment B.

Treatment D: 3 g/l of bleaching accelerator BA-2 described herein were added to the treatment solution of Treatment B.

Treatment E: Bleach-fixing treatment.

Treatment F: 3 g/l of bleaching accelerator BA-1 described herein were added to the bleach-fixing treatment solution of Treatment E.

Treatment G: 3 g/l of bleaching accelerator BA-2 described herein were added to the bleach-fixing treatment solution of Treatment E.

Treatment H: The pH of the bleaching solution of Treatment B was lowered to 5.5.

Treatment I: 3 g/l of bleaching accelerator BA-1 described herein were added to the bleaching solution of Treatment H.

Treatment J: 3 g/l of bleaching accelerator BA-2 described herein were added to the bleaching solution of Treatment H.

Treatment K: Treatment A followed by the bleach-fixing step.

Treatment L: 3 g/l of bleaching accelerator BA-1 described herein were added to the bleaching solution of Treatment K.

Treatment M: 3 g/l of bleaching accelerator BA-2 described herein were added to the bleaching solution of Treatment K.

The conditions will be explained below:

Treatments A and B

| | Treatment A | Treatment B | Temp. |
|---|---|---|---|
| Color development | 3 min. 15 sec. | 3 min. 15 sec. | 38° C. |
| Bleaching | 6 min. 30 sec. | 3 min. 00 sec. | 38° C. |
| Fixing | 4 min. 20 sec. | 4 min. 20 sec. | 38° C. |
| Water washing | 3 min. 15 sec. | 3 min. 15 sec. | 38° C. |
| Stabilization | 1 min. 05 sec. | 1 min. 05 sec. | 38° C. |

The composition of the treatment solution used in each step is as follows:

Color Developing Solution

| | |
|---|---|
| diethylene triamine pentaacetatic acid | 1.0 g |
| 1-hydroxyethylidene-1,1-diphosphonic acid | 2.0 g |
| sodium sulfite | 4.0 g |
| potassium carbonate | 30.0 g |
| potassium bromide | 1.4 g |
| potassium iodide | 1.3 mg |
| hydroxylamine sulfate | 2.4 g |
| 4-(N—ethyl-N—β-hydroxyethyl-amino)-2-methyl aniline sulfate | 4.5 g |
| water | to 1.0 l |
| pH | 10.0 |

Bleaching Solution

| | |
|---|---|
| ferric ammonium ethylenediamine tetraacetate | 100.0 g |
| disodium ethylendiamine-tetraacetate | 10.0 g |
| ammonium bromide | 150.0 g |
| ammonium nitrate | 10.0 g |
| aqueous ammonium (28%) | 7.0 ml |
| water | to 1.0 l |
| pH | 6.0 |

Fixing Solution

| | |
|---|---|
| disodium ethylenediamine-tetraacetate | 1.0 g |
| sodium sulfite | 4.0 g |
| aqueous solution of ammonium thiosulfate (70%) | 175.0 ml |
| sodium hydrogen sulfite | 4.6 g |
| water | to 1.0 l |
| pH | 6.6 |

Stabilization Solution

| | |
|---|---|
| formalin (40%) | 2.0 ml |
| polyoxyethylene-p-monononylphenyl ether (average degree of polymerization approximately 10) | 0.3 g |
| water | to 1.0 l |

Treatment E

| | | |
|---|---|---|
| color development | 3 min. 15 sec. | 38° C. |
| bleach-fixing | 6 min. 00 sec. | 38° C. |
| rinsing | 1 min. 40 sec. | 38° C. |
| stabilization | 40 sec. | 38° C. |

Color Developing Solution

| | |
|---|---|
| diethylene triamine pentaacetatic acid | 1.0 g |
| 1-hydroxyethylidene-1,1-diphosphonic acid | 2.0 g |
| sodium sulfite | 4.0 g |
| potassium carbonate | 30.0 g |
| potassium bromide | 1.4 g |
| potassium iodide | 1.3 mg |

-continued

| | |
|---|---|
| hydroxylamine sulfate | 2.4 g |
| 4-(N—ethyl-N—β-hydroxyethyl-amino)-2-methyl aniline sulfate | 4.5 g |
| water | to 1.0 l |
| pH | 10.0 |

Bleach-fixing Solution

| | |
|---|---|
| ferric ammonium ethylenediamine-tetraacetate | 80.0 g |
| disodium ethylenediamine-tetraacetate | 10.0 g |
| bleaching accelerator | 1.5 g |
| sodium sulfite | 12.0 g |
| aqueous solution of ammonium thio sulfate (70%) | 240 ml |
| water | to 1 l |
| pH (adjusted with aqueous ammonium) | 6.8 |

Ringing Water

| | |
|---|---|
| disodium ethylenediamine-tetraacetate | 0.4 g |
| water | to 1 l |
| pH (adjusted with sodium hydroxide) | 7.0 |

Stabilization Solution

| | |
|---|---|
| formalin (37% w/v) | 2.0 ml |
| polyoxyethylene-p-monononylphenyl ether (average degree of polymerization approximately 10) | 0.3 g |
| water | to 1.0 l |

Treatment H

| | | |
|---|---|---|
| Color development | 3 min. 15 sec. | 38° C. |
| Bleaching | 2 min. 00 sec. | 38° C. |
| Fixing | 4 min. 20 sec. | 38° C. |
| Water washing | 3 min. 15 sec. | 38° C. |
| Stabilization | 1 min. 05 sec. | 38° C. |

The composition of the treatment solution used in each step is as follows:

Color Developing Solution

| | |
|---|---|
| diethylene triamine pentaacetatic acid | 1.0 g |
| 1-hydroxyethylidene-1,1-diphosphonic acid | 2.0 g |
| sodium sulfite | 4.0 g |
| potassium carbonate | 30.0 g |
| potassium bromide | 1.4 g |
| potassium iodide | 1.3 mg |
| hydroxylamine sulfate | 2.4 g |
| 4-(N—ethyl-N—β-hydroxyethyl-amino)-2-methyl aniline sulfate | 4.5 g |
| water | to 1.0 l |
| pH | 10.0 |

Bleaching Solution

| | |
|---|---|
| ferric ammonium ethylenediamine tetraacetate | 100.0 g |
| disodium ethylendiamine-tetraacetate | 10.0 g |
| ammonium bromide | 150.0 g |
| ammonium nitrate | 10.0 g |
| aqueous ammonium (28%) | 3.0 ml |
| water | to 1.0 l |
| pH | 5.5 |

Fixing Solution

| | |
|---|---|
| disodium ethylenediamine-tetraacetate | 1.0 g |
| sodium sulfite | 4.0 g |
| aqueous solution of ammonium thiosulfate (70%) | 175.0 ml |
| sodium hydrogen sulfite | 4.6 g |
| water | to 1.0 l |
| pH | 6.6 |

Stabilization Solution

| | |
|---|---|
| formalin (40%) | 2.0 ml |
| polyoxyethylene-p-monononylphenyl ether (average degree of polymerization approximately 10) | 0.3 g |
| water | to 1.0 l |

Treatment H

| | | |
|---|---|---|
| Color development | 3 min. 15 sec. | 38° C. |
| Bleaching | 30 sec. | 38° C. |
| Bleach-fixing | 1 min. 30 sec. | 38° C. |
| Rinsing | 1 min. 40 sec. | 38° C. |
| Stabilization | 40 sec. | 38° C. |

The composition of the treatment solution used in each step is as follows:

Color Developing Solution

| | |
|---|---|
| diethylene triamine pentaacetatic acid | 1.0 g |
| 1-hydroxyethylidene-1,1-diphosphonic acid | 2.0 g |
| sodium sulfite | 4.0 g |
| potassium carbonate | 30.0 g |
| potassium bromide | 1.4 g |
| potassium iodide | 1.3 mg |
| hydroxylamine sulfate | 2.4 g |
| 4-(N—ethyl-N—β-hydroxyethyl-amino)-2-methyl aniline sulfate | 4.5 g |
| water | to 1.0 l |
| pH | 10.0 |

Bleaching Solution

| | |
|---|---|
| ammonium bromide | 100.0 g |
| ferric ammonium ethylenediamine tetraacetate | 120.0 g |
| disodium ethylendiamine-tetraacetate | 10.0 g |
| ammonium nitrate | 10.0 g |
| bleaching accelerator | 2.0 g |

-continued

| | |
|---|---|
| aqueous ammonium | 17.0 ml |
| water | to 1 l |
| pH | 6.5 |

Bleach-fixing Solution

| | |
|---|---|
| ammonium bromide | 50.0 g |
| ferric ammonium ethylenediamine-tetraacetate | 50.0 g |
| disodium ethylenediamine-tetraacetate | 5.0 g |
| ammonium nitrate | 5.0 g |
| sodium sulfite | 12.0 g |
| aqueous solution of ammonium thiosulfate (70%) | 240.0 ml |
| aqueous ammonium | 10.0 ml |
| water | to 1.0 l |
| pH | 7.3 |

Rinsing Solution

| | |
|---|---|
| disodium ethylenediamine-tetraacetate | 0.4 g |
| water | to 1 l |
| pH (adjusted with sodium hydroxide) | 7.0 |

Stabilization Solution

| | |
|---|---|
| formalin (40%) | 2.0 ml |
| polyoxyethylene-p-monononylphenyl ether (average degree of polymerization approximately 10) | 0.3 g |
| water | to 1.0 l |

TABLE 1

| | Sample | | | | | | |
|---|---|---|---|---|---|---|---|
| Treatment | (i) | (ii) | (iii) | (iv) | (v) | (vi) | (vii) |
| A | ◎(1) | — | — | — | — | — | — |
| B | x | x | x | x | x | ○ | ◎ |
| C | ○ | x | x | x | x | ◎ | ◎ |
| D | ◎ | Δ | Δ | Δ | x | ◎ | ◎ |
| E | ○ | x | x | x | x | ◎ | ◎ |
| F | ◎ | Δ | Δ | Δ | x | ◎ | ◎ |
| G | ◎ | Δ | Δ | Δ | Δ | ◎ | ◎ |
| H | ○ | x | x | x | x | ◎ | ◎ |
| I | ◎ | Δ | Δ | Δ | x | ◎ | ◎ |
| J | ◎ | Δ | Δ | Δ | Δ | ◎ | ◎ |
| K | ○ | Δ | Δ | Δ | Δ | ◎ | ◎ |
| L | ◎ | Δ | Δ | Δ | Δ | ◎ | ◎ |
| M | ◎ | Δ | Δ | Δ | Δ | ◎ | ◎ |

◎: Amount of the remaining silver of 2 $\mu g/m^2$ or less.
○: 3 to 5 $\mu g/m^2$.
Δ: 6 to 15 $\mu g/m^2$.
x: 15 μg or more.
(1): The treatment time was long.

Table 1 clearly shows:

(1) Comparing Treatments B to M, where the bleaching step was shortened, with Treatment A, Samples (ii), (iii), (iv) and (v) which are not according to the invention showed the insufficient desilvering.

(2) Samples (vi) and (vii) which light-sensitive materials contained the bleaching accelerator showed the excellent desilvering in Treatments B to M.

(3) Sample (i) according to the invention showed the excellent desilvering in Treatments C to M.

The effects of the present invention are clearly understood from the above results.

EXAMPLE 2

Running operations were conducted with light-sensitive materials (i) to (vii) using the small amounts of replenishers as described below.

These color photographic materials were cut to 35 mm width, used for taking outdoor photographs of a standard subject and subsequently treated by an autodeveloping machine as follows. That is, using the autodeveloping machine with the tank volumes as shown in Table 2, the exposed color photographic materials prepared as described above (35 mm in width) were continuously treated for 20 days by 50 m per day. After the 20 days continuous treatment, the aforesaid color photographic materials which had been subjected to 20 CMS wedge exposure using a tungsten light source adjusted by a filter at a color temperature of 4800° K. were treated, which were used as test pieces.

The samples according to the invention did not show any unfavorable results. In contrast, Samples (ii), (iii), (iv) and (v), which are not according to the invention, showed uneven color due to insufficient desilvering.

TABLE 2

| Step | Treatment steps (at 38° C.) Treatment Time | Tank Volumes | Amount* of Replenisher |
|---|---|---|---|
| Color developing | 3 min. 15 sec. | 18 l | 19 ml |
| Bleaching | 2 min. 00 sec. | 18 l | 18 ml |
| Water washing | 2 min. 00 sec. | 18 l | 1200 ml |
| Fixing | 3 min. 15 sec. | 18 l | 33 ml |
| Water washing (1) | 1 min. 30 sec. | 9 l | — |
| Water washing (2) | 1 min. 30 sec. | 9 l | 1200 ml |
| Stabilization | 1 min. 05 sec. | 9 l | 33 ml |

*per meter in length of the photographic materials with 35 mm width

Water washing steps (1) and (2) in the above treatment were conducted in 9 counterflow manner from (2) to (1). The following are the compositions of the treatment solutions.

Color Developing Solution

The compsitions of the mother liquor and the replenisher are as follows.

| | Mother Liquor | Replenisher |
|---|---|---|
| diethylene triamine pentaacetic acid | 0.8 g | 0.8 g |
| 1-hydroxyethylidene-1,1-diphosphonic acid | 3.3 g | 3.3 g |
| sodium sulfite | 4.0 g | 4.5 g |
| potassium carbonate | 30.0 g | 39.0 g |
| potassium bromide | 1.4 g | 0.3 g |
| potassium iodide | 1.3 g | 0 |
| hydroxylamine sulfate | 2.4 g | 3.0 g |
| 4-(N—ethyl-N—β-hydroxyethyl-amino)-2-methyl aniline sulfate | 4.5 g | 6.4 g |
| water | 1.0 l | 1.0 l |
| pH | 10.0 | 10.15 |

pH was adjusted with potassium hydroxide or sulfuric acid.

Bleaching Solution

| | Mother Liquor (g) | Replenisher (g) |
|---|---|---|
| ferric ammonium ethylenediamine tetraacetate | 100 | 110 |
| disodium ethylendiamine-tetraacetate | 10 | 11 |
| aqueous ammonium | 3 ml | 2 ml |
| ammonium nitrate | 10.0 g | 12.0 g |
| ammonium bromide | 150 | 170 |
| water | to 1 l | to 1 l |
| pH | 6.0 | 5.8 |

Fixing Solution

| | Mother Liquor (g) | Replenisher (g) |
|---|---|---|
| disodium ethylenediamine-tetraacetate | 1.0 g | 1.2 g |
| sodium sulfite | 4.0 | 5.0 |
| aqueous solution of ammonium thiosulfate (70%) | 175.0 ml | 200.0 ml |
| sodium hydrogen sulfite | 4.6 | 5.8 |
| water | to 1.0 l | 1 l |
| pH | 6.6 | 6.6 |

Stabilization Solution

| | Mother Liquid | Replenisher |
|---|---|---|
| formalin (40%) | 2.0 ml | 3.0 ml |
| polyoxyethylene-p-mononononylphenyl ether (average degree of polymerization approximately 10) | 0.3 g | 0.45 g |
| water | to 1.0 l | |

EXAMPLE 3

A multilayered color photographic light-sensitive material consisting of layers which have the following compositions were prepared on a substrate of cellulose triacetate film which had been undercoated.

Composition of the Light-Sensitive Layer

The coated amounts of silver halide and colloidal silver are expressed in gram of silver per $m^2$, the coated amounts of couplers, additives and gelatine are expressed in $g/m^2$, and the amount of sensitizing dyes are expressed in mole per mole of silver halide in the same layer.

1st Layer (Antihalation Layer)

| | |
|---|---|
| black colloidal silver | 1.3 |
| gelatine | |
| colored coupler C-1 | 0.06 |
| UV absorbant UV-1 | 0.1 |
| UV absorbant UV-2 | 0.2 |
| dispersion oil Oil-1 | 0.01 |
| dispersion oil Oil-2 | 0.01 |

2nd Layer (Intermediate Layer)

| | |
|---|---|
| gelatine | 1.0 |
| colored coupler C-2 | 0.02 |

-continued

| | |
|---|---|
| dispersion oil Oil-1 | 0.1 |

3rd Layer (First Red-Sensitive Emulsion Layer)
silver iodobromide emulsion (average grain size 0.3μ)

| | |
|---|---|
| gelatine | 0.6 |
| sensitizing dye I | $1.0 \times 10^{-4}$ |
| sensitizing dye II | $3.0 \times 10^{-4}$ |
| sensitizing dye III | $1 \times 10^{-5}$ |
| coupler C-3 | 0.06 |
| coupler C-4 | 0.06 |
| coupler C-8 | 0.04 |
| coupler C-2 | 0.03 |
| dispersion oil Oil-1 | 0.03 |
| dispersion oil Oil-2 | 0.012 |

4th Layer (Second Red-Sensitive Emulsion Layer)
silver iodobromide emulsion (average grain size 0.5μ)

| | |
|---|---|
| sensitizing dye I | $1 \times 10^{-4}$ |
| sensitizing dye II | $3 \times 10^{-4}$ |
| sensitizing dye III | $1 \times 10^{-5}$ |
| coupler C-3 | 0.24 |
| coupler C-4 | 0.24 |
| coupler C-8 | 0.04 |
| coupler C-2 | 0.04 |
| dispersion oil Oil-1 | 0.05 |
| dispersion oil Oil-3 | 0.10 |

5th Layer (Third Red-Sensitive Emulsion Layer)
silver iodobromide emulsion (average grain size 0.7μ)

| | |
|---|---|
| gelatine | 1.0 |
| sensitizing dye I | $1 \times 10^{-4}$ |
| sensitizing dye II | $3 \times 10^{-4}$ |
| sensitizing dye III | $1 \times 10^{-5}$ |
| coupler C-6 | 0.05 |
| coupler C-7 | 0.1 |
| coupler C-2 | 0.03 |
| dispersion oil Oil-1 | 0.01 |
| dispersion oil Oil-2 | 0.05 |

6th Layer (Intermediate Layer)

| | |
|---|---|
| gelatine | 1.0 |
| compound Cpd-A | 0.03 |
| dispersion oil Oil-1 | 0.05 |
| dispersion oil Oil-2 | 0.05 |

7th Layer (First Green-Sensitive Emulsion Layer)
silver iodobromide emulsion (average grain size 0.3μ)

| | |
|---|---|
| sensitizing dye VI | $5 \times 10^{-4}$ |
| sensitizing dye V | $2 \times 10^{-4}$ |
| gelatine | 1.0 |
| magenta coupler (see Table 3) | 0.2 |
| coupler C-5 | 0.03 |
| coupler C-1 | 0.03 |
| dispersion oil Oil-1 | 0.5 |

8th Layer (Second Green-Sensitive Emulsion Layer)
silver iodobromide emulsion (average grain size 0.5μ)

| | |
|---|---|
| sensitizing dye IV | $5 \times 10^{-4}$ |
| sensitizing dye V | $2 \times 10^{-4}$ |
| coupler C-M (see Table 3) | 0.25 |
| coupler C-1 | 0.03 |
| coupler C-10 | 0.015 |
| coupler C-5 | 0.03 |
| dispersion oil Oil-1 | 0.2 |

9th Layer (Third Green-Sensitive Emulsion Layer)
silver iodobromide emulsion (average grain size 0.7μ)

| | |
|---|---|
| gelatine | 1.0 |
| sensitizing dye IV | $3.5 \times 10^{-4}$ |
| sensitizing dye V | $1.4 \times 10^{-4}$ |
| coupler C-11 | 0.05 |
| coupler C-12 | 0.01 |
| coupler C-13 | 0.08 |
| coupler C-1 | 0.02 |
| coupler C-15 | 0.02 |
| dispersion oil Oil-1 | 0.10 |
| dispersion oil Oil-2 | 0.05 |

10th Layer (Yellow Filter Layer)

| | |
|---|---|
| gelatine | 1.2 |
| yellow colloidal silver | 0.08 |
| compound Cpd-B | 0.1 |
| dispersion oil Oil-1 | 0.3 |

11th Layer (First Blue-Sensitive Emulsion Layer)
monodisperse silver iodobromide (average grain size 0.3μ)

| | |
|---|---|
| gelatine | 1.0 |
| sensitizing dye V | $2 \times 10^{-4}$ |
| coupler C-14 | 0.9 |
| coupler C-5 | 0.07 |
| dispersion oil Oil-1 | 0.2 |

12th Layer (Second Blue-Sensitive Emulsion Layer)
silver iodobromide (average grain size 1.5μ)

| | |
|---|---|
| gelatine | 0.6 |
| sensitizing dye V | $1 \times 10^{-4}$ |
| coupler C-14 | 0.25 |
| dispersion oil Oil-1 | 0.07 |

13th Layer (First Protective Layer)

| | |
|---|---|
| gelatine | 0.8 |
| UV absorbant UV-1 | 0.1 |
| UV absorbant UV-2 | 0.2 |
| dispersion oil Oil-1 | 0.01 |
| dispersion oil Oil-2 | 0.01 |

14th Layer (Second Protective Layer)

| | |
|---|---|
| fine silver bromide grains (average grain size 0.07μ) | 0.5 |
| gelatine | 0.45 |
| polymethylmethacrylate particles (diameter 1.5μ) | 0.2 |
| hardening agent H-1 | 0.4 |
| formaldehyde scavenger S-1 | 0.5 |
| formaldehyde scavenger S-2 | 0.5 |

In addition to the above constituents, a surfactant was used as a coating aid in each layer. In the samples prepared as described above, the amount of coated silver in each sample, the mole content of iodide in the whole emulsion grains and the type of the magenta coupler were varied as shown in Table 3. These samples were designated Samples 101 to 114.

This photographic element was subjected to wedge exposure of 25 CMS adjusted at a color temperature of 4800° K. by a filter. Then, developmemnt was conducted at 38° C. according to the following steps:

| | |
|---|---|
| color development | 3 min. |
| bleach-fixing | 1 to 15 min. |
| rinsing | 2 min. |
| drying | 2 min. |

The compositions of the processing liquids used in the above steps will be shown below.

Color Developing Solution

| | |
|---|---|
| diethylene triamine pentaacetatic acid | 1.0 g |
| 1-hydroxyethylidene-1,1-diphosphonic acid | 2.0 g |
| sodium sulfite | 4.0 g |
| potassium carbonate | 30.0 g |
| potassium bromide | 1.4 g |
| potassium iodide | 1.3 mg |
| hydroxylamine sulfate | 2.4 g |
| 4-(N—ethyl-N—β-hydroxyethyl-amino)-2-methyl aniline sulfate | 4.5 g |
| water | to 1.0 l |
| pH | 10.0 |

Bleach-Fixing Soltuon

| | |
|---|---|
| ferric ammonium ethylenediamine tetraacetate | 100.0 g |
| disodium ethylendiamine-tetraacetate $2H_2O$ | 5.0 g |
| sodium sulfite | 10.0 g |
| aqueous solution of ammonium thiosulfate (70%) | 220.0 ml |
| water | to 1.0 l |
| pH | 6.9 |

Rinsing Solution

| | |
|---|---|
| water | 1.0 l |
| disodium ethylenediamine-tetraacetate | 0.2 g |
| sulfanylaminde | 0.2 g |

For each sample subjected to the above development process, the amount of the remaining silver in parts of the maximum density of the sample was determined by X ray fluorometry to examine desilvering property. Time required for completion of the bleach-fixing (time at completion of desilvering) for each sample is shown in Table 1.

In Sample 101, the silver amount in each layer and the iodide content of the light-sensitive silver halide grains are as follows:

| Layer | Silver Amount in Layer ($g/m^2$) | Iodide Content (mol %) |
|---|---|---|
| 1 | 0.17 | — |
| 2 | — | — |
| 3 | 0.34 | 2 |
| 4 | 0.59 | 5 |
| 5 | 0.84 | 6 |
| 6 | — | — |
| 7 | 0.25 | 4 |
| 8 | 0.34 | 5 |
| 9 | 0.72 | 5 |
| 10 | 0.07 | — |
| 11 | 0.34 | 4 |
| 12 | 0.42 | 7 |
| 13 | — | — |
| 14 | 0.42 | — |
| | Total Amount of Coated Silver | Average Iodide Content |
| | 4.5 $g/m^2$ | 5.0 mol % |

When the amount of coated silver of the average iodide content is increased or decreased in other samples, the silver amount in each layer or the iodide content in the light-sensitive silver halde was set so as to be proportional to those values in each layer of Sample 101, respectively.

TABLE 3

| | Sample No. | Total Amount of Coated Silver ($g/m^2$) | Average Iodide Content (mol %) | Magenta Dye-Forming Coupler | Desilvering Completion Time |
|---|---|---|---|---|---|
| Comparison Example | 101 | 4.5 | 5.0 | Comparison Compound 1 | more than 15 min. |
| Comparison Example | 102 | " | " | Comparison Compound 2 | more than 15 min. |
| Comparison Example | 103 | 5.5 | " | Compound MP-5 | more than 15 min. |
| Comparison Example | 104 | 4.5 | 6.0 | Compound MP-5 | more than 15 min. |
| Comparison Example | 105 | 5.5 | " | Compound MP-5 | more than 15 min. |
| Invention | 106 | 4.5 | 5.0 | Compound MP-5 | 3 min. 30 sec. |
| Invention | 107 | " | " | Compound MP-1 | 4 min. |
| Invention | 108 | " | " | Compound MP-6 | 4 min. |
| Invention | 109 | " | " | Compound MP-9 | 4 min. 30 sec. |
| Invention | 110 | " | " | Compound MP-15 | 4 min. |
| Invention | 111 | " | " | Compound MP-18 | 4 min. 30 sec. |
| Invention | 112 | " | " | Compound MP-19 | 4 min. 20 sec. |
| Invention | 113 | " | " | Compound MP-29 | 4 min. 10 sec. |

TABLE 3-continued

| | Sample No. | Total Amount of Coated Silver ($g/m^2$) | Average Iodide Content (mol %) | Magenta Dye-Forming Coupler | Desilvering Completion Time |
|---|---|---|---|---|---|
| Invention | 114 | " | " | Compound MP-43 | 4 min. 40 sec. |

Comparison Compound 1

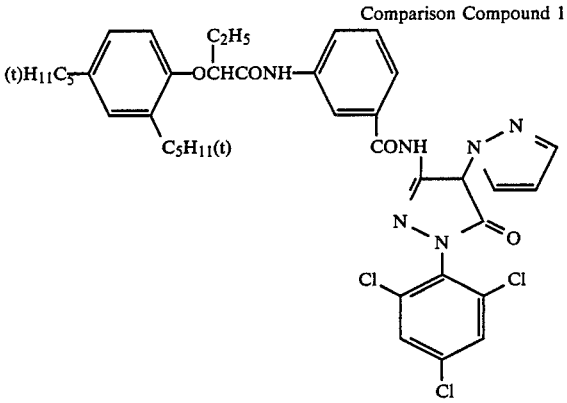

Comparison Compound 2

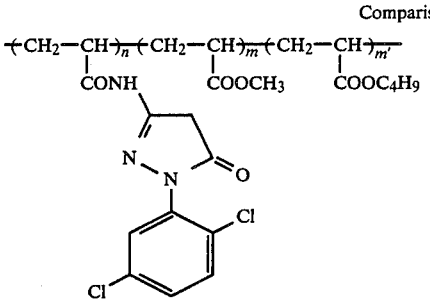

n/m + m' = 1
m/m' = 1 (weight ratio)
Molecular weight about 40,000

As seen from Table 3, even if the total amount of the coated silver and the average iodide content fall within the range according to the invention, the time required for completion of desilvering is very long, which leads to insufficient desilvering in practice in the event that a magenta dye-forming coupler is the 2-equivalent magenta coupler (Sample 101) or the 4-equivalent magenta polymer coupler (Sample 102). Further, even if the 2-equivalent magenta polymer coupler according to the invention is used, desilvering is insufficient in the event that the total amount of the coated silver or the average iodide content are out of the range of the present invention (Samples 103 to 105).

That is, only when the total amount of the coated silver is 5.2 $g/m^2$ or less, the average iodide content is 5.5 mol% or less, and the 2-equivalent magenta polymer coupler is used as a magenta dye-forming coupler, the desilvering in a single bath bleach-fixing solution is remarkably accelerated and is completed in a very short time.

EXAMPLE 4

The procedure of Example 3 was repeated with the exception that exemplary compound MP-5 according to the invention was used as magenta coupler and the total silver amount in each sample and the average iodide content were varied as shown in Table 4. The obtained samples were designated Sample 201 to 212.

These samples were treated in the very same way as in Example 3 and the times required for completion of desilvering were determined. The results are shown in Table 4.

TABLE 4

| | Sample No. | Total Amount of Coated Silver ($g/m^2$) | Average Iodide Content (mol %) | Desilvering Completion Time |
|---|---|---|---|---|
| Comparison Example | 201 | 8.0 | 5.0 | more than 15 min. |
| Comparison Example | 202 | 6.0 | " | more than 15 min. |
| Comparison Example | 203 | 5.5 | " | more than 15 min. |
| Invention | 204 | 5.2 | " | 5 min. |
| Invention | 205 | 5.0 | " | 3 min. 30 sec. |
| Invention | 206 | 4.5 | " | 3 min. |
| Comparison Example | 207 | " | 8.0 | more than 15 min. |
| Comparison Example | 208 | " | 7.0 | more than 15 min. |
| Comparison Example | 209 | " | 6.0 | more than 15 min. |
| Invention | 210 | " | 5.5 | 4 min. |
| Invention | 211 | " | 5.0 | 3 min. 30 sec. |
| Invention | 212 | " | 4.5 | 3 min. 30 sec. |

As seen from Table 4, only in the cases where both the total amount of the coated silver and the average iodide content fall within the range according to the invention, the desilvering is remarkably accelerated. Particularly, the desilvering speed is higher in the samples having the total amount of the coated silver of 5.0 $g/m^2$ or less (Samples 205, 206, 210, 211 and 212).

EXAMPLE 5

The procedure of Example 1 was repeated with the exception that the total amount of coated silver and the average iodide content were set to 4.5 $g/m^2$ and 5.0 mol%, respectively, and exemplary compound MP-5 according to the invention was used in various amounts as magenta coupler. The obtained samples were designated Samples 301 to 305. When the amount of compound MP-5 was decreased, coupler C-13 (2-equivalent magenta non-polymeric coupler) of the subtracted amount by weight was added instead.

These samples were treated in the very same way as in Example 1 and the times required for completion of desilvering were determined. The results are summarized in Table 5.

TABLE 5

| | Sample No. | Content of Compound MP-5 | Desilvering Completion Time |
|---|---|---|---|
| Invention | 301 | 85 wt. % | 3 min. 30 sec. |
| Invention | 302 | 70 | 3 min. 30 sec. |
| Invention | 303 | 50 | 6 min. |
| Invention | 304 | 30 | 6 min. |
| Invention | 305 | 20 | 10 min. |

Table 5 clearly shows that, when the content of the 2-equivalent magenta polymer coupler becomes 30% by weight or higher, the desilvering speed is accelerated; and particularly when the content is 70% by weight or higher, the desilvering is very rapid.

EXAMPLE 6

The procedure of Example 3 was repeated with the exception that the same amount of ferric ammonium diethylenetriaminepentaacetate was used in the bleach-fixing solution instead of ferric ammonium ethylenediaminetetraacetate. The same effect as in Example 3 was attained using ferric ammonium diethylenetriaminepentaacetate. Particularly, in the event that a pH of the bleach-fix solution was high (pH 8.0), a shorter desilvering completion time was attained compared to the case of ferric ammonium ethylenediaminetetraacetate, which is more favorable for practical use.

What we claim is:

1. A method of processing silver halide color photographic light-sensitive material used for taking photographs, wherein the silver halide color photographic light-sensitive material used for taking photographs has at least one red-sensitive silver halide emulsion layer, at least one green-sensitive silver halide emulsion layer and at least one blue-sensitive silver halide emulsion layer on a substrate in which the total amount of coated silver is 5.2 g/m$^2$ or less, the average iodide content based on the total amount of light-sensitive silver halide grains is 5.5 mol% or less, and a 2-equivalent magenta polymer coupler is included as a magenta coupler, said method comprising subjecting the material to one of bleach-fixing treatment, bleaching treatment at a pH of 5.5 or less, or desilvering treatment in the presence of a desilvering accelerator represented by general formula XI or XII:

[XI]

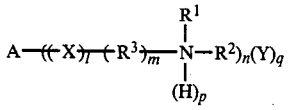

wherein A represents a n-valent aliphatic, aromatic or heterocyclic linking group provided that, if n equals 1, A is merely an aliphatic, aromatic or heterocyclic group or a hydrogen atom, X represents —O—, —S— or

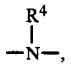

wherein $R^4$ represents a lower alkyl group, $R^1$ and $R^2$ represent a substituted or unsubstituted lower alkyl group, $R^3$ represents a lower alkylene group having 1 to 5 carbon atoms, Y represents an anion, l is zero or 1; m, zero or 1; n, 1, 2 or 3; p, zero or 1; and l, zero, 1, 2, or 3,

[XII]

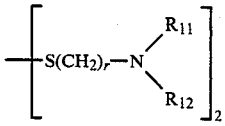

wherein $R_{11}$ and $R_{12}$ may be the same or different and represent a hydrogen atom, a substituted or unsubstituted lower alkyl group, and r is an integer of 1 to 3 provided that $R_{11}$ and $R_{12}$ is not a hydrogen atom at the same time.

2. The method according to claim 1, wherein the 2-equivalent magenta coupler is represented by the following formula I:

[I]

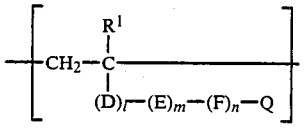

wherein $R^1$ represents a hydrogen atom, an alkyl group having 1 to 4 carbon atoms, or a chlorine atom, D represents —COO—, —CONR$^2$—, or a substituted or unsubstituted phenylene group, E represents a substituted or unsubstituted alkylene, phenylene or aralkylene group, and F represents —CONR$^2$—, —NR$^2$CONR$^2$—, —NR$^2$COO—, —NR$^2$CO—, —OCONR$^2$—, —NR$^2$—, —COO—, —OCO—, —CO—, —O—, —SO$_2$—, —NR$^2$SO$_2$— or —SO$_2$NR$^2$—, $R^2$ represents a hydrogen atom, a substituted or unsubstituted aliphatic hydrocarbon or aryl group, each of l, m and n is zero or 1, Q is a pyrazolone type magenta coupler residue represented by the following general formula III or a pyrazoloazol type magenta coupler residue represented by the following general formula IV:

[III]

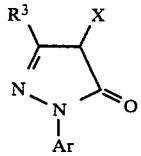

[IV]

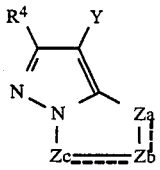

wherein Ar is an alkyl or aryl group, $R^3$ is an anilino, acylamino, ureido or sulfonamide group which may all have one or more substituents, $R^4$ is an organic substituent or a hydrogen atm, Za, Zb and Zc represent a methine, substituted methine, =N— or —NH— group, and either of a Za-Zb bond and a Zb-Zc bond is a double bond and the other is a single bond, when Zb-Zc is a carbon-carbon double bond, it may be a part of an aromatic ring, X and Y each represent a group capable of splitting off through coupling reaction with an oxidized form of aromatic primary amine developing agent.

3. The method according to claim 2, wherein the compound represented by general formula IV is one of compounds represented by general formula V to X:

General formula [V]

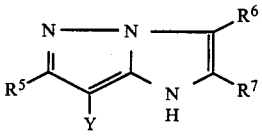

-continued

General formula [VI]

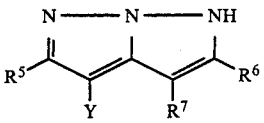

General formula [VII]

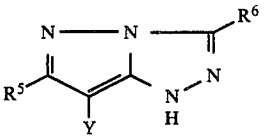

General formula [VIII]

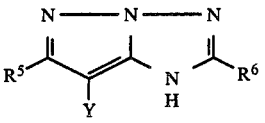

General formula [IX]

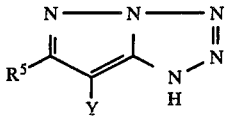

General formula [X]

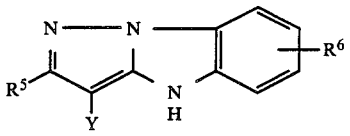

wherein $R^5$, $R^6$ and $R^7$ each represent aliphatic hydrocarbon, aromatic or heterocyclic groups, Y represents a halogen atom, such a group as to link the carbon atom at a coupling active site with an aliphatic group, aromatic group, heterocyclic group, aliphatic, aromatic or heterocyclic sulfonyl group or aliphatic, aromatic or heterocyclic carbonyl group through an oxygen, nitrogen or sulfur atom, or an aromatic azo group.

4. The method according to claim 2, wherein the compound represented by general formula IV is represented by general formula VIIII.

5. The method according to claim 1, wherein the amount of the 2-equivalent coupler is 20 wt% or more of the total amount of the whole magenta couplers.

6. The method according to claim 1, wherein the amount of the 2-equivalent coupler is 70 wt% or more of the total amount of the whole magenta couplers.

7. The method according to claim 1, wherein the light-sensitive material contains at least one desilvering accelerator represented by general formula XI or XII.

8. The method according to claim 1, wherein the desilvering accelerator is added in an amount of from $1\times10^{-5}$ to $1\times10^{-2}$ mole/m$^2$.

9. The method according to claim 1, wherein the total amount of coated silver is 5.0 g/m$^2$ or less.

10. The method according to claim 1, wherein a bleach-fixing bath in a bleach-fixing process contains the desilvering accelerator.

11. The method according to claim 1, wherein a bleaching bath of a pH of 5.5 or less in a bleaching process contains the desilvering accelerator.

12. A silver halide color photographic light-sensitive material having at least one red-sensitive silver halide emulsion layer, at least one green-sensitive silver halide emulsion layer and at least one blue-sensitive silver halide emulsion layer on a substrate, wherein the total amount of coated silver is 5.2 g/m$^2$ or less, the average iodide content based on the total amount of light-sensitive silver halide grains is 5.5 mol% or less; a 2-equivalent magenta polymer coupler is included as a magenta coupler; and at least one desilvering accelerator represented by general formula XI or XII.

13. The silver halide color photographic material according to claim 12, wherein the 2-equivalent magenta coupler is represented by formula I.

14. The silver halide color photographic material according to claim 12, wherein the compound represented by general formula IV is one of compounds represented by formula V to X.

15. The silver halide color photographic material according to claim 12, wherein the amount of the 2-equivalent coupler is 20 wt% or more of the total amount of magenta couplers.

16. The silver halide color photographic material according to claim 12, wherein the amount of the 2-equivalent coupler is 70 wt% or more of the total amount of magenta couplers.

17. The silver halide color photographic material according to claim 12, wherein the desilvering accelerator is incorporated in an amount of from $1\times10^{-5}$ to $1\times10^{-2}$ mol/m$^2$.

18. The silver halide color photographic material according to claim 12, wherein the total amount of coated silver is 5.0 g/m$^2$ or less.

* * * * *